US012297582B2

(12) United States Patent
Lee et al.

(10) Patent No.: US 12,297,582 B2
(45) Date of Patent: May 13, 2025

(54) LAUNDRY TREATING APPARATUS

(71) Applicant: LG ELECTRONICS INC., Seoul (KR)

(72) Inventors: Yunhi Lee, Seoul (KR); Jaehyun Kim, Seoul (KR); Hyunsun Yoo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 275 days.

(21) Appl. No.: 17/827,217

(22) Filed: May 27, 2022

(65) Prior Publication Data

US 2022/0380965 A1 Dec. 1, 2022

(30) Foreign Application Priority Data

May 28, 2021 (KR) ..... 10-2021-0069528
Jun. 1, 2021 (KR) ..... 10-2021-0071149
Aug. 23, 2021 (KR) ..... 10-2021-0110915
Sep. 9, 2021 (KR) ..... 10-2021-0120156

(51) Int. Cl.
*D06F 58/10* (2006.01)
*D06F 29/00* (2006.01)
*D06F 58/04* (2006.01)
*D06F 58/20* (2006.01)

(52) U.S. Cl.
CPC ..... *D06F 58/10* (2013.01); *D06F 29/005* (2013.01); *D06F 58/04* (2013.01); *D06F 58/20* (2013.01)

(58) Field of Classification Search
CPC ..... D06F 29/00; D06F 29/005; D06F 58/04; D06F 58/10; D06F 58/20; D06F 73/02
See application file for complete search history.

(56) References Cited

U.S. PATENT DOCUMENTS 7,320,234 B2 1/2008 Hershey et al.
2002/0017117 A1 2/2002 Sunshine et al.
2004/0194339 A1 10/2004 Johnson et al.
2006/0090524 A1* 5/2006 Jeon ..... D06F 29/005 68/135
2006/0112585 A1 6/2006 Choi et al.
2006/0156765 A1 7/2006 Sunshine et al.
2007/0119072 A1* 5/2007 Kim ..... D06F 58/26 34/550
2007/0151301 A1 7/2007 Kendall et al.
2007/0169519 A1 7/2007 Hershey et al.
2008/0229515 A1 9/2008 Hong et al.
(Continued)

FOREIGN PATENT DOCUMENTS

DE 10 2006 015 840 A1 10/2007
DE 10 2008 006 111 A1 7/2009
(Continued)

*Primary Examiner* — Joseph L. Perrin
(74) *Attorney, Agent, or Firm* — Birch, Stewart, Kolasch & Birch, LLP

(57) ABSTRACT

A laundry treating apparatus including an outer case; an inner case disposed in the outer case and providing a laundry receiving space; a supply air hole communicating with the laundry receiving space; a heat exchange channel having an inlet end where air is introduced and a discharge end where the air is discharged; a heating device for heating air passing through the heat exchange channel; and a supply air duct connecting the discharge end of the heat exchange channel and the supply air hole, the supply air duct is disposed in a rear of the inner case.

12 Claims, 24 Drawing Sheets

(56) References Cited

U.S. PATENT DOCUMENTS

| | | | | |
|---|---|---|---|---|
| 2009/0126421 | A1 | 5/2009 | Kim et al. | |
| 2011/0041564 | A1* | 2/2011 | Beihoff | D06F 58/206 165/104.19 |
| 2011/0185511 | A1 | 8/2011 | Ryoo et al. | |
| 2011/0252835 | A1* | 10/2011 | Beihoff | D06F 39/30 165/104.21 |
| 2014/0026433 | A1 | 1/2014 | Bison et al. | |
| 2016/0186374 | A1 | 6/2016 | Ryoo et al. | |
| 2020/0240065 | A1 | 7/2020 | Underly et al. | |
| 2021/0148029 | A1 | 5/2021 | Lv et al. | |

FOREIGN PATENT DOCUMENTS

| | | | |
|---|---|---|---|
| DE | 10 2008 064 737 | B3 | 8/2016 |
| EP | 1 029 961 | A2 | 8/2000 |
| JP | 2008-307151 | A | 12/2008 |
| KR | 10-0587360 | B1 | 6/2006 |
| KR | 10-2006-0060211 | A | 8/2006 |
| KR | 10-2006-0111128 | A | 10/2006 |
| KR | 10-0839519 | B1 | 6/2008 |
| KR | 10-2008-0100964 | A | 11/2008 |
| KR | 10-2019-0131259 | A | 11/2019 |
| KR | 10-2120993 | B1 | 6/2020 |
| KR | 10-2020-0109194 | A | 9/2020 |
| KR | 10-2254903 | B1 | 5/2021 |
| WO | WO 2007/148894 | A2 | 12/2007 |
| WO | WO 2011/149320 | A2 | 12/2011 |
| WO | WO 2014/017004 | A1 | 1/2014 |
| WO | WO 2017/119673 | A1 | 7/2017 |
| WO | WO 2019/141063 | A1 | 7/2019 |
| WO | WO 2019/154266 | A1 | 8/2019 |
| WO | WO 2021/083006 | A1 | 5/2021 |

* cited by examiner

LAUNDRY TREATING APPARATUS

CROSS-REFERENCE TO RELATED APPLICATIONS

This application claims the priority benefit of Korean Patent Application No. 10-2021-0069528, filed in the Republic of Korea on May 28, 2021, Korean Patent Application No. 10-2021-0071149, filed in the Republic of Korea on Jun. 1, 2021, Korean Patent Application No. 10-2021-0110915, filed in the Republic of Korea on Aug. 23, 2021, and Korean Patent Application No. 10-2021-0120156, filed in the Republic of Korea on Sep. 9, 2021, which are hereby incorporated by reference in their entirety for all purposes as if fully set forth herein.

BACKGROUND OF THE INVENTION

1. Field of the Invention

The present disclosure relates to a laundry treating apparatus including a duct for supplying air.

2. Description of the Related Art

Laundry treating machines, such as washing machines, dryers, and refreshers, are installed in different spaces, such as a kitchen, a utility room, a living room, and an outdoor space, according to usage in a residential space.

Korean Patent Publication of 10-2020-0109194 A discloses a washing machine. The washing machine washes laundry by supplying water and detergent into a tub and a drum and by rotating the drum in which the laundry is placed. In the washing machine, water from an external water source is supplied into the tub or the drum, and a pump is used to circulate the water in the tub to the drum or to discharge the water in the tub to the outside. The washing machine is generally installed in the kitchen or the utility room for supplying and discharging water.

The washing machine separately includes a heater for heating air, a blower fan, and a steam generator, to dry or sterilize the laundry.

Korean Patent No. 10-2120993 B discloses a dryer. The dryer may dry the laundry, placed in the drum, by heating air using a heating means and a blower fan and by supplying the heated air into the drum. The dryer is generally disposed adjacent to the washing machine, so as to dry the washed laundry and to allow a user to easily put the laundry containing moisture into the dryer.

By using the steam generator for generating steam and spraying the steam into the drum, the dryer may sterilize the laundry or may relieve wrinkles from the laundry. Water may be supplied into the dryer for generating the steam, and water not converted into steam may be reused or may be discharged to the outside. Further, in order to deodorize the dried laundry, the dryer may further have a deodorization function for filtering the circulated air.

Korean Patent No. 10-2254903 B discloses a refresher. The refresher may have functions, such as drying, deodorizing, de-wrinkling, de-static and/or sterilization (hereinafter referred to as "refreshing").

The refresher is used for treating clothes, such as suits and coats, which are frequently used by a user after washing. Generally, the user hangs the clothes, such as suits and coats, in a wardrobe. Accordingly, the refresher may be installed adjacent to the wardrobe, or may be installed instead of the wardrobe, in a dressing room, a living room, or a bedroom.

Further, not only for the clothes or garments, the refresher may also be used for all washable items, such as shoes, socks, gloves, hats, scarves, etc., which are worn by users, as well as dolls, towels, blankets, etc., which are frequently used by users.

However, the existing laundry treating machines, which are installed in different spaces, have a problem in that users need to move the laundry items, which are sorted by the user, to the respective laundry treating machines performing corresponding laundry treating processes, thereby requiring a longer workflow, and making the laundry treating processes uncomfortable.

In addition, as the refresher is installed in a different place from the washing machine and the dryer, it is cumbersome for users to move the washed wet laundry or the dried laundry to the place where the refresher is installed.

Furthermore, each of the existing laundry treating machines for treating the laundry using hot air and steam separately requires water supply equipment, drainage equipment, an air heater, a steam generator, a pump, a blower fan, an air passage, a steam passage, etc., thereby causing a problem in that a space for receiving clothes is reduced. In addition, each of the machines includes the heater, the steam generator, etc., thereby increasing costs and energy consumption of the entire system.

SUMMARY OF THE INVENTION

It is an object of the present disclosure to solve the above and other problems.

It is another object of the present disclosure to provide a laundry treating apparatus including a plurality of laundry treating machines.

It is yet another object of the present disclosure to provide a laundry treating apparatus including a washing machine, a dryer, and a refresher.

It is still another object of the present disclosure to provide a laundry treating apparatus capable of performing washing, drying, and refreshing of the laundry in the same space.

It is still another object of the present disclosure to provide a laundry treating apparatus capable of minimizing a user's workflow required for laundry treatment.

It is still another object of the present disclosure to provide a laundry treating apparatus capable of treating laundry which may not be subjected to high temperature drying in a space where washing and drying are performed.

It is still another object of the present disclosure to provide a laundry treating apparatus with improved workability in washing, drying, and refreshing of the laundry.

It is still another object of the present disclosure to provide a refresher having an extended longitudinal width.

It is still another object of the present disclosure to provide a laundry treating apparatus including a refresher having an extended longitudinal width.

It is still another object of the present disclosure to provide a laundry treating apparatus capable of reducing vibrations generated in the entire system (i.e., the laundry treating apparatus).

It is still another object of the present disclosure to provide a laundry treating apparatus capable of improving user convenience in manipulation by lowering the height of components, such as a door, a control panel, etc., which require manipulation by a user.

It is still another object of the present disclosure to provide a laundry treating apparatus in which upper surfaces of the plurality of laundry treating machines are aligned.

It is still another object of the present disclosure to provide a laundry treating apparatus in which front surfaces of the plurality of laundry treating machines are aligned.

It is still another object of the present disclosure to provide a laundry treating apparatus in which a laundry receiving space has an extended vertical height.

It is still another object of the present disclosure to provide a laundry treating apparatus in which a laundry receiving space in the refresher has an extended vertical height.

It is still another object of the present disclosure to provide a laundry treating apparatus using a difference between a longitudinal width of the refresher and a longitudinal width of the washing machine/dryer is used.

It is still another object of the present disclosure to provide a laundry treating apparatus having hot air passages for supplying air to the washing machine, the dryer, and the refresher.

It is still another object of the present disclosure to provide a laundry treating apparatus capable of supplying hot air to the plurality of laundry treating machines by using a single heating device.

It is still another object of the present disclosure to provide a laundry treating apparatus capable of supplying high temperature air to the refresher by using a heating device of the dryer.

It is still another object of the present disclosure to provide a laundry treating apparatus capable of supplying high temperature air to the dryer by using a heating device of the refresher.

It is still another object of the present disclosure to provide a laundry treating apparatus in which without increasing the entire size, a laundry treating space may increase in size by an efficient arrangement of supply air ducts and exhaust air ducts.

It is still another object of the present disclosure to provide a laundry treating apparatus in which water supply passages for reducing the temperature of hot air supplied to the refresher are arranged efficiently.

It is still another object of the present disclosure to provide a laundry treating apparatus capable of facilitating the drainage of condensate generated in the process of supplying hot air.

It is still another object of the present disclosure to provide a laundry treating apparatus capable of minimizing the length of hot air passages for supplying air to the washing machine, the dryer, and the refresher.

It is still another object of the present disclosure to provide a laundry treating apparatus having a steam passage for supplying steam to the washing machine, the dryer, and the refresher.

It is still another object of the present disclosure to provide a laundry treating apparatus capable of minimizing the length of a steam passage for supplying steam to the washing machine, the dryer, and the refresher.

It is still another object of the present disclosure to provide a laundry treating apparatus capable of supplying steam to the plurality of laundry treating machines using a single heating device.

It is still another object of the present disclosure to provide a laundry treating apparatus capable of facilitating the supply and drainage of water required for steam generation.

The objects of the present disclosure are not limited to the aforementioned objects and other objects not described herein will be clearly understood by those skilled in the art from the following description.

In accordance with an aspect of the present disclosure, the above and other objects can be accomplished by providing a laundry treating apparatus including: a case providing a laundry receiving space; a heating device for heating air; and supply air ducts disposed in a rear of the laundry receiving space. Accordingly, a height of the laundry receiving space may be extended.

The laundry treating apparatus may include an inner case. The inner case may provide the laundry receiving space. The inner case may be opened forward. The laundry receiving space may be opened forward.

The inner case may include a bottom defining a lower surface of the laundry receiving space. The inner case may include a rear wall defining a rear surface of the laundry receiving space. The inner case may include a ceiling defining an upper surface of the laundry receiving space.

The laundry treating apparatus may include an outer case. The outer case may form an outer appearance of the laundry treating apparatus. The outer case may be opened forward.

The inner case may be disposed in the outer case. An opening of the outer case and an opening of the inner case may overlap each other. The laundry receiving space may be opened by the openings. Through the openings, a user may put laundry into the laundry receiving space or may take the laundry out of the laundry receiving space.

The laundry treating apparatus may include a cabinet. The cabinet may include the outer case and the inner case. A combination of the outer case and the inner case may be referred to as a case or a cabinet. Alternatively, the outer case may be referred to as the cabinet, and the inner case may be defined separately from the cabinet.

A hanger may be provided at an upper portion of the laundry receiving space. A plurality of garments may be hung on the hanger.

The laundry treating apparatus may further include a door for opening and closing the laundry receiving space. The door may be coupled to the cabinet. The door may be rotatably coupled to the cabinet to open and close the laundry receiving space. The door may be coupled to the cabinet by a hinge.

The laundry treating apparatus may include a heat exchange channel. The heat exchange channel may have an inlet end where air is introduced. The heat exchange channel may have a discharge end where the air is discharged.

The heating device may heat air passing through the heat exchange channel. The heating device may be configured to heat the air passing through the heat exchange channel.

The heating device may be disposed in the heat exchange channel.

The heating device may be disposed above the bottom of the inner case. Accordingly, the bottom defining the lower surface of the laundry receiving space may be further lowered, thereby extending the height of the laundry receiving space. Accordingly, long clothes may be hung in the laundry receiving space and may be refreshed.

The heating device may be disposed below the ceiling of the inner case. The heating device may be disposed outside of the outer case. That is, by using a separate heating device, high temperature air may be supplied to the refresher having the laundry receiving space. Alternatively, by using a laundry treating machine having the heating device, high temperature air may be supplied to the refresher, which is another laundry treating machine and has the laundry receiving space.

The laundry treating machine having the heating device may be the dryer. Alternatively, the laundry treating machine having the heating device may be the washing machine.

The separate heating device may be disposed over (i.e., above) the refresher.

The separate heating device may be disposed on a lateral side of the refresher. The dryer may be disposed on the lateral side of the refresher. The washing machine may be disposed on the lateral side of the refresher. The washing machine may be disposed vertically with respect to the dryer. The separate heating device may be disposed vertically with respect to the dryer and the washing machine.

For example, the dryer may be disposed over the washing machine, and the heating device may be disposed between the washing machine and the dryer. The heating device may be a heating device provided separately from the dryer. Alternatively, the heating device may be a part of the dryer.

A supply air hole communicating with the laundry receiving space may be provided. The supply air hole may be formed in the inner case.

The supply air hole may be disposed at a lower portion of the inner case. The supply air hole may be formed in the bottom of the inner case. Alternatively, the supply air hole may be formed at a lower portion of the rear wall.

The supply air duct may be connected to the heat exchange channel. The supply air duct may be connected to the discharge end of the heat exchange channel.

The supply air duct may be connected to the supply air hole. The supply air duct may be connected to the inner case. The supply air duct may be coupled to the inner case.

The supply air duct may be disposed in a rear of the inner case. The supply air duct may extend vertically in the rear of the inner case. The supply air duct may extend vertically along the rear wall of the inner case.

The supply air duct may be connected to the discharge end of the heat exchange channel and may extend downwardly along the rear wall of the inner case to be connected to the supply air hole.

Accordingly, air heated by the heating device may be introduced into the lower portion of the laundry receiving space. The high temperature air introduced into the lower portion of the laundry receiving space may easily move upward. While moving upward, the high temperature air may sterilize, clean, dry, and/or refresh laundry placed in the laundry receiving space.

An exhaust air hole communicating with the laundry receiving space may be provided. The exhaust air hole may be formed in the inner case. The exhaust air hole may be formed at an upper portion of the inner case. The exhaust air hole may be formed at an upper portion of the rear wall of the inner case. Alternatively, the exhaust air hole may be formed at the ceiling of the inner case. The exhaust air hole may be disposed at a position above the hanger or at a height corresponding to the hanger.

The laundry treating apparatus may include an exhaust air duct connected to the heat exchange channel. The exhaust air duct may be connected to the inlet end of the heat exchange channel.

The exhaust air duct may be connected to the exhaust air hole. The exhaust air duct may be connected to the inner case. The exhaust air duct may be coupled to the inner case.

The exhaust air duct may be disposed in the rear of the inner case. The exhaust air duct may extend vertically in the rear of the inner case. The exhaust air duct may extend vertically along the rear wall of the inner case.

The exhaust air duct may extend downwardly from the exhaust air hole to be connected to the inlet end of the heat exchange channel.

Accordingly, the air used for sterilizing, cleaning, drying, and/or refreshing the laundry may return to the heat exchange channel through the exhaust air hole. The air discharged through the exhaust air hole may be heated by the heating device, and then may be supplied again to the laundry receiving space through the supply air hole.

The supply air hole and the exhaust air hole may be disposed vertically on opposite sides with respect to the heat exchange channel, such that the air may circulate vertically in the laundry receiving space.

As described above, the supply air hole may be disposed at the lower portion of the inner case, and the exhaust air hole may be disposed at the upper portion of the inner case. Accordingly, the high temperature air, introduced into the lower portion of the laundry receiving space, may move upward to refresh the laundry, and then may be discharged rapidly through the exhaust air hole. Accordingly, the air may circulate rapidly and may refresh the laundry rapidly.

Unlike the example, the supply air hole may be disposed at the upper portion of the inner case, the exhaust air hole may be disposed at the lower portion of the inner case. Accordingly, the high temperature air may rapidly flow through the supply air duct, thereby reducing energy loss which occurs while the air flows through the supply air duct. Accordingly, the high temperature air, introduced into the upper portion of the laundry receiving space, may be reduced in temperature and may gradually move downward. Accordingly, an upper portion of clothing, which may be relatively easily contaminated, may be efficiently sterilized, cleaned, dried, and/or refreshed.

The supply air duct may be disposed adjacent to the rear wall. The supply air duct may extend vertically at a position closer to the rear wall than the exhaust air duct, thereby reducing heat loss of the high temperature air flowing through the supply air duct.

In accordance with another aspect of the present disclosure, the above and other objects can be accomplished by providing a laundry treating apparatus including a dryer and a refresher disposed on a lateral side of the dryer.

The laundry treating apparatus may further include a washing machine disposed vertically with respect to the dryer. For example, the dryer may be disposed over the washing machine. An upper surface of the dryer may be aligned with an upper surface of the refresher. Alternatively, the washing machine may also be disposed over the dryer. In this case, an upper surface of the washing machine may be aligned with the upper surface of the refresher.

A front surface of the dryer may be aligned with a front surface of the refresher. The front surface of the dryer may be a front panel of a cabinet of the dryer or a door of the dryer. The front surface of the refresher may be a front panel of the refresher or a door of the refresher. For example, the front panel of the dryer and the door of the refresher may be disposed on a same plane. Alternatively, the front panel of the dryer and the front panel of the refresher may be disposed on a same plane, or the door of the dryer and the front panel of the refresher or the door of the refresher may be disposed on a same plane.

As in the dryer, a front surface of the washing machine may be aligned with the front surface of the refresher.

In addition, the front surfaces of the dryer and the washing machine may be aligned.

A longitudinal depth of the dryer may be greater than a longitudinal depth of the laundry receiving space of the refresher.

A duct for supplying air to at least one of the refresher, the dryer, and the washing machine may be disposed in a rear of the laundry receiving space. A rear case may be disposed in the rear of the laundry receiving space, and the duct may be disposed in the rear case.

A side surface of the dryer may be parallel to a side surface of the washing machine. The side surface of the dryer and the side surface of the washing machine may be disposed on a same plane.

The side surface of the dryer and the side surface of the refresher may face each other. The side surface of the dryer and the side surface of the refresher may be disposed parallel to each other. The side surface of the washing machine and the side surface of the refresher may face each other. The side surface of the washing machine and the side surface of the refresher may be disposed parallel to each other.

The side surface of the dryer (also referred to as a side surface of a first cabinet) and the side surface of the refresher (also referred to as a side surface of a second cabinet) may come into contact with each other. Alternatively, the side surface of the dryer and the side surface of the refresher may be close enough to allow a thin plate to be interposed therebetween. It can be said that the side surface of the dryer and the side surface of the refresher are disposed on substantially a same plane.

As described above, the side surface of the washing machine and the side surface of the refresher may be disposed on substantially the same plane.

Unlike the example, the side surface of the dryer and the side surface of the refresher, which face each other, may be spaced apart from each other. A storage box may be disposed in a space between the side surface of the dryer and the side surface of the refresher which are spaced apart from each other.

A second supply air duct may include an extension part extending across a rear of a space between the first cabinet and the second cabinet. The extension part may have a corrugated tube.

Accordingly, a length of the duct may be adjusted according to a distance between the refresher and the dryer.

The dryer may include a first cabinet, and a drum which is rotatably mounted in the first cabinet. The drum may be coupled to the motor by using a belt-pulley method. Alternatively, the drum may be coupled to the motor by using gears. Alternatively, the drum may be rotated by being directly coupled to a motor shaft.

The first cabinet may have an opening formed on a front side thereof. The opening may be connected to an inner space of the drum. Accordingly, through the opening, a user may put an object to be dried (also referred to as "laundry") into the drum or may take the object to be dried out of the drum.

The dryer may include a first door for opening and closing the opening. The first door may be coupled to the first cabinet. The first door may be rotatably coupled to the first cabinet.

The refresher may include an inner case providing a laundry receiving space. The inner case may provide the laundry receiving space. The inner case may be opened forward. The laundry receiving space may be opened forward.

The inner case may include a bottom defining a lower surface of the laundry receiving space. The inner case may include a rear wall defining a rear surface of the laundry receiving space. The inner case may include a ceiling defining an upper surface of the laundry receiving space.

The laundry treating apparatus may include an outer case disposed on a lateral side of the dryer. The outer case may form an outer appearance of the refresher. The outer case may be opened forward.

The inner case may be disposed in the outer case. An opening of the outer case and an opening of the inner case may overlap each other. The laundry receiving space may be opened by the openings. Through the openings, a user may put laundry into the laundry receiving space or may take the laundry out of the laundry receiving space.

The refresher may include a second cabinet. The second cabinet may include the outer case and the inner case. A combination of the outer case and the inner case may be referred to as a case or a cabinet. Alternatively, the outer case may be referred to as the cabinet, and the inner case may be defined separately from the cabinet.

A hanger may be provided at an upper portion of the laundry receiving space. A plurality of garments may be hung on the hanger.

The refresher may further include a second door for opening and closing the laundry receiving space. The second door may be coupled to the second cabinet. The second door may be rotatably coupled to the second cabinet to open and close the laundry receiving space. The second door may be coupled to the second cabinet by a hinge.

The washing machine may be disposed vertically with respect to the dryer. For example, the washing machine may be disposed under the dryer.

The washing machine may include: a third cabinet disposed vertically with respect to the first cabinet; an outer tub disposed in the third cabinet; and an inner tub rotatably mounted in the outer tub. The outer tub may be referred to as a tub, and the inner tub may be referred to as a drum.

The inner tub may be directly connected to the motor to be rotated thereby. The motor may be fixed to the tub. A rotating shaft of the motor may pass through a rear surface of the tub to be fixed to a rear surface of the drum.

Alternatively, the inner tub may be rotated by the motor using a belt-pulley method. Alternatively, the inner tub may be rotated by the motor using gears.

The cabinet may have an opening formed on a front side thereof.

The washing machine may have a third door coupled to the third cabinet to open and close the opening of the third cabinet.

The laundry treating apparatus may include a duct system. The duct system may be connected to the dryer and the refresher.

The duct system may include: a first supply air duct for supplying air into the drum of the dryer; a second supply air duct for supplying air into the laundry receiving space; and a heat exchange channel connected to the first supply air duct and the second supply air duct.

The duct system may further include a third supply air duct for supplying air into the tub of the washing machine and/or the drum. The heat exchange channel may be connected to the third supply air duct.

The heating device may heat air. The heating device may be configured to heat air passing through the heat exchange channel.

Accordingly, high temperature air may be supplied to the plurality of laundry treating machines by using a single heating device.

The heating device may be disposed on a lateral side of the refresher. The heating device may be disposed horizontally with respect to the refresher. The heating device may be disposed vertically with respect to the drum of the dryer.

The heating device may be disposed between the drum of the dryer and the outer tub of the washing machine.

The heat exchange channel may be disposed on the lateral side of the refresher. The heat exchange channel may be disposed horizontally with respect to the refresher. The heat exchange channel may be disposed vertically with respect to the drum.

The heat exchange channel may be disposed between the drum of the dryer and the outer tub of the washing machine.

The heating device may be disposed in the heat exchange channel.

In accordance with yet another aspect of the present disclosure, the above and other objects can be accomplished by providing a laundry treating apparatus including a plurality of laundry treating machines.

The plurality of laundry treating machines may be different types of laundry treating machines. For example, the laundry treating apparatus may include a dryer and a refresher. Alternatively, the laundry treating apparatus may include a dryer and a washing machine. Alternatively, the laundry treating apparatus may include a washing machine and a refresher. Alternatively, the laundry treating apparatus may include a dryer, a washing machine, and a refresher.

Alternatively, the plurality of laundry treating machines may be the same type of laundry treating machines. For example, the laundry treating apparatus may include a plurality of refreshers.

Alternatively, the plurality of laundry treating machines may be a plurality of the same type of laundry treating machines and laundry treating machines which are of different types. For example, the laundry treating apparatus may include two or more dryers and one or two or more refreshers.

The laundry treating apparatus may include a first laundry treating machine, a second laundry treating machine, and a third laundry treating machine.

The first laundry treating machine may be the aforesaid dryer or washing machine. For example, the laundry treating machine may be the dryer.

The second laundry treating machine may be disposed over the first laundry treating machine. The second laundry treating machine may be the dryer or the washing machine. For example, the second laundry treating machine may be the washing machine.

The third laundry treating machine may be disposed on a lateral side of the first laundry treating machine and the second laundry treating machine. The third laundry treating machine may be the refresher.

The laundry treating apparatus may include a duct system. The duct system may include: a first supply air duct for supplying air into a first drum of the first laundry treating machine; a second supply air duct for supplying air into a second drum of the laundry treating machine; and a heat exchange channel connected to the first supply air duct and the second supply air duct.

The heat exchange channel may be disposed under (i.e., below) the first drum.

The third supply air duct may connect a supply air hole, formed at a lower portion of the laundry receiving space, and the heat exchange channel.

The laundry treating apparatus may include a heating device configured to heat air passing through the heat exchange channel. The heating device may be disposed under the first drum.

The second supply air duct may be disposed in a rear of the third cabinet.

The second supply air duct may be disposed between a rear surface of the laundry receiving space and a rear surface of the first cabinet in a forward and backward direction.

Accordingly, convenience in drying after a washing cycle may be improved.

Accordingly, a length of a hot air passage connected to the first laundry treating machine (e.g. dryer) and the third laundry treating machine (e.g., refresher) may be minimized. Accordingly, heat loss of hot air supplied to the first and third laundry treating machines may be minimized.

Accordingly, the laundry treating apparatus including the plurality of laundry treating machines may be provided with a minimum change in existing laundry treating machines.

In accordance with still another aspect of the present disclosure, the above and other objects can be accomplished by providing a laundry treating apparatus including a first laundry treating machine and a second laundry treating machine. The laundry treating apparatus may further include a third laundry treating machine.

The first laundry treating machine may be the aforesaid dryer or washing machine. For example, the first laundry treating machine may be the dryer.

The third laundry treating machine may be disposed under the first laundry treating machine. The third laundry treating machine may be the aforesaid dryer or washing machine. For example, the third laundry treating machine may be the washing machine.

The second laundry treating machine may be disposed on a lateral side of the first laundry treating machine. The second laundry treating machine may be a refresher.

An upper surface of the first laundry treating machine and an upper surface of the second laundry treating machine may be disposed on a same plane.

The second laundry treating machine may include a second cabinet. The second cabinet may have a second opening which is opened forward. A laundry receiving space may be provided in the second cabinet.

The second laundry treating machine may have a second door for opening and closing the laundry receiving space. The second door may be couple to the second cabinet. The second door may be rotatably coupled to the second cabinet. The second door may be hingedly coupled to the second cabinet to open and close the second opening.

The second cabinet may include a first side panel facing the first cabinet of the first laundry treating machine, and a second side panel disposed on a side opposite to the first side panel. The second door may be hingedly coupled to the second cabinet at a position adjacent to the second side panel.

The second cabinet may include an outer case and an inner case.

The outer case may be disposed on a lateral side of the first laundry treating machine. The outer case may have a second opening formed on a front side thereof.

The inner case may be disposed in the outer case. The inner case may provide the laundry receiving space which is opened by the second opening.

The inner case may include a bottom defining a lower surface of the laundry receiving space. The inner case may include a rear wall defining a rear surface of the laundry receiving space. The inner case may include a ceiling defining an upper surface of the laundry receiving space.

A hanger may be provided at an upper portion of the laundry receiving space. A plurality of garments may be hung on the hanger.

The bottom of the inner case may include a first bottom, and a second bottom which is recessed downwardly from the first bottom. The laundry receiving space may include a first space disposed over the first bottom, and a second space disposed over the second bottom.

The first bottom and the second bottom may be arranged in a longitudinal direction of the hanger.

The second bottom may be disposed adjacent to the first side panel.

The laundry treating apparatus may include a duct system for supplying air to the first and second laundry treating machines. The duct system may include: a first supply air duct for supplying air into a drum of the first laundry treating machine; a second supply air duct for supplying air into the laundry receiving space.

The duct system may include a heat exchange channel connected to the first supply air duct and the second supply air duct.

The duct system may further include a third supply air duct for supplying air into a drum of a third laundry treating machine. The third supply air duct may supply air into a tub of the third laundry treating machine.

The first supply air duct may be disposed in a rear of the inner case. The third supply air duct may be disposed in the rear of the inner case.

The laundry treating apparatus may include a heating device for heating air. The heating device may be configured to heat air passing through the heat exchange channel.

The heating device may be disposed in the second cabinet. The heating device may be disposed under the bottom of the inner case. The heating device may be disposed under the first bottom.

Accordingly, the dryer and the washing machine may dry laundry (also referred to as an object to be dried) even without having a separate heating device.

Accordingly, the height of the laundry treating apparatus including the dryer and the washing machine may be reduced.

Accordingly, the height of a door of one of the dryer and the washing machine, which is disposed over the other, in the laundry treating apparatus may be reduced.

Accordingly, long clothes may be refreshed even when the heating device is disposed in the refresher.

The laundry treating apparatus may further include a control panel. A user may input a command for the first laundry treating machine through the control panel. The user may input a command for the second laundry treating machine through the control panel.

The control panel may be provided under the first door. The control panel may be disposed vertically between the first door and the second door.

Accordingly, the control panel for inputting a control command for one of the dryer and the washing machine, which is disposed over the other, in the laundry treating apparatus may be reduced in height.

Other detailed matters of the exemplary embodiments are included in the detailed description and the drawings.

Effects of the Invention

According to at least one of the embodiments of the present disclosure, there is provided a laundry treating apparatus including a plurality of laundry treating machines.

According to at least one of the embodiments of the present disclosure, there is provided a laundry treating apparatus including a washing machine, a dryer, and a refresher.

According to at least one of the embodiments of the present disclosure, there is provided a laundry treating apparatus, in which the washing machine, the dryer, and the refresher are disposed in the same space, thereby performing washing, drying, and refreshing in the same space.

According to at least one of the embodiments of the present disclosure, there is provided a laundry treating apparatus, in which laundry may be treated in the same space regardless of the type of laundry.

According to at least one of the embodiments of the present disclosure, there is provided a laundry treating apparatus, in which when washing, drying, and refreshing are performed, a user's load (e.g., amount of work, workflow, etc.) for moving the laundry may be reduced.

According to at least one of the embodiments of the present disclosure, there is provided a laundry treating apparatus in which the refresher may treat laundry which may not be subjected to high temperature drying in the same space where washing and drying are performed.

According to at least one of the embodiments of the present disclosure, there is provided a laundry treating apparatus, in which the washing machine and the refresher share one surface, thereby reducing vibrations generated in the washing machine.

According to at least one of the embodiments of the present disclosure, upper surfaces of the plurality of laundry treating machines may be aligned.

According to at least one of the embodiments of the present disclosure, front surfaces of the plurality of laundry treating machines may be aligned.

According to at least one of the embodiments of the present disclosure, a heating device for heating air supplied to the refresher is disposed vertically with respect to the dryer, such that a laundry receiving space in the refresher may have an extended height. In addition, by providing supply air ducts for supplying high temperature air into the laundry receiving space in the rear of the laundry receiving space, the laundry receiving space in the refresher may have an extended height.

According to at least one of the embodiments of the present disclosure, by providing hot air passages in a rear space of the refresher, a longitudinal width of the entire system may be uniformly aligned.

According to at least one of the embodiments of the present disclosure, hot air may be supplied to each of the washing machine, the dryer, and the refresher by using a single heating device.

According to at least one of the embodiments of the present disclosure, high temperature air may be supplied to the refresher by using a heating device of the dryer.

According to at least one of the embodiments of the present disclosure, high temperature air may be supplied to the dryer by using a heating device of the refresher.

According to at least one of the embodiments of the present disclosure, by providing supply air ducts and exhaust air ducts in the rear of the refresher, the size of a laundry treating space may be maximized. In addition, the entire size of the laundry treating apparatus may be maintained while increasing the laundry treating space.

According to at least one of the embodiments of the present disclosure, the heating device is positioned at an intermediate height of the refresher, thereby minimizing the length of hot air supply passages for supplying hot air to each of the washing machine, the dryer, and the refresher.

According to at least one of the embodiments of the present disclosure, a steam generator is positioned at an intermediate height of the refresher, thereby minimizing the length of a steam supply passage for supplying steam to each of the washing machine, the dryer, and the refresher.

According to at least one of the embodiments of the present disclosure, steam may be supplied to each of the washing machine, the dryer, and the refresher by using a single steam generator.

According to at least one of the embodiments of the present disclosure, there is provided a laundry treating apparatus capable of discharging condensate, generated by an evaporator, through a drain pump of the washing machine, thereby facilitating management of the condensate.

According to at least one of the embodiments of the present disclosure, there is provided a laundry treating apparatus capable of supplying water for steam generation through water supply pipes of the washing machine, thereby facilitating the steam generation.

According to at least one of the embodiments of the present disclosure, any one of a supply air hole and an exhaust air hole of the refresher is formed at an upper portion of the laundry receiving space, and the other one is formed at a lower portion of the laundry receiving space, thereby circulating air up and down in the laundry receiving space.

According to at least one of the embodiments of the present disclosure, the supply air hole of the refresher is formed at the lower portion of the laundry receiving space, such that high temperature air, introduced into the lower portion of the laundry receiving space, may easily move upward. In addition, while moving upward, the high temperature air may sterilize, clean, dry, and/or refresh the laundry placed in the laundry receiving space.

According to at least one of the embodiments of the present disclosure, the exhaust air hole of the refresher is formed at the upper portion of the laundry receiving space, such that the air used for sterilizing, cleaning, drying, and/or refreshing the laundry may return to a heat exchange channel through the exhaust air hole.

According to at least one of the embodiments of the present disclosure, the supply air hole of the refresher is formed at the lower portion of the laundry receiving space, and the exhaust air hole of the refresher is formed at the upper portion of the laundry receiving space, such that the high temperature air, introduced into the lower portion of the laundry receiving space, may refresh the laundry while move upward, and then may be discharged rapidly through the exhaust air hole. In addition, the air may circulate rapidly and may refresh the laundry rapidly.

According to at least one of the embodiments of the present disclosure, the supply air hole of the refresher is formed at the upper portion of the laundry receiving space, and the exhaust air hole of the refresher is formed at the lower portion of the laundry receiving space, such that high temperature air, introduced into the upper portion of the laundry receiving space, may be reduced in temperature and may gradually move downward. In addition, an upper portion of clothing, which may be relatively easily contaminated, may be efficiently sterilized, cleaned, dried, and/or refreshed.

According to at least one of the embodiments of the present disclosure, the supply air hole of the refresher is formed at the upper portion of the laundry receiving space, and the exhaust air hole of the refresher is formed at the lower portion of the laundry receiving space, such that high temperature air may move rapidly through the supply air ducts. In addition, energy loss may be reduced, which occurs during the flow of air through the supply air ducts.

According to at least one of the embodiments of the present disclosure, the supply air ducts extend vertically at a position relatively closer to the laundry receiving space than the exhaust air ducts, thereby reducing the heat loss of hot temperature air flowing through the supply air ducts.

According to at least one of the embodiments of the present disclosure, by changing the supply air ducts and the exhaust air ducts, or by applying a duct having a corrugated tube, a distance may be adjusted in a lateral direction of the dryer and the refresher.

Further scope of applicability of the present disclosure will become apparent from the detailed description given hereinafter. However, it should be understood that the detailed description and specific examples, while indicating preferred embodiments of the present disclosure, are given by illustration only, since various changes and modifications within the spirit and scope of the present disclosure will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention.

DETAILED DESCRIPTION OF THE PREFERRED EMBODIMENTS

Figure 1:
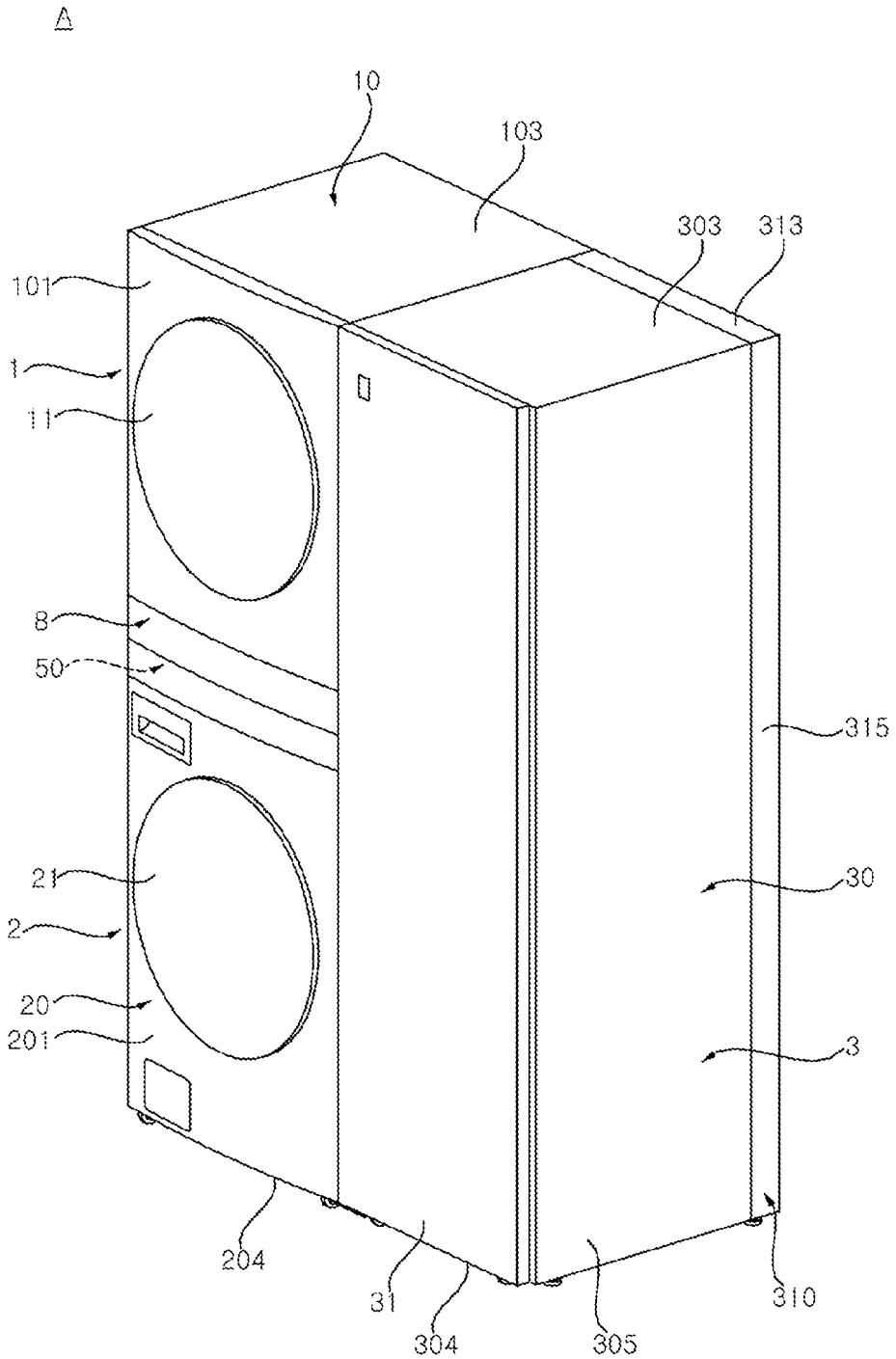
FIG. 1 is a front perspective view of a laundry treating apparatus according to an embodiment of the present disclosure.

Hereinafter, the present disclosure will be described in detail with reference to the accompanying drawings, in which the same reference numerals are used throughout the drawings to designate the same or similar components, and a redundant description thereof will be omitted.

Terms "module" and "unit" for elements used in the following description are given simply in view of the ease of the description, and do not have a distinguishing meaning or role.

It will be noted that a detailed description of known arts will be omitted if it is determined that the detailed description of the known arts can obscure the embodiments of the invention. Further, the accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

It will be understood that, although the terms first, second, etc., may be used herein to describe various elements, these elements should not be limited by these terms. These terms are only used to distinguish one element from another.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

As used herein, the singular forms are intended to include the plural forms as well, unless the context clearly indicates otherwise.

Hereinafter, an outer appearance of a laundry treating apparatus A will be described below with reference to FIG. 1.

The laundry treating apparatus A according to embodiments of the present disclosure may include one or more laundry treating machines. The laundry treating machines refer to devices for washing, drying, and/or refreshing objects (e.g., clothes, towels, bedding, etc.).

The laundry treating apparatus A may include a plurality of the same type of laundry treating machines. For example, the laundry treating apparatus A may include two or more dryers 1. For example, the laundry treating apparatus A may include two or more washing machines 2. For example, the laundry treating apparatus A may include two or more refreshers 3.

The laundry treating apparatus A may include different types of laundry treating machines. For example, the laundry treating apparatus may include the dryer 1, the washing machine 2, and the refresher 3.

The laundry treating apparatus A may include a plurality of the same type of laundry treating machines and laundry treating machines which are of different types. For example, the laundry treating apparatus A may include two or more washing machines, one dryer, and one refresher. For example, the laundry treating apparatus A may include one washing machine, one dryer, and two or more refreshers.

The laundry treating apparatus A of the present disclosure is not limited to the type and number of the laundry treating machines and may include various combinations thereof. The following description will be given of an example in which the laundry treating apparatus A includes one dryer 1, one washing machine 2, and one refresher 3, but the present disclosure is not limited thereto.

The dryer 1, the washing machine 2, and the refresher 3 may be referred to as any one of first to third laundry treating machines, respectively. For example, the dryer 1 may be referred to as the "first laundry treating machine," the washing machine 2 may be referred to as the "second laundry treating machine," and the refresher 3 may be referred to as the "third laundry treating machine." As described above, the ordinal numbers are used only for distinguishing one component from another, and unlike the above example, the dryer 1 may be referred to as the first laundry treating machine, the refresher 3 may be referred to as the second laundry treating machine, and the washing machine 2 may be referred to as the third laundry treating machine.

Figure 2:
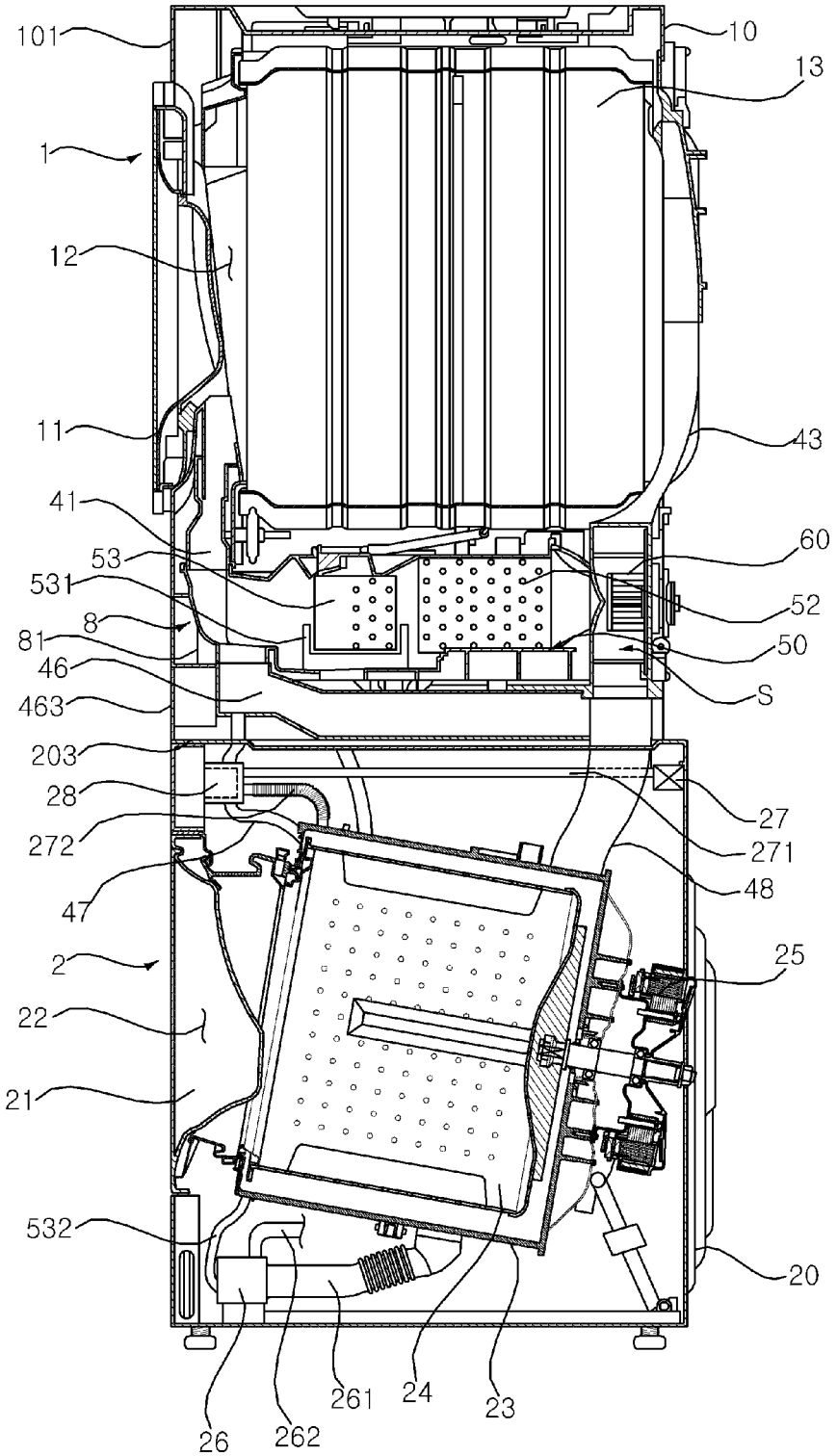
FIG. 2 is a cross-sectional view of the laundry treating apparatus illustrated in FIG. 1.

The laundry treating apparatus A may include a controller 81 (see FIG. 2). The controller 81 may control components of the present disclosure, such as the dryer 1, the washing machine 2, the refresher 3, the heating device 50, and the like. In the following description, it should be understood that controlling any component is performed by the controller 81, unless described otherwise herein.

The controller 81 is formed as a single controller, such that the single controller may control the overall operation of the laundry treating apparatus of the present disclosure. Alternatively, a plurality of controllers may be provided. The following description will be given of an example in which one controller 81 is provided, but the present disclosure is not limited hereto.

The controller 81 may be mounted on a Printed Circuit Board (PCB). The controller 81 may control the dryer 1, the washing machine 2, the refresher 3, and the heating device 50 based on an electrical signal received from a control panel 8 which will be described below. The controller 81 may communicate with the control panel 8.

The dryer 1 and the washing machine 2 may be vertically disposed. The control panel 8 may be disposed between the dryer 1 and the washing machine 2. The control panel 8 and the refresher 3 may be vertically disposed.

Accordingly, a command for one of the dryer 1 and the washing machine 2 which is disposed as a lower laundry treating machine (e.g., washing machine 2), as well as a command for one of the dryer 1 and the washing machine 2 which is disposed as an upper laundry treating machine (e.g., dryer 1) may be input through the control panel 8 provided under the door 11 (i.e., first door) of the dryer 1. In addition, a command for the refresher 3 may also be input through the control panel 8. Alternatively, commands for the dryer 1, the washing machine 2, and the refresher 3 may be input through the control panel 8 provided at the refresher 3.

A user may input a command to the laundry treating apparatus A through the control panel 8. By operating the control panel 8, the user may control the operations of the dryer 1, the washing machine 2, and the refresher 3. By operating the control panel 8, the user may control the operation of the heating device 50. The control panel 8 may transmit an electrical signal, input by the user's operation, to the controller 81.

A space for providing the PCB may be formed in the control panel 8. A controller may be mounted on the PCB. The controller may be the controller 81.

Alternatively, the controller 81 may be disposed on a rear surface of the control panel 8. The space for providing the PCB may be formed on the rear surface of the control panel 8. The controller 81 may be mounted on the PCB.

Alternatively, at least some of the washing machine 2, the dryer 1, the refresher 3, and a machine room S may include respective controllers for controlling each operation thereof. Even in this case, the respective controllers may be mounted on the PCB. The respective controllers may communicate with each other. In some cases, at least one controller may be an upper level controller that may control other controllers and devices.

The control panel 8 may display an operating state of the laundry treating apparatus A. The user may check information on the operating state of the laundry treating apparatus A through the control panel 8.

The laundry treating apparatus A may include the heating device 50. The heating device 50 may supply hot air to the dryer 1. The heating device 50 may supply hot air to the refresher 3. The heating device 50 may supply hot air to the washing machine 2. The hot air, supplied to the respective laundry treating machines, may be drawn into the heating device 50 again for circulation.

However, without circulating the hot air supplied to each of the washing machine 2, the dryer 1, and the refresher 3, the laundry treating apparatus of the present disclosure may discharge the hot air to the outside. That is, the laundry treating apparatus of the present disclosure may discharge the hot air supplied to a tub 23 of the washing machine 2 to the outside of the washing machine 2, may discharge the hot air supplied to a first drum 13 of the dryer 1 to the outside of the dryer 1, and may discharge the hot air supplied to an inner space 33 (i.e., laundry receiving space) of the refresher 3 to the outside of the refresher 3.

The laundry treating apparatus A may include the machine room S (see FIG. 2). The machine room S may provide a space in which the heating device 50 is disposed. The machine room S may be a concept that refers to a space in which the heating device 50 and components other than the heating device 50 are disposed. A pump, a blower fan, an air passage, a steam device, a steam passage, a dehumidification device, a controller, a motor, a fan housing, etc., in addition to the heating device 50, may be disposed in the machine room S. The machine room S may provide the space in which the aforementioned movable elements (a pump, a blower fan, an air passage, a steam device, a steam passage, a dehumidification device, a controller, a motor, and a fan housing) are disposed.

In the present disclosure, the machine room S may refer to the space in which the heating device 50 is disposed or may be an upper concept that encompasses the heating device 50.

The machine room S may include a separate case. When the machine room S includes the separate case, the machine room S may be separated from a first cabinet 10 and a second cabinet 20. Unlike the example, the machine room S may be disposed in any one of first to third cabinets 10, 20, and 30. In the case where the machine room S is disposed in any one of the first to third cabinets 10, 20, and 30, the machine room S may be a concept that refers to a space in which various components including the heating device 50 are disposed. That is, in the case where the machine room S is disposed in any one of the first to third cabinets 10, 20, and 30, the machine room S may refer to a portion of the inner space of the first to third cabinets 10, 20, and 30.

The machine room S may be vertically disposed with respect to the washing machine 2 and the dryer 1. The machine room S may be disposed over the washing machine 2 and the dryer 1. The machine room S may be disposed between the washing machine 2 and the dryer 1. The machine room S may be disposed under the washing machine 2 and the dryer 1. Unlike the example, the machine room S and the refresher 3 may be vertically disposed. The machine room S may be disposed over or under the refresher 3.

The heating device 50 may supply hot air to the washing machine 2. The heating device 50 may recover the hot air supplied to the washing machine 2.

The heating device 50 may supply hot air to the dryer 1. The heating device 50 may recover the hot air supplied to the dryer 1.

The heating device 50 may supply hot air to the refresher 3. The heating device 50 may recover the hot air supplied to the refresher 3.

The heating device 50 may supply steam to the washing machine 2. The heating device 50 may supply steam to the dryer 1. The heating device 50 may supply steam to the refresher 3.

The heating device 50 may include a heat pump device. The heat pump device may include a compressor 51, a condenser 52, an evaporator 53, and an expansion device 54 (see FIG. 5). The heating device 50 may include a fan 60 (see FIG. 5). The heat pump device may be referred to as a "heat exchange unit."

Figure 5:
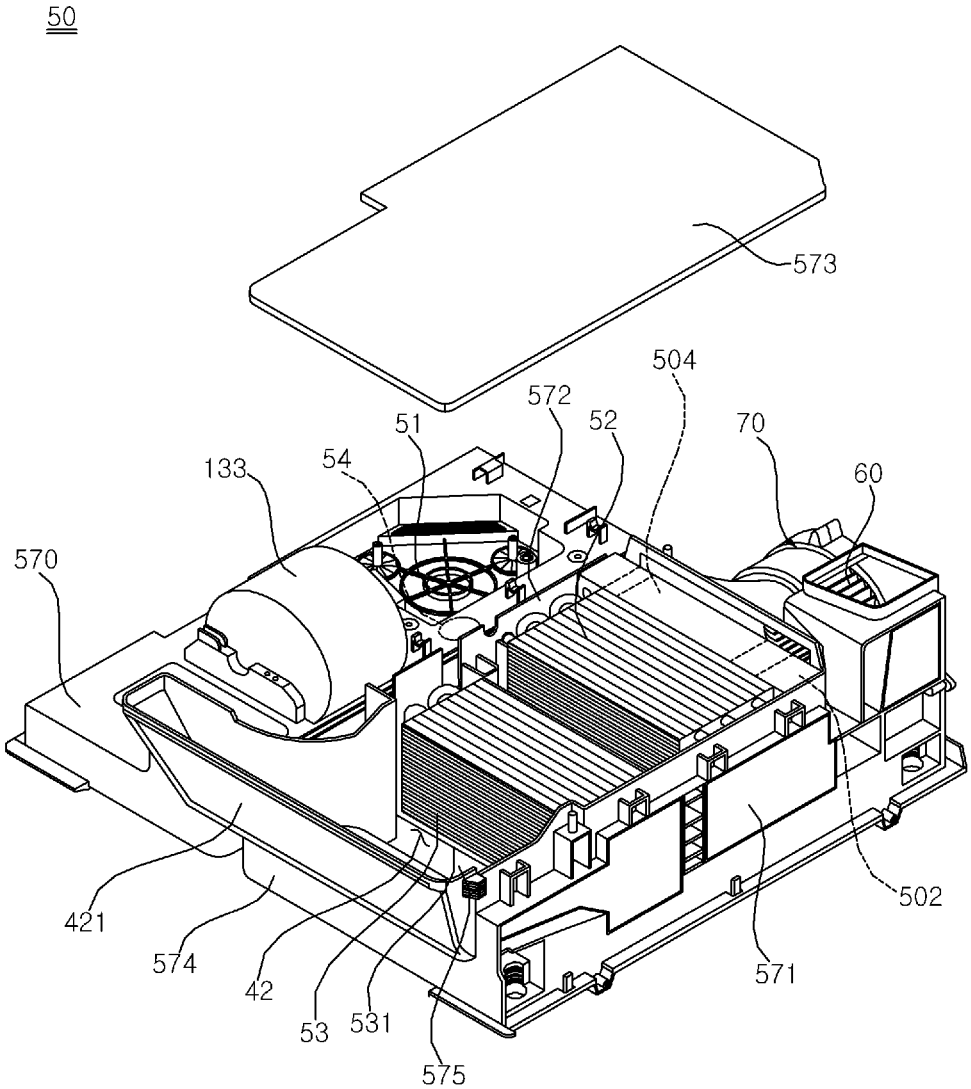
FIG. 5 is a perspective view of a heating device according to an embodiment of the present disclosure.

The heating device 50 may include a heat exchange unit for heating air flowing through a heat exchange channel 42 (see FIG. 5). The heat exchange unit may be a heat pump device connected by a refrigerant passage. The heat exchange unit may be a heater that operates using electricity as power. The heat exchange unit may be a heating device. The heat exchange unit may include the heater and a cooler. The cooler may be disposed on an upstream side of the heater. The cooler may be disposed in the heat exchange channel 42. The cooler may dehumidify and cool air passing through the heat exchange channel 42.

The heating device 50 may be vertically disposed with respect to the washing machine 2 and the dryer 1. The heating device 50 may be disposed over the washing machine 2 and the dryer 1, may be disposed between the washing machine 2 and the dryer 1, or may be disposed under the washing machine 2 and the dryer 1.

The heating device 50 and the refresher 3 may be vertically disposed. The heating device 50 may be disposed in a rear space of the refresher 3.

The heating device 50 may be disposed in the first cabinet 10. The heating device 50 may also be disposed in the second cabinet 20. The heating device 50 may also be disposed in the third cabinet 30.

The washing machine 2, the dryer 1, and the heating device 50 (or the machine room S) may be vertically arranged, and the refresher 3 may be disposed on a lateral side of the washing machine 2 and the dryer 1. The heating device 50 may be disposed on a lateral side of the refresher 3.

As illustrated in FIG. 1, an example will be described below in which the dryer 1 is disposed over the washing machine 2, and the heating device 50 is disposed between the washing machine 2 and the dryer 1. However, a vertical arrangement of the washing machine 2, the dryer 1, and the heating device 50 is not limited thereto.

The refresher 3 may be disposed on a lateral side of the washing machine 2 and the dryer 1. For example, as illustrated in FIG. 1, the refresher 3 may be disposed on the right side of the washing machine 2 and the dryer 1. However, an arrangement position of the refresher 3 is not limited to the above example, and the refresher 3 may be disposed on the left side of the washing machine 2 and the dryer 1.

A longitudinal width of the refresher 3 may be smaller than a longitudinal width of the washing machine 2 and the dryer 1.

A rear case 310, in which a hot air passage or a steam passage which will be described later is disposed, may be disposed in the rear of the refresher 3.

Accordingly, as a front surface (or door 31) of the refresher 3 is aligned with a front panel 201 of the washing machine 2, a passage connected to the refresher 3 may be arranged efficiently.

The washing machine 2 may include a second cabinet 20 having a second laundry loading opening 22 (see FIG. 2) formed on the front surface thereof, and a second door 21 rotatably coupled to the second cabinet 20.

By rotating the second door 21, a user may open the second laundry loading opening 22 and may put the laundry into a second drum 24 through the second laundry loading opening 22.

The dryer 1 may include the first cabinet 10 having a first laundry loading opening 12 (see FIG. 2) formed on the front surface thereof, and a first door 11 rotatably coupled to the first cabinet 10.

By rotating the first door 11, the user may open the first laundry loading opening 12 and may put the laundry into the first drum 13 through the first laundry loading opening 12.

The refresher 3 includes a third cabinet 30 including an inner space for receiving laundry and having a third laundry loading opening 32 (see FIG. 3), and a third door 31 rotatably coupled to the third cabinet 30. The third door 31 may be coupled to the third cabinet 30 by a hinge. The third laundry loading opening 32 may be referred to as an "opening."

By rotating the third door 31, the user may open the third laundry loading opening 32 and may load the laundry into the third cabinet 30 through the third laundry loading opening 32.

Each of the first cabinet 10, the second cabinet 20, and the third cabinet 30 may include an upper panel, a lower panel, a front panel, a rear panel, and side panels.

The first cabinet 10 may include a first upper panel 103, a first lower panel 104, a first front panel 101, a first rear panel 102, and first side panels 105 and 106.

The second cabinet 20 may include a second upper panel 203, a second lower panel 204, a second front panel 201, a second rear panel 202, and second side panels 205 and 206.

The third cabinet 30 may include a third upper panel 303, a third lower panel 304, a third front panel 301, a third rear panel 302, and third side panels 305 and 306. The third cabinet 30 may include the third door 31 instead of the third front panel 301.

A plate may be disposed in a space between the washing machine 2 and the refresher 3 and in a space between the dryer 1 and the refresher 3. The plate may be a damping material. The dryer 1, the washing machine 2, and the refresher 3 may be coupled to each other by the plate.

The first upper panel 103 of the dryer 1 and the third upper panel 303 of the refresher 3 may be disposed on the same horizontal plane. The third upper panel 303 of the refresher 3 and an upper wall 313 of the rear case 310 may be disposed on the same horizontal plane.

The third side panel 305 of the refresher 3 and the side wall 315 of the rear case 310 may be disposed on the same plane.

The front panel 201 of the washing machine 2, the front panel 101 of the dryer 1, and the control panel 8 may be disposed on the same plane.

The third door 31 of the refresher 3 may be disposed parallel to the front panel 201 of the washing machine 2, the front panel 101 of the dryer 1, and the control panel 8. The third door 31 of the refresher 3 may be disposed on the same plane as the front panel 201 of the washing machine 2, the front panel 101 of the dryer 1, and the control panel 8. Alternatively, the third door 31 of the refresher 3 may be disposed parallel to or on the same plane as the second door 21 of the washing machine 2 and the first door 11 of the dryer 1.

The second lower panel 204 of the washing machine 2 and the third lower panel 304 of the refresher 3 may be disposed on the same horizontal plane.

The rear case 310 may be disposed in the rear of the third cabinet 30. Alternatively, as a portion of the third cabinet 30, the rear case 310 may be a component disposed in the rear of the third cabinet 30.

Hereinafter, an internal structure of the dryer 1, the washing machine 2, and the heating device 50 will be described with reference to FIG. 2. FIG. 2 is a cross-sectional view of the dryer 1 and the washing machine 2 of the laundry treating apparatus A.

The washing machine 2 includes the second cabinet 20, the second door 21 rotatably coupled to the second cabinet 20, the tub 23 disposed in the second cabinet 20, and the second drum 24 which is rotatably disposed in the tub 23 and in which laundry is received. Further, the washing machine 2 includes a motor 25 for rotating the second drum 24, a drain pump 26 for discharging water, generated in the laundry treating apparatus A, to the outside, a water supply valve 27 (FIG. 2) connected to an external water source, and a drawer 28 in which detergent is stored. Hereinafter, the tub 23 may also be referred to as an "outer tub," and the second drum 24 may also be referred to as an "inner tub."

The drain pump 26 may be connected to the tub 23 by a first drain pipe 261. The drain pump 26 may discharge water, introduced through the first drain pipe 261 and a drain pipe 532, to the outside of the laundry treating apparatus A through a second drain pipe 262.

The water supply valve 27 may open and close water supply lines 278 and 279 (see FIG. 9) connecting the external water source and the washing machine 2. The water supply valve 27 may control a flow rate of water flowing into the washing machine 2 from the external water source. The water supply valve 27 may be connected to a first water supply pipe 271. The first water supply pipe 271 may be connected to the drawer 28 in which the detergent is stored. The water flowing into the drawer 28 through the first water supply pipe 271 may flow into the tub 23 along with the detergent in the drawer 28 through a second water supply pipe 272.

The dryer 1 includes the first cabinet 10, the first door 11 rotatably coupled to the first cabinet 10, and the first drum 13 which is rotatably mounted in the first cabinet 10 and in which the laundry is received.

The dryer 1 may include a motor 133 (see FIG. 5) for rotating the first drum 13. A pulley may be fixed to a rotating shaft of the motor 133. A belt may connect the pully with a circumferential surface of the drum 13, such that torque of the motor 133 may be transferred to the drum 13 via the pulley and the belt.

The motor 133 may be disposed under the first drum 13. The motor 133 may be disposed in the heating device 50. The motor 133 may be disposed on a lateral side of the heat exchange channel 42. A motor mounting portion 133*s* (see FIG. 5) may be provided in a case 570 (see FIG. 5) of the heating device 50.

Unlike the example, the motor 133 may be directly coupled to the first drum 13 to rotate the first drum 13.

The heating device 50 may be disposed over the second upper panel 203. The heating device 50 may be disposed in the first cabinet 10. The heating device 50 may be disposed at a lower portion of the dryer 1.

The heating device 50 includes: a condenser 52 for performing heat exchange between a high-temperature refrigerant and air to heat the air; a fan 60 for blowing air heated by passing through the condenser 52; and an evaporator 53 for performing heat exchange between the air flowing into the heating device 50 and a low-temperature refrigerant to cool and dehumidify the air. The condenser 52 and the evaporator 53 may be referred to as a "heat exchange unit."

The air heated by passing through the condenser 52 (hereinafter referred to as "hot air") may be blown by the fan 60, and may be supplied to at least one of the washing machine 2, the dryer 1, or the refresher 3.

The heating device 50 may be connected to the first drum 13 by a first supply air duct 43. The hot air generated by the heating device 50 may be blown by the fan 60 to be supplied into the first drum 13 through the first supply air duct 43. The first supply air duct 43 may extend upwardly from the heating device 50.

The heating device 50 may be connected to the tub 23 by a third supply air duct 48. The hot air generated by the heating device 50 may be blown by the fan 60 to be supplied into the tub 23 through the third supply air duct 48. The third supply air duct 48 may extend downwardly from the heating device 50.

The hot air generated by the heating device 50 may be blown by the fan 60 to be supplied to the outside of the laundry treating apparatus A through a dehumidification duct 46. The dehumidification duct 46 may be disposed between a base plate 575 to be described below and the second upper panel 203. The air blown by the fan 60 may be supplied into an indoor space through the dehumidification duct 46. An opening member 463 may be disposed at a front side of the dehumidification duct 46. The opening member 463 may open and close the front side of the dehumidification duct 46. The opening member 463 may be rotatably coupled to the first cabinet 10 or the second cabinet 20.

The supply air ducts 43, 45, and 48 may be referred to as any one of first to third supply air ducts. For example, the supply air duct connected to the dryer 1 may be referred to as a first supply air duct 43; the supply air duct connected to the refresher 3 may be referred to as a second supply air duct 45, and the supply air duct connected to the washing machine 2 may be referred to as a third supply air duct 48. The supply air ducts 43, 45, and 48 may be referred to as "supply ducts." The respective first, second, and third supply air ducts 43, 45, and 48 may be referred to as any one of the "first to third supply ducts." For example, the first supply air duct 43 may be referred to as a first supply duct; the second supply air duct 45 may be referred to as a second supply duct; and the third supply air duct 48 may be referred to as a third supply duct. The supply air ducts 43, 45, and 48 may be referred to as "supply pipes." The respective first, second, and third supply air ducts 43, 45, and 48 may be referred to as any one of the "first to third supply pipes." For example, the first supply air duct 43 may be referred to as a first supply pipe; the second supply air duct 45 may be referred to as a second supply pipe; and the third supply air duct 48 may be referred to as a third supply pipe.

The air supplied to the washing machine 2, the dryer 1, or the refresher 3 may return to the heating device 50.

The heating device 50 may be connected to the first drum 13 by a first exhaust air duct 41. The hot air flowing into the first drum 13 through the first supply air duct 43 may dry the laundry placed in the first drum 13, and then may return to the heating device 50 through the first exhaust air duct 41. The first exhaust air duct 41 may extend downwardly from the first drum 13.

The heating device 50 may be connected to the tub 23 by a third exhaust air duct 47. The washing machine 2 may be connected to the heating device 50 by the third supply air duct 48 and the third exhaust air duct 47.

The third supply air duct 48 may be connected to the tub 23. The third supply air duct 48 may be connected to an upper portion of the tub 23. The third supply air duct 48 may be connected to a rear portion of the tub 23.

The third exhaust air duct 47 may be connected to the tub 23. The third exhaust air duct 47 may be connected to an upper portion of the tub 23. The third exhaust air duct 47 may be connected to a front portion of the tub 23 or a gasket. The gasket may be a component connecting a front opening of the tub and a front opening of the cabinet.

The hot air flowing into the tub 23 through the third supply air duct 48 may dry the laundry placed in the second drum 24, and then may return to the heating device 50 through the third exhaust air duct 47. The third exhaust air duct 47 may extend upwardly from the tub 23.

The exhaust air ducts 41, 44, and 47 may be referred to as any one of first to third exhaust air ducts. For example, the exhaust air duct connected to the dryer 1 may be referred to as a first exhaust air duct 41; the exhaust air duct connected to the refresher 3 may be referred to as a second exhaust air duct 44; and the exhaust air duct connected to the washing machine 2 may be referred to as a third exhaust air duct 47. The exhaust air ducts 41, 44, and 47 may be referred to as "discharge ducts" or "return ducts." The respective first, second, and third exhaust air ducts 41, 44, and 47 may be referred to as any one of "first to third discharge ducts." For example, the first exhaust air duct 41 may be referred to as a first discharge duct, the second exhaust air duct 44 may be referred to as a second discharge duct, and a third exhaust air duct 47 may be referred to as a third discharge duct. The respective first, second, and third exhaust air ducts 41, 44, and 47 may be referred to as any one of "first to third return ducts." For example, the first exhaust air duct 41 may be referred to as a first return duct, the second exhaust air duct 44 may be referred to as a second return duct, and a third exhaust air duct 47 may be referred to as a third return duct. The respective first, second, and third exhaust air ducts 41, 44, and 47 may be referred to as any one of "first to third return lines." For example, the first exhaust air duct 41 may be referred to as a first return line, the second exhaust air duct 44 may be referred to as a second return line, and a third exhaust air duct 47 may be referred to as a third return line.

The hot air generated by the heating device 50 may be supplied to the washing machine 2, the dryer 1, and the refresher 3 to dry the laundry placed in the respective laundry treating machines 1, 2, and 3, and then may return to the heating device 50. That is, the hot air generated in the heating device 50 may circulate within the laundry treating apparatus A. The hot air, returning to the heating device 50 after drying the laundry placed in each of the laundry treating machines 1, 2, and 3, may contain a greater amount of moisture than the air for drying the laundry placed in one laundry treating machine.

By performing heat exchange between the air returning to the heating device 50 and a refrigerant, the evaporator 53 may reduce the temperature of the returning air and removes moisture contained in the air. The air returning to the heating device 50 may be heat exchanged with the evaporator 53 to generate condensate.

The heating device 50 may include a drain pan 531 disposed under the evaporator 53. The drain pan 531 may receive the condensate generated in the evaporator 53.

The drain pan 531 may be connected to the drain pump 26 by the drain pipe 532. The drain pipe 532 may extend downwardly from the drain pan 531 to be connected to the drain pump 26.

The condensate collected in the drain pan 531 may flow to the drain pump 26 through the drain pipe 532, and may be discharged to the outside of the laundry treating apparatus A by the drain pump 26.

Figure 3:
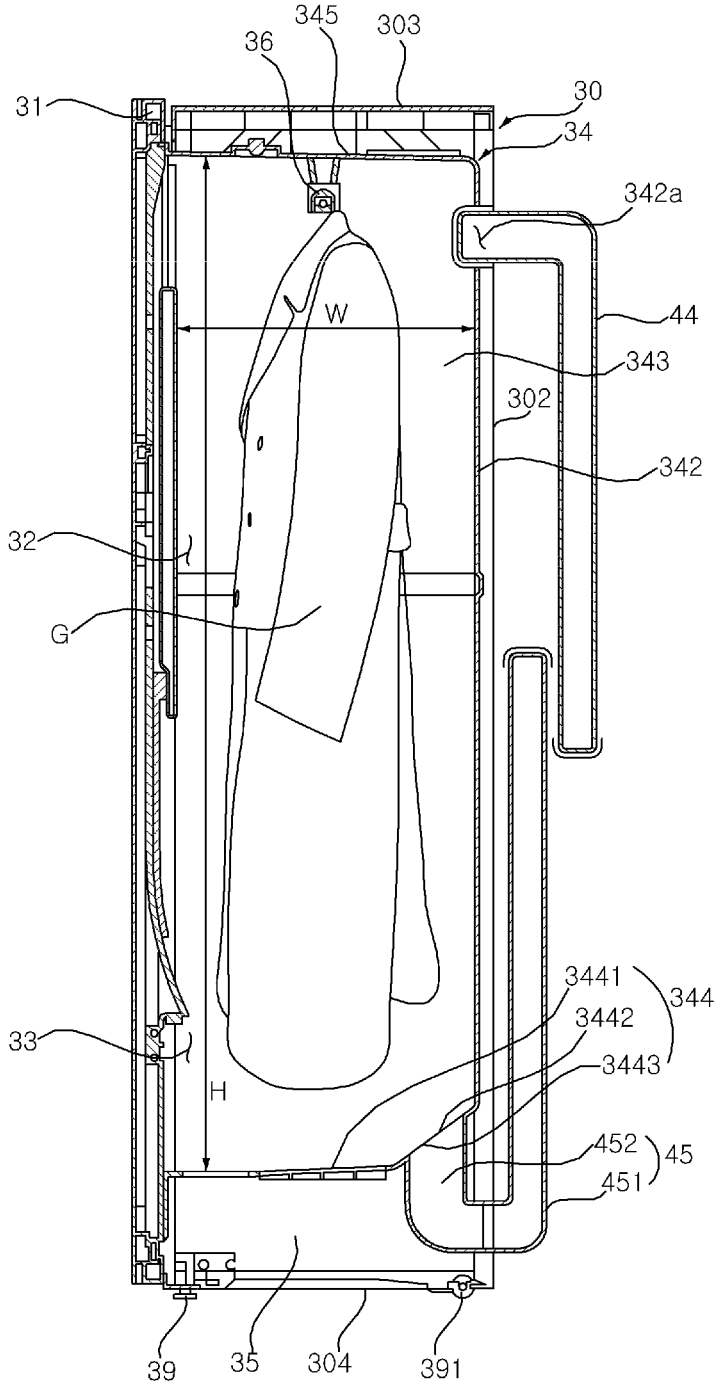
FIG. 3 is a cross-sectional view of the refresher illustrated in FIG. 1.

Hereinafter, an internal structure of the refresher 3 will be described with reference to FIG. 3. FIG. 3 is a cross-sectional view of the refresher 3 of the laundry treating apparatus A.

Referring to FIG. 3, the refresher 3 may include the third cabinet 30 having an inner space for receiving laundry.

The third cabinet 30 may include an outer case, and an inner case 34 disposed in the outer case. The outer case may be a concept that refers to outer panels 301, 302, 303, 304, 305, and 306 of the third cabinet 30.

Unlike the example, the outer panels 301, 302, 303, 304, 305, and 306 may be defined as the third cabinet 30, and the inner case 34 may be defined as a portion disposed in the third cabinet 30.

The inner case 34 may provide an inner space 33, and laundry may be placed in the space 33. The inner case 34 may include a bottom 344, a lateral side 343, a rear wall 342, and a ceiling 345.

The inner case 34 may include the ceiling 345 forming an upper surface thereof. The ceiling 345 may be connected to the lateral side 343 and an upper portion of the rear wall 342.

The refresher 3 may include a hanger 36, on which clothing is hung. The hanger 36 may be provided in a laundry receiving space 33. The hanger 36 may be connected to the ceiling 345. The hanger 36 may be held to the ceiling 345. The hanger 36 may be coupled to the ceiling 345.

Garments G placed in the inner space 33 of the third cabinet 30 may be hung on the hanger 36.

The height H of the inner space 33 may refer to a height between the ceiling 345 and the bottom 344. The height H of the inner space 33 may be extended compared to a case where the heating device 50 is disposed between the bottom 344 and the third lower panel 304. Accordingly, unlike an existing refresher, the refresher 3 of the present disclosure may receive garments G having a great vertical height, such as long coats or suits.

In addition, compared to the existing refresher, the refresher 3 of the present disclosure may have an extended longitudinal width according to the longitudinal width of the washing machine 2 and the dryer 1. Accordingly, the refresher 3 of the present disclosure may receive a larger number of garments in a forward and backward direction than the existing refresher. The longitudinal width W of the refresher 3 may refer to a width between the third door 31 and the third rear panel 302.

A storage space 35 may be formed between the bottom 344 and the third lower panel 304. Relatively small clothing items, such as socks, underwear, hats, scarves, gloves, etc., may be placed in the storage space 35. Alternatively, the height H of the laundry receiving space may increase by removing the storage space 35 or by reducing the height of the storage space 35.

The bottom 344 may form a lower surface of the inner case 34. The bottom 344 may define a lower end of the laundry receiving space 33. The bottom 344 may be disposed parallel to the third lower panel 304.

The bottom 344 may include a first bottom surface 3441 disposed in the front thereof, and a second bottom surface 3442 disposed in the rear thereof. A supply air hole 3443 may be formed in the bottom 344.

The supply air hole 3443 may be formed in the second bottom surface 3442. The second bottom surface 3442 may be inclined upwardly and forwardly.

The supply air hole 3443 may be connected to the second supply air duct 45. The supply air hole 3443 may allow the laundry receiving space 33 to communicate with the second supply air duct 45. Air in the second supply air duct 45 may be introduced into the laundry receiving space 33 through the supply air hole 3443.

Unlike the example, the supply air hole 3443 may also be provided in the rear wall 342.

The rear wall 342 may form a rear surface of the inner case 34. The rear wall 342 may be disposed parallel to the rear panel 302. The rear wall 342 may extend upwardly from the bottom 344.

The second supply air duct 45 may be disposed in the rear of the inner case 34. The second supply air duct 45 may be disposed in the rear of the rear wall 342. The second supply air duct 45 may extend along the rear wall 342. The second supply air duct 45 may extend vertically along the rear wall 342. The second supply air duct 45 may include a first hot air duct 451 disposed in the rear of the third rear panel 302, and a second hot air duct 452 disposed in the front of the third rear panel 302.

The first hot air duct 451 may be disposed in the rear case 310. The second hot air duct 452 may be disposed in the storage space 35. The first hot air duct 451 and the second hot air duct 452 may be coupled to the third rear panel 302. The first hot air duct 451 may extend upwardly in the rear case 310 to be connected to the heating device 50. The second hot air duct 452 may extend upwardly to be connected to the second bottom surface 3442.

An exhaust air hole **342*a* may be formed in the rear wall 342. The exhaust air hole 342*a* may be formed at an upper portion of the rear wall 342**.

The exhaust air hole 342*a* may be connected to the second exhaust air duct 44. The exhaust air hole 342*a* may allow the laundry receiving space 33 to communicate with the second exhaust air duct 44. The air in the laundry receiving space 33 may be discharged to the second exhaust air duct 44 through the exhaust air hole 342*a*.

The second exhaust air duct 44 may be disposed in the rear of the inner case 34. The second exhaust air duct 44 may be disposed in the rear of the rear wall 342. The second exhaust air duct 44 may extend along the rear wall 342. The second exhaust air duct 44 may extend vertically along the rear wall 342.

The hot air discharged into the inner space 33 of the refresher 3 may dry the garments G, and then may flow into the second exhaust air duct 44 through the exhaust air hole 302*a*.

The second exhaust air duct 44 may pass through the third rear panel 302 to extend into the rear case 310. After passing through the third rear panel 302, the second exhaust air duct 44 may extend downwardly in the rear case 310 to be connected to the heating device 50.

The heating device 50 may be positioned at an approximately intermediate height of the refresher 3 (see FIG. 1). The second supply air duct 45 may extend downwardly from the heating device 50 to be connected to the supply air hole 3443. The second exhaust air duct 44 may extend upwardly from the heating device 50 to be connected to the exhaust air hole 342*a*.

The second supply air duct 45 may be disposed ahead of the exhaust air duct 44. The second supply air duct 45 may extend along the rear wall 342 at a position closer to the rear wall 342 than the exhaust air duct 44.

Accordingly, high temperature air, introduced into the laundry receiving space 33 through the supply air hole 3443 formed at a lower portion of the laundry receiving space 33, may move upward and may be discharged smoothly through the exhaust air hole 342*a* formed at an upper portion of the laundry receiving space 33.

Accordingly, without remaining stagnant in the laundry receiving space 33, the air may circulate smoothly between the heating device 50 and the laundry receiving space 33.

Accordingly, the passage for introducing air into the laundry receiving space 33 and the passage for discharging air from the laundry receiving space 33 may be arranged efficiently.

Accordingly, it is possible to reduce the loss of heat energy of the high temperature air, flowing through the supply air duct 45, when the heat energy is lost to a region other than the laundry receiving space 33.

The refresher 3 may include legs 39 protruding downwardly from the third lower panel 304. A plurality of legs 39 may be spaced apart from each other in a forward and backward direction. Among the legs 39, a leg disposed in the rear may be a roller 391 which is rotatable. A leg and roller structure of the refresher 3 may also be applied to the second lower panel 204 of the washing machine 2. The rollers of the washing machine 2 and the refresher 3 may serve to support the weight of the laundry treating apparatus A when the laundry treating apparatus A is moved.

Figure 4:
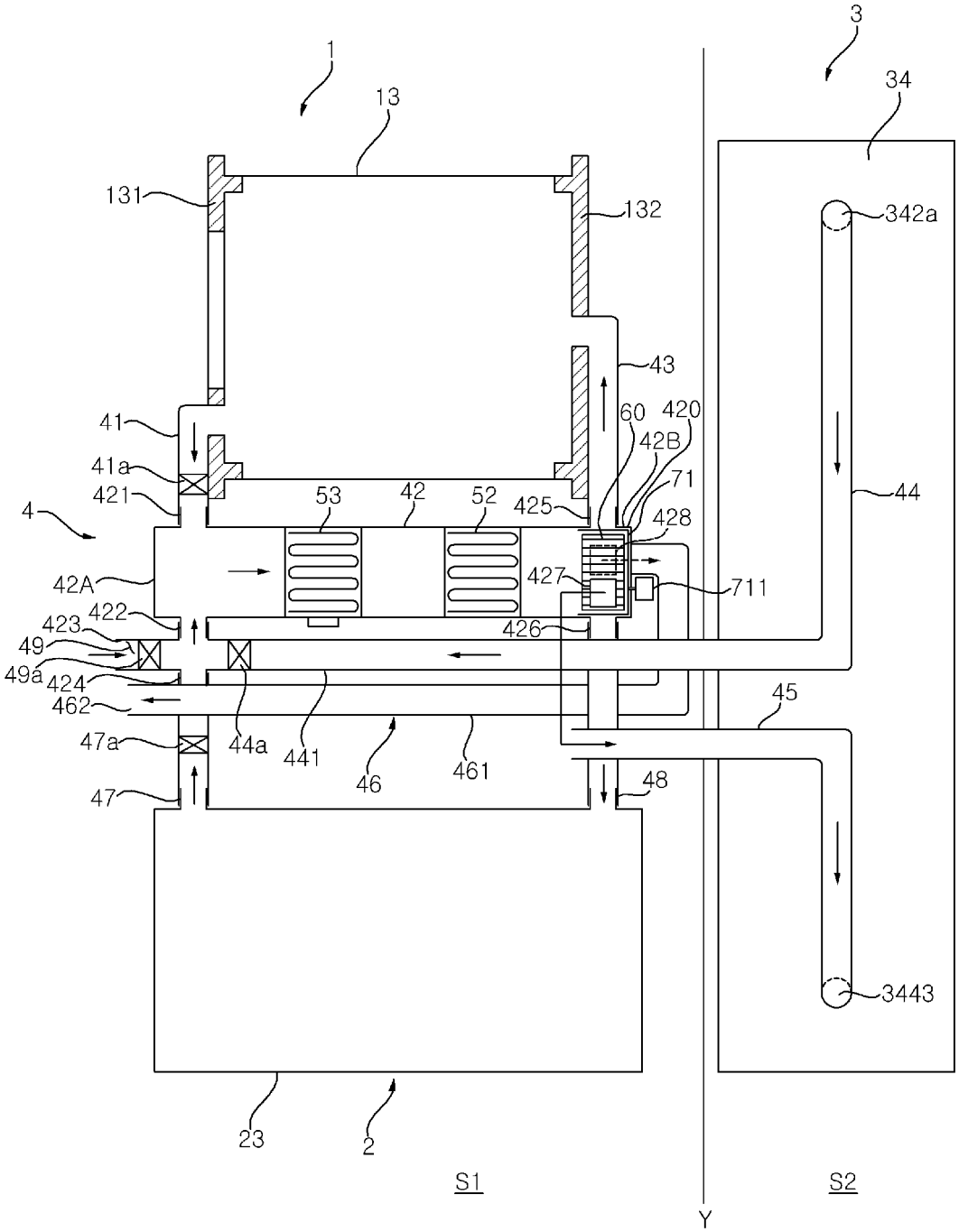
FIG. 4 is a conceptual diagram illustrating a duct system according to an embodiment of the present disclosure.

Hereinafter, a duct system in the laundry treating apparatus A according to the present disclosure will be described with reference to FIG. 4. In FIG. 4, the left of a reference line Y shows a duct system of the dryer 1 and the washing machine 2, and the right of the reference line Y shows a duct system of the refresher 3. The left of the reference line Y in FIG. 4 is a conceptual view illustrating a duct system in which the dryer 1 and the washing machine 2 are cut by a plane perpendicular to a left and right direction; and the right of the reference line Y in FIG. 4 is a conceptual view of a rear surface of the refresher 3 to show the duct system. The directions used in the description of FIG. 4 may be the same as those illustrated in FIG. 1.

The left of the reference line Y in FIG. 4 may be referred to as a first conceptual view S1. The right of the reference line Y in FIG. 4 may be referred to as a second conceptual view S2.

A duct system 4 may be a concept that collectively refers to passages of hot air circulating in the laundry treating apparatus A. The duct system 4 may be a concept that collectively refers to passages connecting the heating device 50, the dryer 1, the washing machine 2, and the refresher 3. The duct system 4 may be a concept that collectively refers to passages of air heated by the heating device 50.

The heating device 50 heats air and supplies the heated air to each of the dryer 1, the washing machine 2, and the refresher 3.

The duct system 4 may include the heat exchange channel 42 in which the air is heated. The duct system 4 may include the first supply air duct 43 connecting the heating device 50 and the dryer 1. The duct system 4 may include the second supply air duct 45 connecting the heating device 50 and the refresher 3. The duct system 4 may include the third supply air duct 48 connecting the heating device 50 and the washing machine 2. The duct system 4 may include the dehumidification duct 46 connected to the heating device 50. The air heated by passing through the heat exchange channel 42 is blown by the fan 60 to be supplied to at least any one of the first supply air duct 43, the second supply air duct 45, the third supply air duct 48, and the dehumidification duct 46.

The duct system 4 may include the first exhaust air duct 41 connecting the heating device 50 and the dryer 1. The duct system 4 may include the second exhaust air duct 44 connecting the heating device 50 and the refresher 3. The duct system 4 may include the third exhaust air duct 47 connecting the heating device 50 and the washing machine 2. The heated air supplied to the dryer 1 may flow into the heat exchange channel 42 through the first exhaust air duct 41. The heated air supplied to the refresher 3 may flow into the heat exchange channel 42 through the second exhaust air duct 44. The heated air supplied to the washing machine 2 may flow into the heat exchange channel 42 through the third exhaust air duct 47.

The heat exchange channel 42, through which the air flows, may be provided in the heating device 50. The heating device 50 may include a heat exchange unit disposed in the heat exchange channel 42. The heat exchange unit may heat the air flowing in the heat exchange channel 42. The heat exchange unit may include the condenser 52 and the evaporator 53. The heating device 50 may be a concept that encompasses the heat exchange channel 42.

The laundry treating apparatus A may include the fan 60. The fan 60 may blow the air in the heat exchange channel 42. The fan 60 may be disposed on a downstream side of the condenser 52. The air, heated by heat exchange with the evaporator 53 and the condenser 52, may be blown by the fan 60. The fan 60 may be disposed in the heat exchange channel 42.

The air blown by the fan 60 may be supplied to at least any one of the dryer 1, the washing machine 2, the refresher 3, and the dehumidification duct 46.

The laundry treating apparatus A may include a blowing duct 420 surrounding the fan 60. The duct system may include the blowing duct 420. The fan 60 may be disposed in the blowing duct 420.

An inner space of the blowing duct 420 may be a portion of the heat exchange channel 42.

The fan 60 and the blowing duct 420 may be disposed at a discharge end 42B of the heat exchange channel 42. The discharge end 42B may be disposed at a downstream side of the condenser 52 and the evaporator 53.

The blowing duct 420 may include a first discharge port 425 connected to the first supply air duct 43. The blowing duct 420 may include a second discharge port 427 connected to the second supply air duct 45. The blowing duct 420 may include a third discharge port 426 connected to the third supply air duct 48. The blowing duct 420 may include a fourth discharge port 428 connected to the dehumidification duct 46.

The first discharge port 425 may protrude upwardly from the blowing duct 420. The first supply air duct 43 may connect the first drum 13 and the first discharge port 425.

The second discharge port 427 may protrude from the blowing duct 420 to a lateral side. The second supply air duct 45 may connect the third cabinet 30 and the second discharge port 427.

The third discharge port 426 may protrude downwardly from the blowing duct 420. The third supply air duct 48 may connect the tub 23 and the third discharge port 426.

The fourth discharge port 428 may protrude from the blowing duct 420 to the lateral side. The fourth discharge port 428 may protrude in a direction opposite to the second discharge port 427. The dehumidification duct 46 may be connected to the fourth discharge port 428.

A rotating body 71 of a switching device 70 (see FIG. 6) which will be described later may be disposed in the blowing duct 420. The rotating body 71 may be connected to a driving motor 711 to be rotated in the blowing duct 420. The air blown by the fan 60 may flow into at least any one of the first supply air duct 43, the second supply air duct 45, the third supply air duct 48, and the dehumidification duct 46 by the operation of the switching device 70.

The laundry treating apparatus A of the present disclosure may also include a separate distribution device in addition to the switching device 70 which will be described later. The distribution device may distribute the air blown by the fan 60 to each of the dryer 1, the washing machine 2, the refresher 3, and the dehumidification duct 46. That is, by the distribution device, the air blown by the fan 60 may be supplied simultaneously to each of the dryer 1, the washing machine 2, the refresher 3, and the dehumidification duct 46. The distribution device may be disposed in the blowing duct 420 or may be disposed in a distribution passage connected to the blowing duct 420. The distribution device may be a valve. The distribution device may include an actuator and a switching damper. The laundry treating apparatus A may include both the switching device 70 and the distribution device at the same time, may include only the switching device 70, or may include only the distribution device.

The hot air flowing into the first drum 13 through the first supply air duct 43 may dry the laundry placed in the first drum 13, and then may flow into the heat exchange channel 42 through the first exhaust air duct 41. The first drum 13 may include a front cover 131 disposed in the front thereof, and a rear cover 132 disposed in the rear thereof. The first supply air duct 43 may be connected to the rear cover 132, and the first exhaust air duct 41 may be connected to the front cover 131.

The first exhaust air duct 41 may connect the first drum 13 and the heat exchange channel 42. The first exhaust air duct 41 may extend downwardly from the first drum 13 to be connected to the heat exchange channel 42.

A first inlet port 421 connected to the first exhaust air duct 41 may be formed at an inlet end 42A of the heat exchange channel 42. The first inlet port 421 may extend upwardly from the heat exchange channel 42. The first inlet port 421 may extend upwardly from the case 570 of the heating device 50.

The laundry treating apparatus A may include a first opening and closing valve 41*a* disposed in the first exhaust air duct 41. The first opening and closing valve 41*a* may control a flow rate of air in the first exhaust air duct 41. The first opening and closing valve 41*a* may block an air flow in the first exhaust air duct 41. The first opening and closing valve 41*a* may block the air flow in the first exhaust air duct 41 when the hot air is not supplied into the first drum 13 through the first supply air duct 43.

The hot air flowing into third cabinet 30 through the second supply air duct 45 may dry the laundry placed in the third cabinet 30, and then may flow into the heat exchange channel 42 through the second exhaust air duct 44. The second supply air duct 45 and the second exhaust air duct 44 may be connected to the third rear panel 302 of the third cabinet 30.

The second exhaust air duct 44 may connect the third cabinet 30 and the heat exchange channel 42. The second exhaust air duct 44 may extend downwardly from an upper portion of the third cabinet 30 to be connected to the heat exchange channel 42.

The second exhaust air duct 44 may include a first duct section 441 disposed between the heating device 50 and the second cabinet 20. A first duct section 441 may be disposed between a base plate 575 (see FIG. 10) to be described later and the second upper panel 203 of the second cabinet 20. The first duct section 441 may extend forwardly and rearwardly in a separation space 55 (see FIG. 10) which will be described later.

A second inlet port 422 connected to the second exhaust air duct 44 may be formed at the inlet end 42A of the heat exchange channel 42. The second inlet port 422 may extend downwardly from the heat exchange channel 42. The second inlet port 422 may extend downwardly from the case 570 of the heating device 50.

The laundry treating apparatus A may include a second opening and closing valve 44*a* disposed in the second exhaust air duct 44. The second opening and closing valve 44*a* may control a flow rate of air in the second exhaust air duct 44. The second opening and closing valve 44*a* may block an air flow in the second exhaust air duct 44. The second opening and closing valve 44*a* may block the air flow in the second exhaust air duct 44 when the hot air is not supplied into the third cabinet 30 through the second supply air duct 45. The second opening and closing valve 44*a* may be disposed in the first duct section 441.

The hot air flowing into the tub 23 through the third supply air duct 48 may dry the laundry placed in the tub 23, and then may flow into the heat exchange channel 42 through the third exhaust air duct 47.

The third exhaust air duct 47 may connect the tub 23 and the heat exchange channel 42. The third exhaust air duct 47 may extend upwardly from an upper portion of the tub 23 to be connected to the heat exchange channel 42.

A third inlet port 424 connected to the third exhaust air duct 47 may be formed at the inlet end 42A of the heat exchange channel 42. The third inlet port 424 may extend downwardly from the heat exchange channel 42. The third inlet port 424 may extend downwardly from the second exhaust air duct 44. The third inlet port 424 may extend downwardly from the first duct section 441.

The third inlet port 424 may protrude downwardly from a lower surface of the second exhaust air duct 44. The third exhaust air duct 47 may connect the tub 23 and the third inlet port 424. The third exhaust air duct 47 may connect the tub 23 and the second exhaust air duct 44. The air in the third exhaust air duct 47 may join the air in the second exhaust air duct 44 to flow into the heat exchange channel 42.

The laundry treating apparatus A may include a third opening and closing valve 47*a* disposed in the third exhaust air duct 47. The third opening and closing valve 47*a* may control a flow rate of air in the third exhaust air duct 47. The third opening and closing valve 47*a* may block an air flow in the third exhaust air duct 47. The third opening and closing valve 47*a* may block the air flow in the third exhaust air duct 47 when the hot air is not supplied into the tub 23 through the third supply air duct 48.

The hot air flowing through the dehumidification duct 46 may be supplied to the outside of the laundry treating apparatus A through an outlet 462 that is opened forward. The hot air flowing through the dehumidification duct 46 may be supplied into an indoor space through the outlet 462.

The dehumidification duct 46 may include a second duct section 461 disposed between the heating device 50 and the second cabinet 20. The second duct section 461 may be disposed between the base plate 575 (see FIG. 10) to be described later and the second upper panel 203 of the second cabinet 20. The second duct section 461 may extend forwardly and rearwardly in the separation space 55 (see FIG. 6) which will be described later.

An outside air inlet port 423 connected to the heat exchange channel 42 may be formed at the inlet end 42A of the heat exchange channel 42. The outside air inlet port 423 may extend forwardly from the heat exchange channel 42. The outside air inlet port 423 may extend forwardly from the second exhaust air duct 44.

The outside air inlet port 423 may protrude forwardly from one side of the second exhaust air duct 44. The outside air inlet port 423 may allow the indoor space and the second exhaust air duct 44 to communicate with each other. The air in the outside air inlet port 423 may join the air in the second exhaust air duct 44 to flow into the heat exchange channel 42. The outside air inlet port 423 may have an outside air inlet 49 that is opened forward. The air drawn in through the outside air inlet 49 may join the air in the second exhaust air duct 44 to flow into the heat exchange channel 42.

The laundry treating apparatus A may include a fourth opening and closing valve 49*a* disposed at the outside air inlet port 423. The fourth opening and closing valve 49*a* may control a flow rate of air in the outside air inlet port 423. The fourth opening and closing valve 49*a* may block an air flow in the outside air inlet port 423. The fourth opening and closing valve 49*a* may block the air flow in the outside air inlet port 423 when the hot air is not supplied to the dehumidification duct 46.

Figure 6:
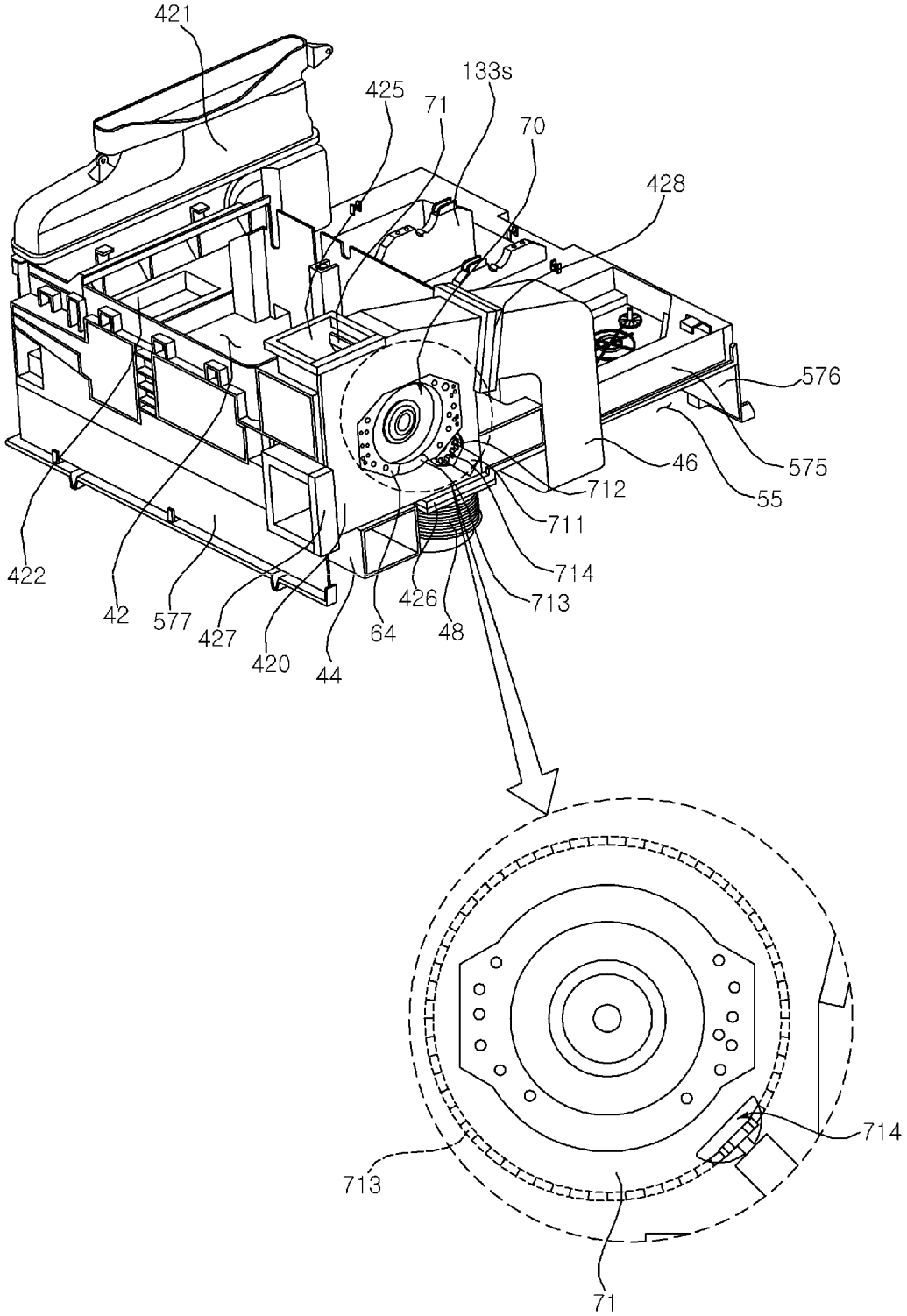
FIG. 6 is a perspective view of a heating device according to an embodiment of the present disclosure.
Figure 7:
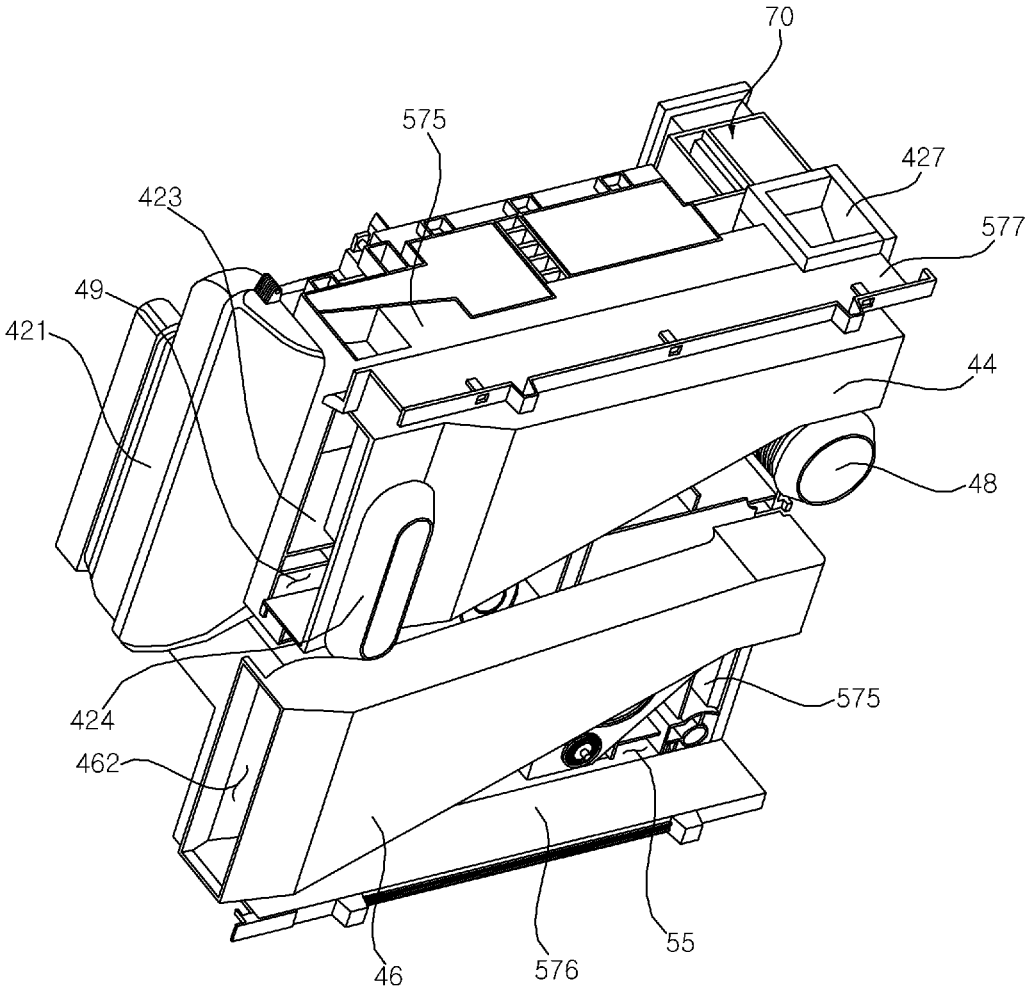
FIG. 7 is a perspective view of a heating device according to an embodiment of the present disclosure.

Hereinafter, the heating device 50 will be described with reference to FIGS. 5 to 7. FIGS. 5 and 6 are top-side perspective views of the heating device 50, and FIG. 7 is a bottom-side perspective view of the heating device 50.

Referring to FIG. 5, the heating device 50 may include the case 570, the compressor 51, the condenser 52, the evaporator 53, and the expansion device 54.

The compressor 51, the condenser 52, the evaporator 53, and the expansion device 54 may be connected by a refrigerant passage. The heat pump device may include the compressor 51, the condenser 52, the evaporator 53, and the expansion device 54.

The drain pan 531 may be disposed under the evaporator 53.

The case 570 may provide a space in which the compressor 51, the condenser 52, the fan 60, and the evaporator 53 are disposed. The compressor 51, the condenser 52, the fan 60, the evaporator 53, and the switching device 70 may be disposed in the case 570.

The case 570 may include a cover 573, a base plate 575 spaced from a lower side of the cover 573, a front wall 574 disposed in the front of the evaporator 53, a first side wall 571 disposed on one side of the evaporator 53, and a second side wall 572 disposed on the other side of the evaporator 53.

The drum motor 133 rotating the first drum 13 of the dryer 1 may be disposed in the case 570 of the heating device 50. The drum motor 133 may be disposed on an upper side of the case 570. The case 570 may provide the motor mounting portion 133*s* on which the drum motor 133 is mounted.

The condenser 52, the fan 60, and the evaporator 53 may be disposed on an upper side of the base plate 575.

The heat exchange channel 42 may be a space surrounded by the base plate 575, the front wall 574, the first side wall 571, and the second side wall 572. The cover 573 may not be provided, in which case an upper portion of the heat exchange channel 42 may be in an open state. The heat exchange channel 42 may communicate with the fan 60 disposed at a rear portion of the heating device 50. Air in the heat exchange channel 42 may be blown by the fan 60. The heat exchange channel 42 may be referred to as a "heating passage." The condenser 52 and the evaporator 53 may be disposed in the heat exchange channel 42. The heat exchange channel 42 may refer to a partially open space.

The heat exchange channel 42 may be a space surrounded by the cover 573, the base plate 575, the front wall 574, the first side wall 571, and the second side wall 572. The cover 573 may cover the upper portion of the heat exchange channel 42. The heat exchange channel 42 may refer to a space between the cover 573 and the base plate 575. The cover 573, the base plate 575, the front wall 574, the first side wall 571, and the second side wall 572 may form a "heating duct" surrounding the heat exchange channel 42. The heating duct may communicate with the fan 60, and air in the heating duct may be blown by the fan 60. The condenser 52 and the evaporator 53 may be disposed in the heating duct. The heat exchange channel 42 may refer to a duct shielded in all directions.

The heat exchange channel 42 may be formed in the heating device 50. The heat exchange channel 42 may be a portion of the inner space of the heating device 50.

The first inlet port 421 may be disposed in the front of the heat exchange channel 42. The first inlet port 421 may cover the front side of the heat exchange channel 42. The first inlet port 421 may be connected to the front wall 574. The first inlet port 421 may be formed in the case 570. The first exhaust air duct 41 may be inserted into the first inlet port 421 to be fixed thereto.

The heating device 50 may be disposed in the machine room S. The controller 81 may control the operation of components disposed in the machine room S. The machine room S may have a space in which the PCB is disposed, and the controller 81 may be mounted on the PCB.

The heating device 50 may include a steam generator 502 for generating steam and a dehumidifier 504 for removing moisture from the air flowing through the heat exchange channel 42.

The steam generator 502 may generate steam by heating water. The steam generator 502 may be disposed between the condenser 52 and the fan 60. The steam generated by the steam generator 502 may be pressurized by the fan 60 to be supplied to each of the washing machine 2, the dryer 1, and the refresher 3. The steam generated by the steam generator 502 may be supplied to each of the first drum 13, the second drum 24, and the inner space 33 of the refresher 3.

The dehumidifier 504 may dehumidify air under room temperature conditions (about 25 degrees Celsius). The dehumidifier 504 may dehumidify air by using desiccant dehumidification. The dehumidifier 504 may be filled with zeolite. The zeolite filled in the dehumidifier 504 may be replaced regularly.

The dehumidifier 504 may be disposed between the condenser 52 and the fan 60. The dehumidifier 504 may dehumidify the air flowing through the heat exchange channel 42 even when the compressor 51 is not in operation.

The switching device 70 may control the direction of air blown by the fan 60. The switching device 70 may be disposed in the machine room S.

Referring to FIG. 6, the switching device 70 may control the supply of hot air to the washing machine 2, the dryer 1, the refresher 3, or the dehumidification duct 46.

The switching device 70 may include the rotating body 71 rotatably mounted in the blowing duct 70. The switching device 70 may include the driving motor 711 that rotates the rotating body 71. The rotating body 71 may be rotated by the driving motor 711 in the blowing duct 420. The fan 60 may be disposed in the rotating body 71.

The driving motor 711 may rotate the rotating body 71. A driving gear 712 may be fixed to the rotating shaft of the driving motor 711. The driving gear 712 may be a pinion gear or a spur gear.

A driven gear 713 may be rotated in engagement with the driving gear 712. The driven gear 713 may be fixed to the rotating body 71 or may be integrally formed with the rotating body 71. The driven gear 713 may be a ring gear. The driven gear 713 may be a ring-shaped rack.

The driving gear 712 and the driven gear 713 may be engaged with each other. By the rotation of the driving gear 712, the driven gear 713 may be moved in a circumferential direction with respect to the rotational axis of the fan 60. When the driven gear 713 is moved in a circumferential direction, the rotating body 71 having the driven gear 713 fixed thereto may also be moved in the circumferential direction relative to the rotational axis of the fan 60.

The driving motor 711 may be disposed outside of the blowing duct 420. A cut-out portion 714 may be formed in one surface (e.g., rear surface) of the blowing duct 420 that faces the rotating body 71. The cut-out portion 714 may be formed at a position corresponding to the driven gear 713. A portion of the driving gear 712 may be inserted into the cut-out portion 714. The driving gear 712 and the driven gear 713 may be engaged with each other in the cut-out portion 714.

A rotating shaft of the driving motor 711 may be disposed parallel to the rear surface of the blowing duct 420, thereby reducing a volume occupied by the driving motor 711 and the driving gear 712 in the front-rear direction.

The driving motor 711 may be a motor capable of controlling the position, angle, and direction of rotation. For example, the driving motor 711 may be a Brushless Direct Current (BLDC) motor. Alternatively, the driving motor 711 may be a step motor. The driving motor 711 may be electrically connected to the control panel 8 and/or the controller 81. Rotation of the driving motor 711 may be controlled by an electrical signal transmitted from the control panel 8 and/or the controller 81 to the driving motor 711. The control panel 8 and/or the controller 81 may control a hot air supplying direction by controlling the rotation angle of the driving motor 711.

Meanwhile, the driving motor 711 may rotate the rotating body 71 by various known methods used by the motor for rotating the rotating body. For example, the driving motor 711 may rotate the rotating body 71 by using a belt-pulley method or by using a plurality of gears that are engaged with each other, or the rotating shaft of the motor may be rotated together with the rotating body.

The blowing duct 420 may be connected to the first supply air duct 43, the second supply air duct 45, the third supply air duct 48, and the dehumidification duct 46.

The blowing duct 420 may be connected to a motor mount 64, to which a fan motor rotating the fan 60 is fixed. The motor mount 64 may be disposed on a rear surface of the blowing duct 420. The driving motor 711, the driving gear 712, and the driven gear 713 may be disposed radially outwardly from the motor mount 64.

The blowing duct 420 may include the first discharge port 425, the second discharge port 427, the third discharge port 426, and the fourth discharge port 428.

The first supply air duct 43 may be connected to the first discharge port 425. The first supply air duct 43 may be inserted into the first discharge port 425. The first discharge port 425 may be directed upward in the blowing duct 420. The first discharge port 425 may provide a supply air hole that is vertically open.

The second supply air duct 45 may be connected to the second discharge port 427. The second supply air duct 45 may be inserted into the second discharge port 427. The second discharge port 427 may be directed toward the lateral side in the blowing duct 420. The second discharge port 427 may provide a supply air hole that is horizontally open.

The third supply air duct 48 may be connected to the third discharge port 426. The third supply air duct 48 may be inserted into the third discharge port 426. The third discharge port 426 may be directed downward in the blowing duct 420. The third discharge port 426 may provide a supply air hole that is vertically open.

The dehumidification duct 46 may be connected to the fourth discharge port 428. The dehumidification duct 46 may be inserted into the fourth discharge port 428. The fourth discharge port 428 may be directed toward a direction opposite to the second discharge port 427. The fourth discharge port 428 may be directed toward the lateral side in the blowing duct 420. The fourth discharge port 428 may provide a supply air hole that is horizontally open.

The heating device 50 may be connected to each of the first exhaust air duct 41, the second exhaust air duct 44, the third exhaust air duct 47, and the outside air inlet port 423. The third exhaust air duct 47 and the outside air inlet port 423 may be connected to the heating device 50 via the second exhaust air duct 44.

The heating device 50 may include the first inlet port 421 connected to the first exhaust air duct 41, and the second inlet port 422 connected to the second exhaust air duct 44. The first inlet port 421 may extend upwardly, and the second inlet port 422 may extend downwardly. The first inlet port 421 and the second inlet port 422 may protrude from the case 570 of the heating device 50.

Air flowing into the heating device 50 through the first exhaust air duct 41, the second exhaust air duct 44, the third exhaust air duct 47, and the outside air inlet port 423 may pass through the heat exchange channel 42 and flow into the fan 60 by the suction force of the fan 60.

Referring to FIG. 7, the air flowing through the first exhaust air duct 41, the second exhaust air duct 44, the third exhaust air duct 47, and the outside air inlet port 423 may meet in the heat exchange channel 42 to flow into the fan 60.

The third inlet port 424 connected to the third exhaust air duct 47 may protrude downwardly from the second exhaust air duct 44. The air in the third exhaust air duct 47 may join the air in the second exhaust air duct 44 to flow into the heat exchange channel 42.

The outside air inlet port 423 communicating with the indoor space may protrude forwardly from the second exhaust air duct 44. The air flowing into the outside air inlet port 423 through the outside air inlet 49 may join the air in the second exhaust air duct 44 to flow into the heat exchange channel 42.

The air flowing into the heat exchange channel 42 through the second exhaust air duct 44 may join the air flowing into the heat exchange channel 42 through the first exhaust air duct 41 to flow to the fan 60.

The heating device 50 may include a first support plate 576 extending downwardly from the base plate 575, and a second support plate 577 extending downwardly from the base plate 575 and spaced apart from the first support plate 576.

A separation space 55 may be formed between the first support plate 576 and the second support plate 577.

The second exhaust air duct 44, the third supply air duct 48, and the dehumidification duct 46 may be disposed in the separation space 55. The second exhaust air duct 44, the third supply air duct 48, and the dehumidification duct 46 may be formed between the first support plate 576 and the second support plate 577. The second exhaust air duct 44, the third supply air duct 48, and the dehumidification duct 46 may be disposed under the base plate 575.

The dehumidification duct 46 may be disposed under the base plate 575 and may extend forwardly to discharge the air forwardly through a hot air outlet 462. When an opening member 463 (see FIG. 10) which will be described later opens the front of the separation space 55, the air discharged through the hot air outlet 462 may be discharged forwardly from the laundry treating apparatus A.

A portion of the second exhaust air duct 44 disposed under the base plate 575 may be defined as the first duct section 441.

A portion of the dehumidification duct 46 disposed under the base plate 575 may be defined as the second duct section 461.

Figure 8A:
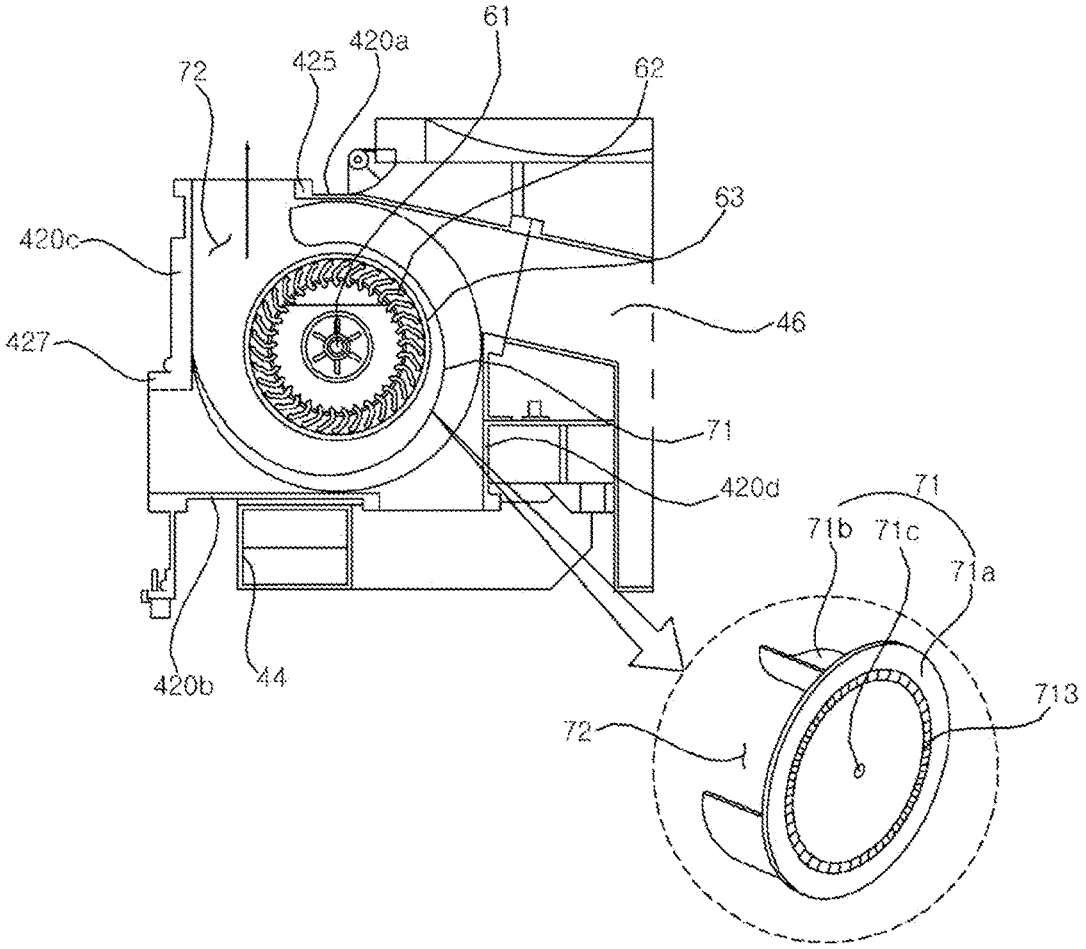
FIGS. 8(*a*) and 8(*b*) are diagrams illustrating examples of operation of a switching device according to an embodiment of the present disclosure.
Figure 8B:
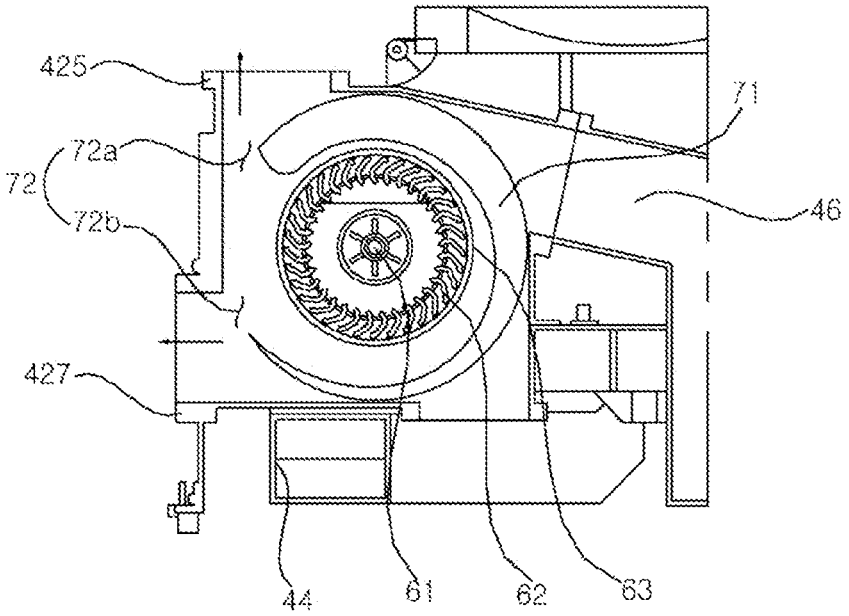

Hereinafter, a method of controlling a blowing direction of air by the switching device 70 will be described with reference to FIGS. 8(*a*) and 8(*b*). FIG. 8(*a*) is a diagram illustrating an example of operation when air is supplied to the first supply air duct 43 by the operation of the switching device 70, and FIG. 8(*b*) is a diagram illustrating an example of operation when air is supplied to the first supply air duct 43 and the second supply air duct 45 at the same time by the operation of the switching device 70.

The fan 60 may be a sirocco fan. The fan 60 may rotate to blow air in a direction perpendicular to the rotating shaft 61. The fan 60 may blow air in a direction coming into contact with the rotation direction. The air blown by the fan 60 may be concentrated in a predetermined range of angles relative to the rotating shaft 61.

The fan 60 may include the rotating shaft 61 coupled to the fan motor and rotated thereby, a plurality of blades 62 spaced apart in a radially outward direction of the rotating shaft 61, and an outer body 63 coupled to the blades 62 and extending in a rotation direction of the fan 60. The outer body 63 may have an annular shape. The rotating shaft 61 and the blades 62 may be connected by the outer body 63. When the rotating shaft 61 rotates, the outer body 63 and the blades 62 may also be rotated together with the rotating shaft 61.

The rotating body 71 may include a rotating plate 71*a* having the driven gear 713, a scroll 71*b* coupled to the rotating plate 71*a*, and a shaft through hole 71*c* formed in the rotating plate 71*a*.

The rotating plate 71*a* may have a disk shape and may be disposed in the rear of the fan 60. The driven gear 713 may be formed in an annular shape on one side surface of the rotating plate 71*a*. The driven gear 713 may be integrally formed with the rotating plate 71*a*. When the driven gear 713 is rotated in engagement with the driving gear 711, the rotating plate 71*a* may be rotated in the same direction as the rotation direction of the fan 60. The rotating plate 71*a* may have the shaft through hole 71*c*, through which the rotating shaft 61 passes. The rotating shaft 61 may pass through the shaft through hole 71*c* to be coupled to the fan motor.

The fan 60 may be disposed between the heat exchange channel 24 and the rotating plate 71*a*. That is, the rotating plate 71*a* may be disposed behind the heat exchange channel 42 and the fan 60. The rotating plate 71*a* may be disposed behind the fan 60 in the blowing duct 420.

The scroll 71*b* may be integrally formed with the rotating plate 71*a*. When the rotating plate 71*a* is rotated, the scroll 71*b* may also be rotated together. The scroll 71*b* may extend in the rotation direction of the fan 60. The scroll 71*b* may be disposed to surround the fan 60. The fan 60 may be disposed in the scroll 71*b*.

The scroll 71*b* may include a blowing channel 72. The blowing channel 72 may be a cut-out portion of an outer circumferential surface of the scroll 71*b*. The scroll 71*b* may cover the outside of the fan 60, and the blowing channel 72 may be an outer region of the fan 60 which is not covered by the scroll 71*b*. The air blown by the fan 60 may be discharged to the outside of the blowing duct 420 through the blowing channel 72.

When the scroll 71*b* is rotated by the rotation of the rotating plate 71*a*, the blowing channel 72 may be changed in position. That is, by the rotation of the scroll 71*b*, the position of the blowing channel 72 may be changed relative to the rotating shaft 61. By rotating the scroll 71*b* to change the position of the blowing channel 72, the driving motor 711 may control the direction of air discharged from the blowing duct 420.

The blowing duct 420 may have a longitudinal section of a square shape. Accordingly, by the rotation of the scroll 71*b*, interference between the scroll 71 and the blowing duct 420 may be avoided.

The blowing duct 420 may include a first wall 420*a* disposed over the fan 60, a second wall 420*b* disposed under the fan 60, a third wall 420*c* disposed on one side of the fan 60, and a fourth wall 420*d* disposed on the other side of the fan 60.

The first discharge port 425 may protrude upwardly from the first wall 420*a*. The second discharge port 427 may protrude toward the lateral side from the third wall 240*c*. The third discharge port 426 may protrude downwardly from the second wall 420*b*. The fourth discharge port 428 may protrude toward the lateral side from the fourth wall 420*d*.

Referring to FIG. 8(*a*), the driving motor 711 may rotate the rotating body 71 by a first angle, and when the rotating body 71 is rotated by the first angle, the air blown by the fan 60 may be supplied to the first supply air duct 43. In this case, the blowing channel 72 may communicate with only an inner space of the first discharge port 425. Accordingly, the air blown by the fan 60 may be supplied to only the dryer 1.

Referring to FIG. 8(*b*), the driving motor 711 may rotate the rotating body 71 by a second angle, and when the rotating body 71 is rotated by the second angle, the air blown by the fan 60 may be supplied to the first supply air duct 43 and the second supply air duct 45 at the same time. In this case, the blowing channel 72 may communicate with an inner space of the first discharge port 425 and an inner space of the second discharge port 427. Accordingly, the air blown by the fan 60 may be supplied to the dryer 1 and the refresher 3 at the same time. The blowing channel 72 may include a first blowing channel 72*a* communicating with the inner space of the first discharge port 425, and a second blowing channel 72*b* communicating with the inner space of the second discharge port 427. The air blown by the fan 60 may be supplied to the dryer 1 through the first blowing channel 72*a*. The air blown by the fan 60 may be supplied to the refresher 3 through the second blowing channel 72*b*.

A user may control the switching device 70 by inputting a signal to the control panel 8. Once the signal is input to the control panel 8, the signal may be transmitted to the driving motor 711, to control a rotation angle of the driving motor 711. For example, when the user inputs, to the control panel 8, a signal for supplying hot air to the dryer 1, the driving motor 711 may rotate the rotating body 71 so that the blowing channel 72 may be moved to a position as illustrated in FIG. 8(*a*). For example, when the user inputs, to the control panel 8, a signal for supplying hot air to the dryer 1 and the refresher 3 at the same time, the driving motor 711 may rotate the rotating body 71 so that the blowing channel 72 may be moved to a position as illustrated in FIG. 8(*b*).

Figure 9:
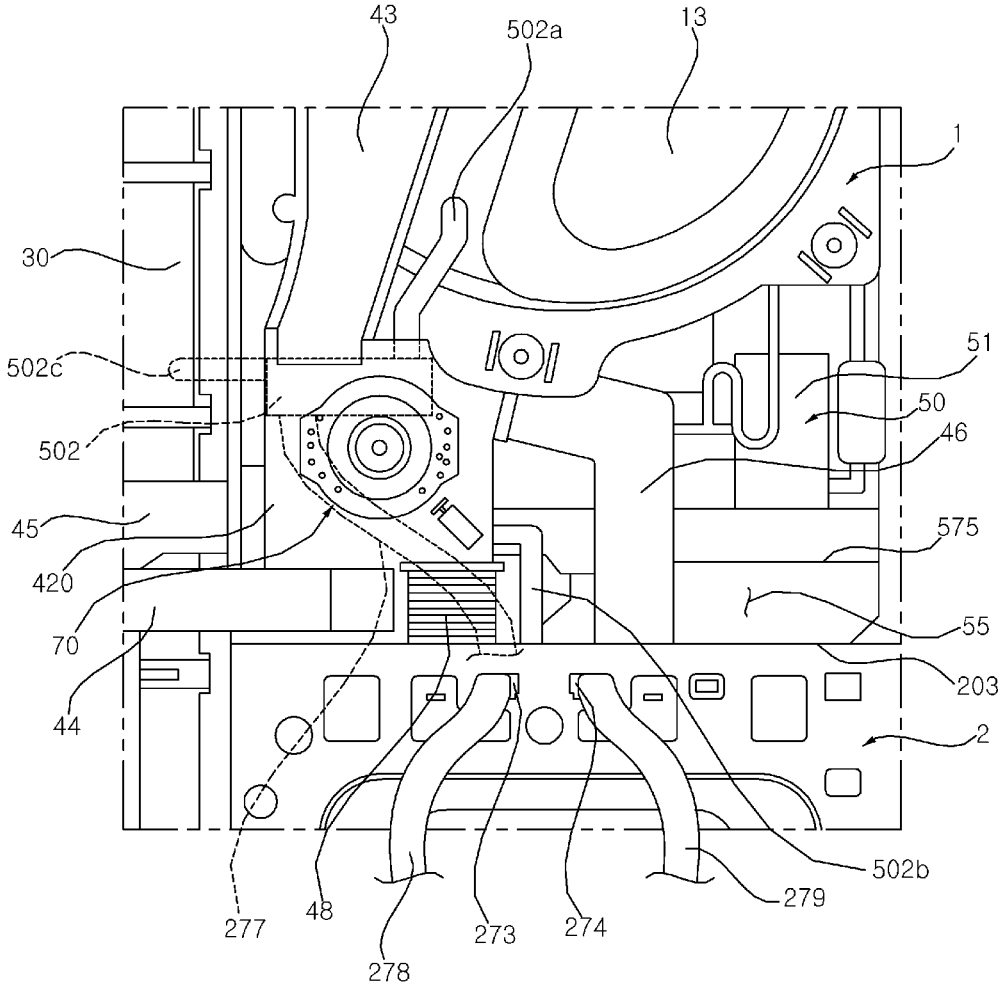
FIG. 9 is a diagram illustrating a rear side of a laundry treating apparatus according to an embodiment of the present disclosure.

Hereinafter, a structure for supplying hot air and steam by the heating device 50 to the respective laundry treating machines 1, 2, and 3 will be described with reference to FIG. 9. FIG. 9 is an enlarged view of a rear surface of the laundry treating apparatus A.

Referring to FIG. 9, the heating device 50 may be disposed over the second upper panel 203. The heating device 50 may be disposed in the first cabinet 10 of the dryer 1.

The switching device 70 may be disposed over the second upper panel 203. The switching device 70 may be disposed in the first cabinet 10 of the dryer 1.

The blowing duct 420 may be connected to the first supply air duct 43, the second supply air duct 45, and the third supply air duct 48.

The first supply air duct 43 may extend upwardly from the blowing duct 420. The first supply air duct 43 may be connected to the first drum 13.

The second supply air duct 45 may extend from the blowing duct 420 to a lateral side. The second supply air duct 45 may be connected to the third cabinet 30.

The third supply air duct 48 may extend downwardly from the blowing duct 420. The third supply air duct 48 may pass through the separation space 55 to extend into the second cabinet 20.

The laundry treating apparatus A may include a first steam supply pipe 502*a* connecting the steam generator 502 and the first drum 13, a second steam supply pipe 502*c* connecting the steam generator 502 and the third cabinet 30, and a third steam supply pipe 502*b* connecting the steam generator 502 and the tub 23.

The steam generator 502 may be disposed in the heating device 50. The steam generated by the steam generator 502 may be sprayed into the first drum 13 through the first steam supply pipe 502*a*. The steam generated by the steam generator 502 may be sprayed into the inner space 33 of the refresher 3 through the second steam supply pipe 502*c*. The steam generated by the steam generator 502 may be sprayed into the second drum 24 through the third steam supply pipe 502*b*.

The first steam supply pipe 502*a* may extend upwardly from the steam generator 502 to be connected to the first drum 13.

The second steam supply pipe 502*c* may extend from the steam generator 502 to the lateral side, to be connected to the third cabinet 30.

The third steam supply pipe 502*b* may extend downwardly from the steam generator 502 to be connected to the tub 23.

The steam generated by the steam generator 502 may flow to each of the first drum 13, the second drum 24, and the inner space 33 of the refresher 3 by the blowing force of the fan 60. That is, by pressurizing the steam generated by the steam generator 502, the fan 60 may cause the steam to flow into the first drum 13, the second drum 24, and the inner space 33 of the refresher 3.

A valve for controlling an amount of steam flow may be provided for each of the first steam supply pipe 502*a*, the second steam supply pipe 502*c*, and the third steam supply pipe 502*b*. By controlling an opening degree of the valve, the controller 81 may adjust the amount of steam supplied to each of the first drum 13, the second drum 24, and the inner space 33 of the refresher 3.

The washing machine 2 may be connected to a cold water supply pipe 278 for supplying cold water to the tub 23, and a hot water supply pipe 279 for supplying hot water to the tub 23.

The steam generator 502 may be connected to a third water supply pipe 277 branching off from the cold water supply pipe 278 or the hot water supply pipe 279. The steam generator 502 may be connected to the third water supply pipe 277 branching off from the hot water supply pipe 279.

The steam generator 502 may be supplied with hot water through the third water supply pipe 277. The steam generator 502 may generate steam by heating the water supplied through the third water supply pipe 277.

Water supply ports 273 and 274 may be disposed closer to the second upper panel 203 than to the second lower panel 204. The steam generator 502 may be disposed between the second upper panel 203 and the first drum 13. Accordingly, as a distance between the steam generator 502 and the water supply pipes 278 and 279 becomes shorter, the third water supply pipe 277 may be reduced in length.

Figure 10:
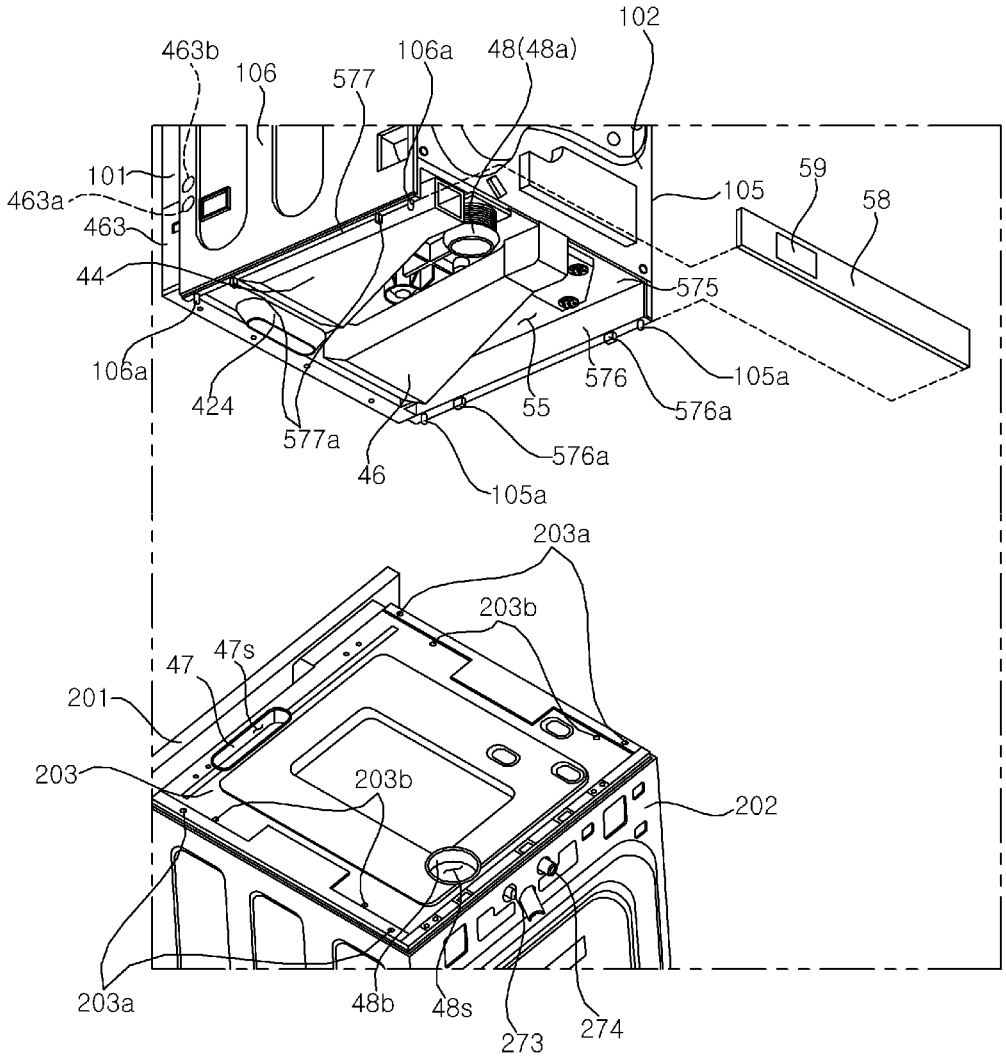
FIG. 10 is a diagram illustrating assembly of a washing machine and a dryer according to an embodiment of the present disclosure.

Hereinafter, a connection structure of the first cabinet 10 and the second cabinet 20 will be described with reference to FIG. 10. FIG. 10 is a diagram illustrating a state in which the first cabinet 10 and the second cabinet 20 are separated from each other.

Referring to FIG. 10, the base plate 575 of the heating device 50 may be spaced from an upper side of the second upper panel 203 of the washing machine 2. The separation space 55 may be formed between the base plate 575 and the second upper panel 203.

The first side panels 105 and 106 of the dryer 1 may protrude downwardly below the base plate 575.

The first side walls 105 and 106 may include a 1-1 side panel 105 forming one side surface of the laundry treating apparatus A, and a 1-2 side panel 106 facing the third cabinet 30.

The heating device 50 may include the first support plate 576 extending downwardly from the base plate 575. The first support plate 576 may be disposed inside the 1-1 side panel 105.

The heating device 50 may include the second support plate 577 extending downwardly from the base plate 575. The second support plate 577 may be disposed inside the 1-2 side panel 106.

The base plate 575 and the support plates 576 and 577 may be integrally formed with each other. The 1-1 side panel 105 and the first support plate 576 may be integrally formed with each other. The 1-2 side panel 106 and the second support plate 577 may be integrally formed with each other.

The first side panels 105 and 106 may include first protrusions 105*a* and 106*a* protruding downwardly. The 1-1 side panel 105 may include a 1-1 protrusion 105*a* protruding downwardly. The 1-2 side panel 106 may include a 1-2 protrusion 106*a* protruding downwardly. The first protrusions 105*a* and 106*a* may protrude downwardly from a lower end of the first side panels 105 and 106.

The second cabinet 20 may include first recesses 203*a* into which the first protrusions 105*a* and 106*a* are inserted. The first recesses 203*a* may be formed in the second upper panel 203. The first recesses 203*a* may be formed at positions corresponding to the first protrusions 105*a* and 106*a*.

The support plates 576 and 577 may include second protrusions 576*a* and 577*a* protruding downwardly. The first support plate 576 may include a 2-1 protrusion 576*a* protruding downwardly. The second support plate 577 may include a 2-2 protrusion 577*a* protruding downwardly. The second protrusions 576*a* and 577*a* may protrude downwardly from a lower end of the support plates 576 and 577.

The second cabinet 20 may include second recesses 203*b* into which the second protrusions 576*a* and 577*a* are inserted. The second recesses 203*b* may be formed in the second upper panel 203. The second recesses 203*b* may be formed at positions corresponding to the second protrusions 576*a* and 577*a*.

The first protrusions 105*a* and 106*b* and the second protrusions 576*a* and 577*a* may be referred to as "protrusions." The first recesses 203*a* and the second recesses 203*b* may be referred to as "recesses."

The first cabinet 10 and the second cabinet 20 may be coupled to each other by the protrusions 105*a*, 106*b*, 576*a*, and 577*a* inserted into the recesses 203*a* and 203*b*.

The machine room S may be disposed over the base plate 575. Accordingly, the machine room S may be spaced from the upper side of the second upper panel 203.

The separation space 55 may be formed between the first support plate 576 and the second support plate 577.

The second exhaust air duct 44, the dehumidification duct 46, and the third exhaust air duct 48 may be disposed in the separation space 55. The second exhaust air duct 44, the dehumidification duct 46, and the third supply air duct 48 may be disposed between the second upper panel 203 and the base plate 575.

The third supply air duct 48 may protrude downwardly toward the second upper panel 203. The third supply air duct 48 may include a first connection duct 48*a* extending downwardly from the blowing duct 420, and a second connection duct 48*b* connected to the tub 23.

The first connection duct 48*a* may be disposed in the separation space 55.

The second connection duct 48*b* may extend downwardly from the second upper panel 203 to be connected to the tub 23. The second connection duct 48*b* may have a first insertion hole 48*s* which is formed on the inside thereof, and into which the first connection duct 48*a* is inserted.

The first connection duct 48*a* is inserted into the first insertion hole 48*s* to be fixed to the second connection duct 48*b*.

The third inlet port 424 may be connected to the second exhaust air duct 44 and may be disposed in the separation space 55.

The third inlet port 424 may be inserted into a second insertion hole 47*s*, formed on the inside of the third exhaust air duct 47, to be fixed to the third exhaust air duct 47.

When the first cabinet 10 and the second cabinet 20 are assembled, the first connection duct 48*a* and the third inlet port 424 are inserted into the first insertion hole 48*s* and the second insertion hole 47*s*, respectively, to be fixed thereto, thereby facilitating the assembly and alignment of the first cabinet 10 and the second cabinet 20.

The laundry treating apparatus A may include an auxiliary panel 58 disposed in the rear of the separation space 55.

The auxiliary panel 58 may shield the rear side of the separation space 55. The auxiliary panel 58 may be connected to the first rear panel 102 and the second rear panel 202. The first rear panel 102 and the second rear panel 202 may be connected to each other by the auxiliary panel 58.

The auxiliary panel 58 may include a duct through hole 59, through which the second exhaust air duct 44 passes. The second exhaust air duct 44 may pass through the auxiliary panel 58 to extend into the separation space 55.

The auxiliary panel 58 may be coupled to the first side panels 105 and 106 and the support plates 576 and 577.

The opening member 463 may shield the front side of the separation space 55. The opening member 463 may be disposed in the front of the dehumidification duct 46 and the outside air inlet port 423.

The laundry treating apparatus A may include a hinge 463*a* connected to the opening member 463, and a motor 463*b* rotating the hinge 463*a*.

The hinge 463*a* may be rotatably connected to the front panel 101. The hinge 463*a* may extend horizontally. The opening member 463 may be rotated in the forward and backward direction with respect to the hinge 463*a* serving as a rotational axis. The opening member 463 may be integrally formed with the hinge 463*a*. When the motor 463*b* rotates the hinge 463*a*, the opening member 463 may be rotated together with the hinge 463*a*. The opening member 463 may be rotated forward to open the front side of the separation space 55. Once the opening member 463 opens the front side of the separation space 55, outside air of the laundry treating apparatus A may flow into the heat exchange channel 44 through the outside air inlet port 423, and the air passing through the dehumidification duct 46 may be discharged to the outside of the laundry treating apparatus A.

The controller 81 may be electrically connected to the motor 463*b*. The controller 81 may control the operation of the motor 463*b*. The user may open the separation space 55 by operating the control panel 8.

Hereinafter, a structure of the second supply air duct 45 and the second exhaust air duct 44 will be described with reference to FIGS. 11 and 12.

Figure 11:
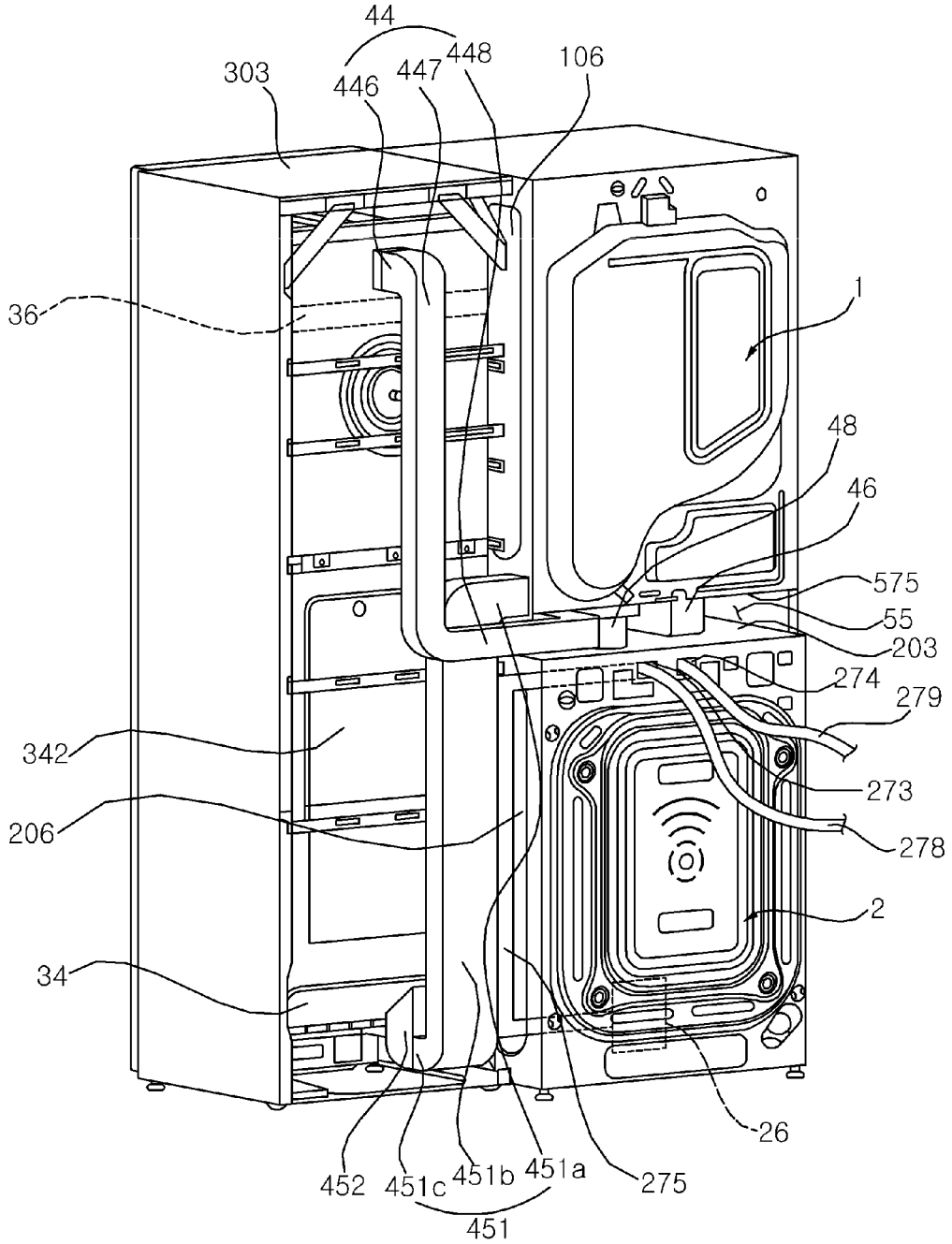
FIG. 11 is a rear perspective view of the laundry treating apparatus, from which the rear case is removed.

FIG. 11 is a rear view of the laundry treating apparatus A, from which the rear case 310 is removed. Referring to FIG. 11, the second supply air duct 45 and the second exhaust air duct 44 for circulating hot air to the refresher 3 may be disposed in the rear of the third cabinet 30.

The second supply air duct 45 and the second exhaust air duct 44 may be disposed behind the third rear panel 302.

The second supply air duct 45 may extend downwardly from the heating device 50 to be connected to the supply air hole 3443 formed in the inner panel 34.

The second supply air duct 45 may face the second side panel 206 of the washing machine 2. The second supply air duct 45 may be disposed parallel to the second side panel 206.

As described above, the second supply air duct 45 may include the first hot air duct 451 and the second hot air duct 452. The first hot air duct 451 may include a first connection part 451*a* connected to the heating device 50, a first extension part 451*b* extending downwardly from the first connection part 451*a*, and a second connection part 451*c* connected to the second hot air duct 452.

The first connection part 451*a* may be coupled to the first side panel 106 of the first cabinet 10. The first connection part 451*a* may be connected to the blowing duct 420, and the air blown by the fan 60 may be introduced through the first connection part 451*a*. The first connection part 451*a* may extend horizontally from the heating device 50.

The first extension part 451*b* may be bent downwardly from the first connection part 451*a*. The first extension part 451*b* may extend downwardly from one end of the first connection part 451*a*. The first extension part 451*b* may face the second side panel 206 of the washing machine 2 and may be disposed parallel to the second side panel 206.

The second connection part 451*c* may be coupled to the second hot air duct 452. That is, the second connection part 451*c* may extend forwardly and rearwardly from the first extension part 451*b*.

The third rear panel 302 may be disposed between the second hot air duct 452 and the second connection part 451*c*. The second connection part 451*c* may be coupled to the third rear panel 302 of the third cabinet 30. The second connection part 451*c* may be inserted into the rear panel 302 of the third cabinet 30 and may be coupled to the second hot air duct 452.

The washing machine 2 may include water supply ports 273 and 274 connected to the external water source. The water supply ports 273 and 274 may be connected to the water supply pipes 278 and 279 which are connected to the external water source. The tub 23 may be supplied with water from the external water source through the water supply pipes 278 and 279.

The water supply ports 273 and 274 may include a first water supply port 273 connected to the cold water supply pipe 278 for supplying cold water, and a second water supply port 274 connected to the hot water supply pipe 279 for supplying hot water. The tub 23 may be supplied with cold water through the cold water supply pipe 278, and may be supplied with hot water through the hot water supply pipe 279. The water supply valve 27 may be connected to the cold water supply pipe 278 and the hot water supply pipe 279, and may control an amount of cold water and hot water flowing into the tub 23.

The laundry treating apparatus A may include a cooling pipe 275 branching off from the cold water supply pipe 289 or the hot water supply pipe 279. The cooling pipe 275 may branch off from the cold water supply pipe 278.

The cooling pipe 275 may branch off from the cold water supply pipe 278 to be disposed adjacent to the second supply air duct 45. The cooling pipe 275 may extend parallel to the second supply air duct 45 or may come into contact with the second supply air duct 45. Hot air flowing in the second supply air duct 45 may be heat exchanged with water flowing in the cooling pipe 275, such that temperature of the hot air may be reduced. The cooling pipe 275 may be disposed adjacent to the first extension part 451*b* or may come into contact with the first extension part 451*b*.

The cooling pipe 275 may be connected to the drain pump 26. Water branched off from the cold water supply pipe 278 and flowing into the cooling pipe 275 may be heat exchanged with the hot air flowing in the second supply air duct 45, and then may flow into the drain pump 26. The drain pump 26 may discharge the water, introduced through the cooling pipe 275, to the outside of the laundry treating apparatus A.

Clothes treated by the refresher 3 may be susceptible to damage when dried at a high temperature. It is required to supply hot air at a relatively lower temperature to clothes dried by the refresher 3 than hot air supplied to clothes treated by the dryer 1 and the washing machine 2. High temperature hot air generated by the heating device 50 may be supplied directly to the washing machine 2 or the dryer 1. However, the high temperature hot air generated by the heating device 50 is required to be cooled before being supplied to the refresher 3. Accordingly, in the laundry treating apparatus A of the present disclosure, the refresher 3 may be supplied with hot air at a lower temperature than hot air supplied to the washing machine 2 and the dryer 1 by using the water supply pipes 275, 278, and 279 of the washing machine 2, thereby preventing damage to the clothing placed in the refresher 3. In addition, by discharging water, used for reducing the temperature of the hot air supplied to the refresher 3, to the outside through the drain pump 26, it is possible to effectively manage the water used for cooling the hot air.

The second exhaust air duct 44 may include a third connection part 446 connected to the third cabinet 30, a second extension part 447 extending downwardly from the third connection part 446, and a fourth connection part 448 connected to the heating device 50.

The third connection part 446 may be coupled to the rear wall 342. The third connection part 446 may communicate with the inner space 33 of the refresher 3, and air circulating in the refresher 3 may flow through the third connection part 446. The third connection part 446 may extend rearwardly from the inner case 34. A position where the third connection part 446 is connected to the inner case 34 may be above the hanger 36.

The second extension part 447 may be bent downwardly from the third connection part 446. The second extension part 447 may extend downwardly from the third connection part 446. The second extension part 447 may extend downwardly from one end of the third connection part 446. The second connection part 447 may face the first side panel 106 of the dryer 1 and may be disposed parallel to the first side panel 106.

The fourth connection part 448 may extend into the separation space 55. The fourth connection part 448 may extend in the left and right direction from the second extension part 447. The fourth connection part 448 may be connected to the heating device 50 in the separation device 55.

Figure 12:
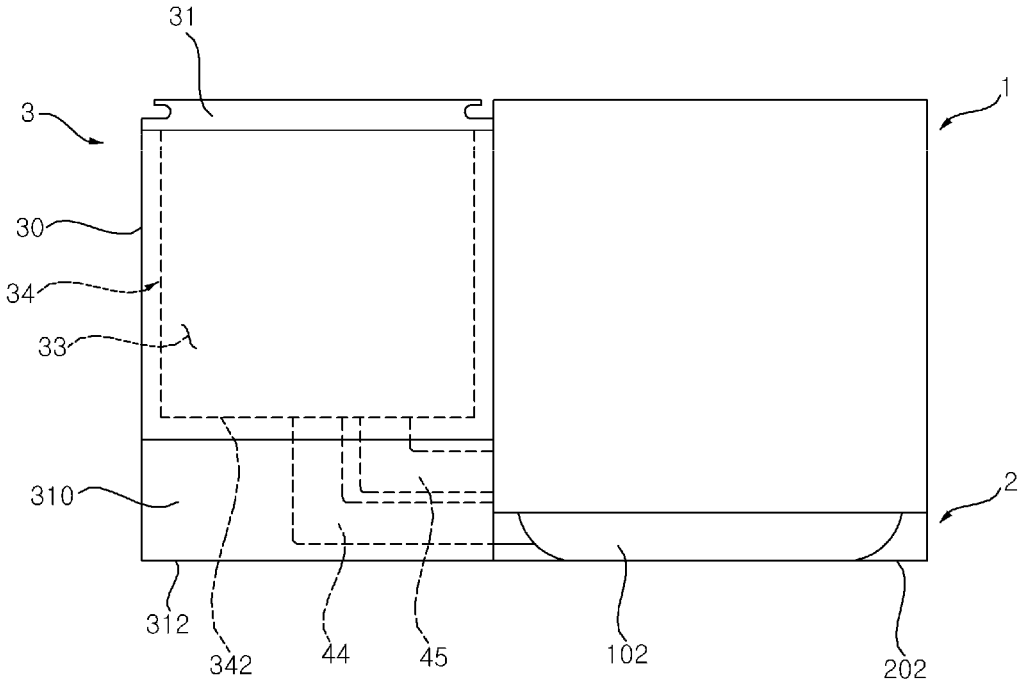
FIG. 12 is a conceptual cross-sectional view of a laundry treating apparatus according to an embodiment of the present disclosure.

Referring to FIG. 12, the refresher 3 may be disposed on any one of the left side and the right side of the dryer 1. The refresher 3 may be disposed on any one of the left side or the right side of the washing machine 2. The dryer 1 may be disposed over the washing machine 2.

The inner case 34 may be disposed in the cabinet 30. The inner case 34 may provide the laundry receiving space 33. The laundry receiving space 33 may be opened forward. The door 31 may open and close a front opening 32 of the laundry receiving space 33. The door 31, having a groove formed on one side or both the left and right sides, may have a handle.

The ducts may be disposed in the rear of the inner case 34 or the laundry receiving space 33. The second supply air duct 45 may be disposed in the rear of the laundry receiving space 33. The second supply air duct 45 may be disposed in the rear of the rear wall 342.

The second supply air duct 45 may be disposed ahead of the rear panel 102 of the dryer 1. The second supply air duct 45 may be disposed ahead of the rear panel 202 of the washing machine 2.

The second supply air duct 45 may be disposed between the rear wall 432 and the rear panel 102 of the dryer 1 in the forward and backward direction. The second supply air duct 45 may be disposed between the rear wall 342 and the rear panel 202 of the washing machine 2 in the forward and backward direction.

The second exhaust air duct 44 may be disposed in the rear of the laundry receiving space 33. The second exhaust air duct 44 may be disposed in the rear of the rear wall 342.

The second exhaust air duct 44 may be disposed ahead of the rear panel 102 of the dryer 1. The second exhaust air duct 44 may be disposed ahead of the rear panel 202 of the washing machine 2.

The second exhaust air duct 44 may be disposed between the rear wall 342 and the rear panel 102 of the dryer 1 in the forward and backward direction. The second exhaust air duct 44 may be disposed between the rear wall 342 and the rear panel 202 of the washing machine 2 in the forward and backward direction.

As described above, the supply air duct 45 may be disposed ahead of the exhaust air duct 44.

The rear case 310 may be disposed in the rear of the cabinet 30. The second supply air duct 45 and the second exhaust air duct 44 may be disposed in the rear case 310.

The second supply air duct 45 may be disposed between the rear wall 342 and the rear panel 312 of the rear case 310. The second exhaust air duct 44 may be disposed between the rear wall 342 and the rear panel 312 of the rear case 310.

Figure 13:
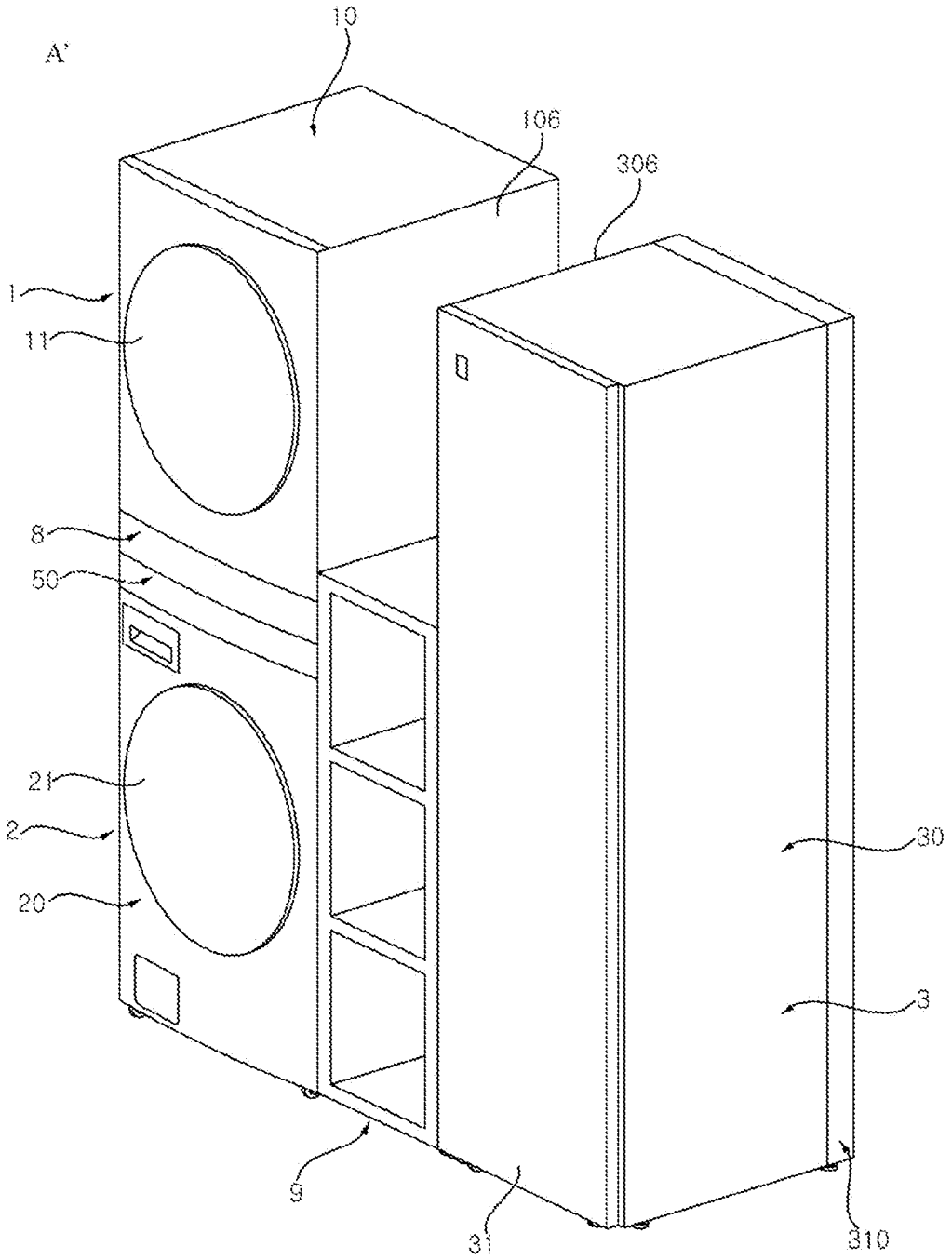
FIG. 13 is a front perspective view of a laundry treating apparatus according to an embodiment of the present disclosure.
Figure 14:
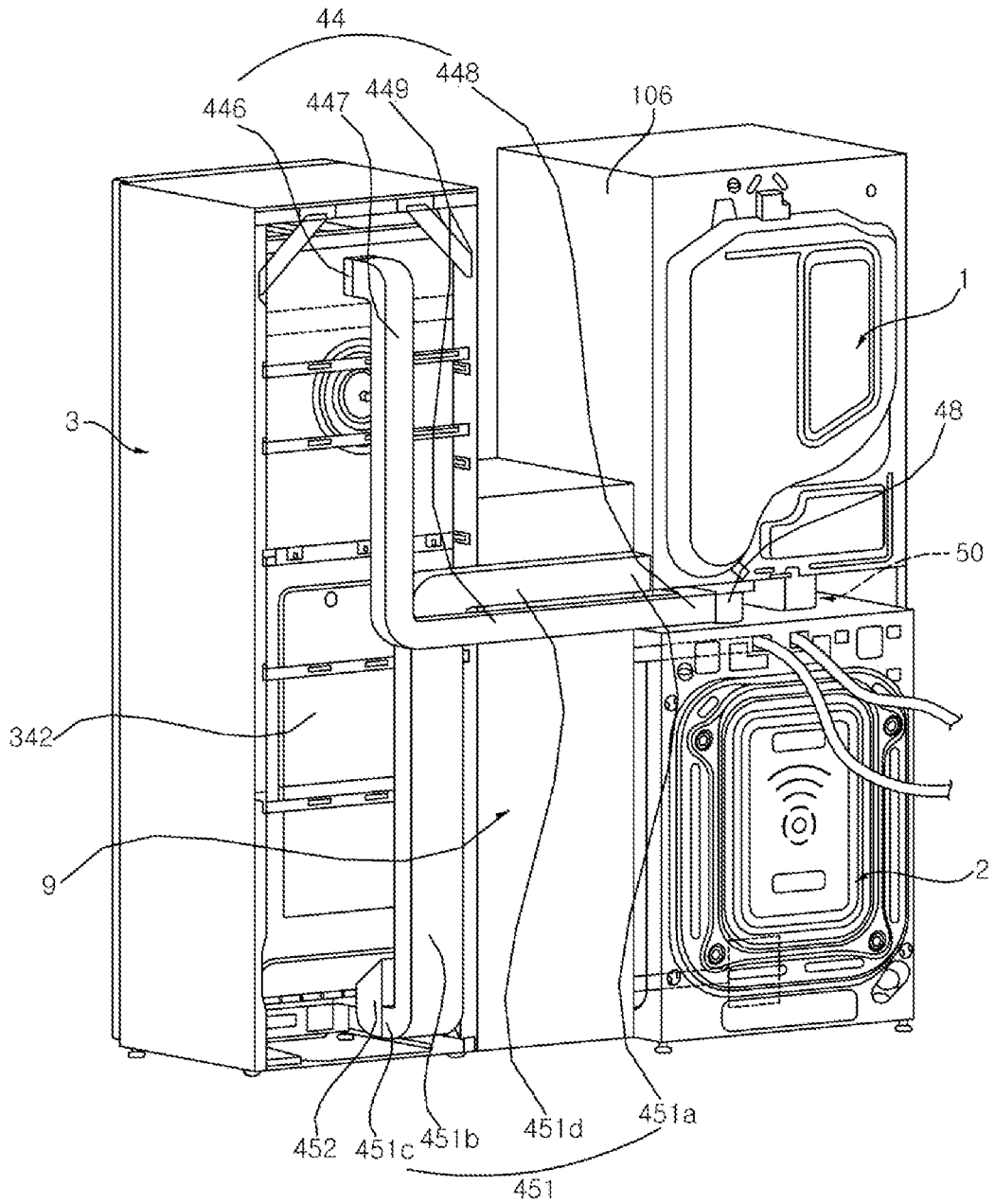
FIG. 14 is a rear perspective view of a laundry treating apparatus according to an embodiment of the present disclosure.

Referring to FIGS. 13 and 14, a laundry treating apparatus according to an embodiment of the present disclosure will be described below. A redundant description of the identical features, described above with reference to FIGS. 1 to 12, will be omitted.

Referring to FIG. 13, a laundry treating apparatus A' according to an embodiment of the present disclosure may include the dryer 1 and the refresher 3. The dryer 1 and the refresher 3 may be spaced apart from each other.

The refresher 3 may be disposed on a lateral side of the dryer 1. The dryer 1 and the refresher 3 may be spaced apart from each other in the left and right direction.

The side panel 106 of the dryer 1 and the side panel 205 of the refresher 3 may face each other while being spaced apart from each other. The side panel 106 of the dryer 1 and the side panel 206 of the refresher 3 may be disposed parallel to each other.

Another device, furniture, and the like may be disposed between the dryer 1 and the refresher 3 which are spaced apart from each other. For example, a storage box 9 may be disposed in a space between the dryer 1 and the refresher 3 which are spaced apart from each other.

The laundry treating apparatus may include the washing machine 2 spaced apart from the refresher 3. The washing machine 2 may be disposed in a lateral direction of the refresher 3. The washing machine 2 and the refresher 3 may be spaced apart from each other in the left and right direction.

The washing machine 2 may be disposed vertically with respect to the dryer 1. For example, the washing machine 2 may be disposed under the dryer 1. That is, the dryer 1 may be stacked over the washing machine 2. Unlike the example, the dryer 1 may be disposed under the washing machine 2, and the washing machine 2 may be disposed over the dryer 1.

Referring to FIG. 14, the first hot air duct 451 may further include a first extension part 451*d* extending between the first connection part 451*a* and the first extension part 451*b*. The second exhaust air duct 44 may further include a second extension part 449 extending between the second extension part 447 and the fourth connection part 448.

The first extension part 451*d* may have a corrugated tube. The second extension part 449 may have a corrugated tube.

Accordingly, lengths of the first extension part 451*d* and the second extension part 449 may be adjusted according to a distance between the refresher 3 and the dryer 1.

Accordingly, the hot air duct 451 and the exhaust air duct 44 may be applied universally to the laundry treating apparatus, in which the refresher 3 and the dryer 1 are spaced apart from each other in the left and right direction as illustrated in FIG. 14, and to the laundry treating apparatus A in which the refresher 3 and the dryer 1 are substantially in contact with each other as illustrated in FIG. 11.

By applying the second supply air duct 44 and the second exhaust air duct 45, which are described above with reference to FIG. 14, to the aforementioned laundry treating apparatus A and laundry treating apparatuses B, C, D, and E which will be described below, the dryer 1 and the refresher 3 may be spaced apart from each other in the left and right direction.

Figure 15:
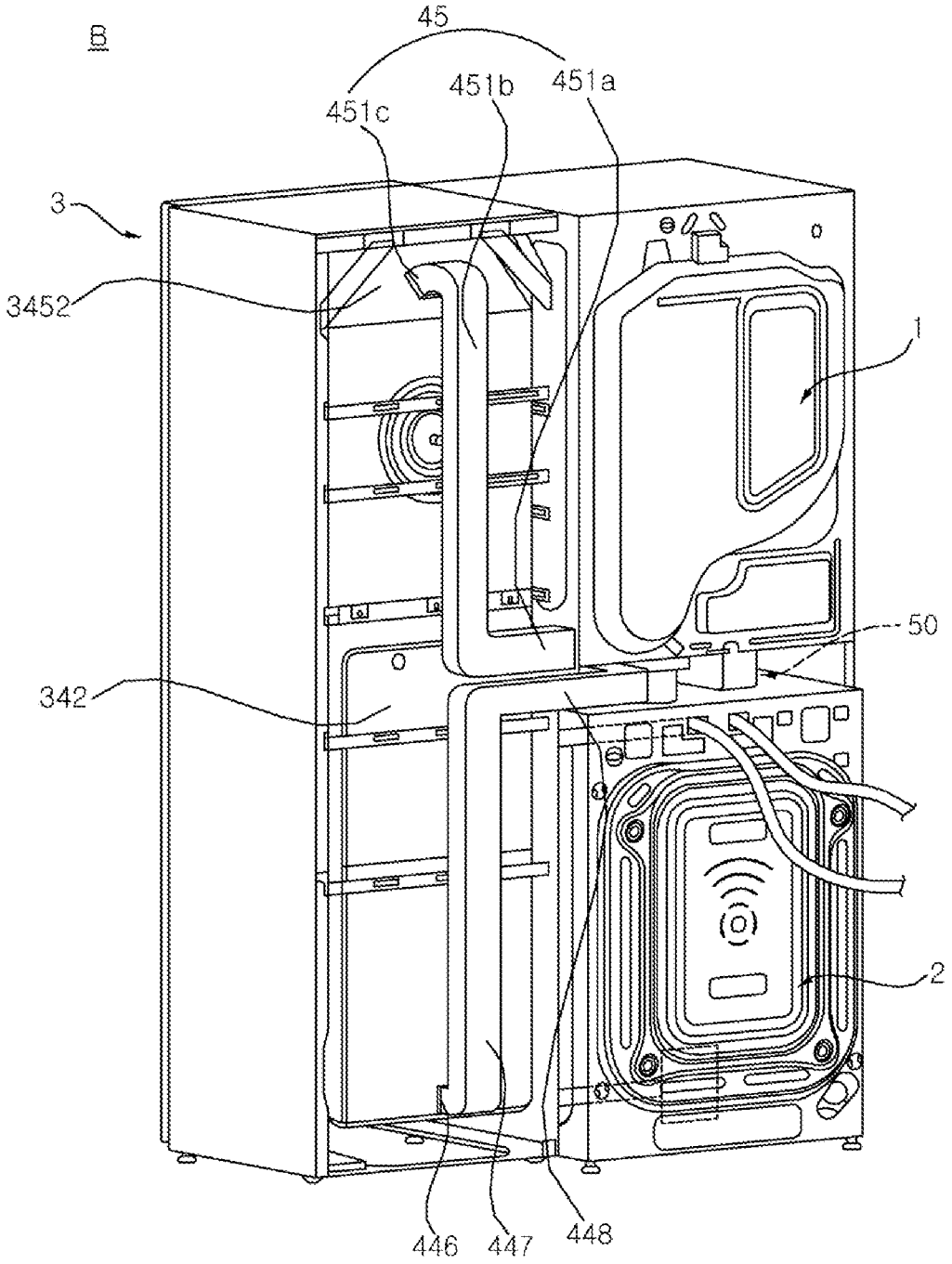
FIG. 15 is a rear perspective view of the laundry treating apparatus according to an embodiment of the present invention.
Figure 16:
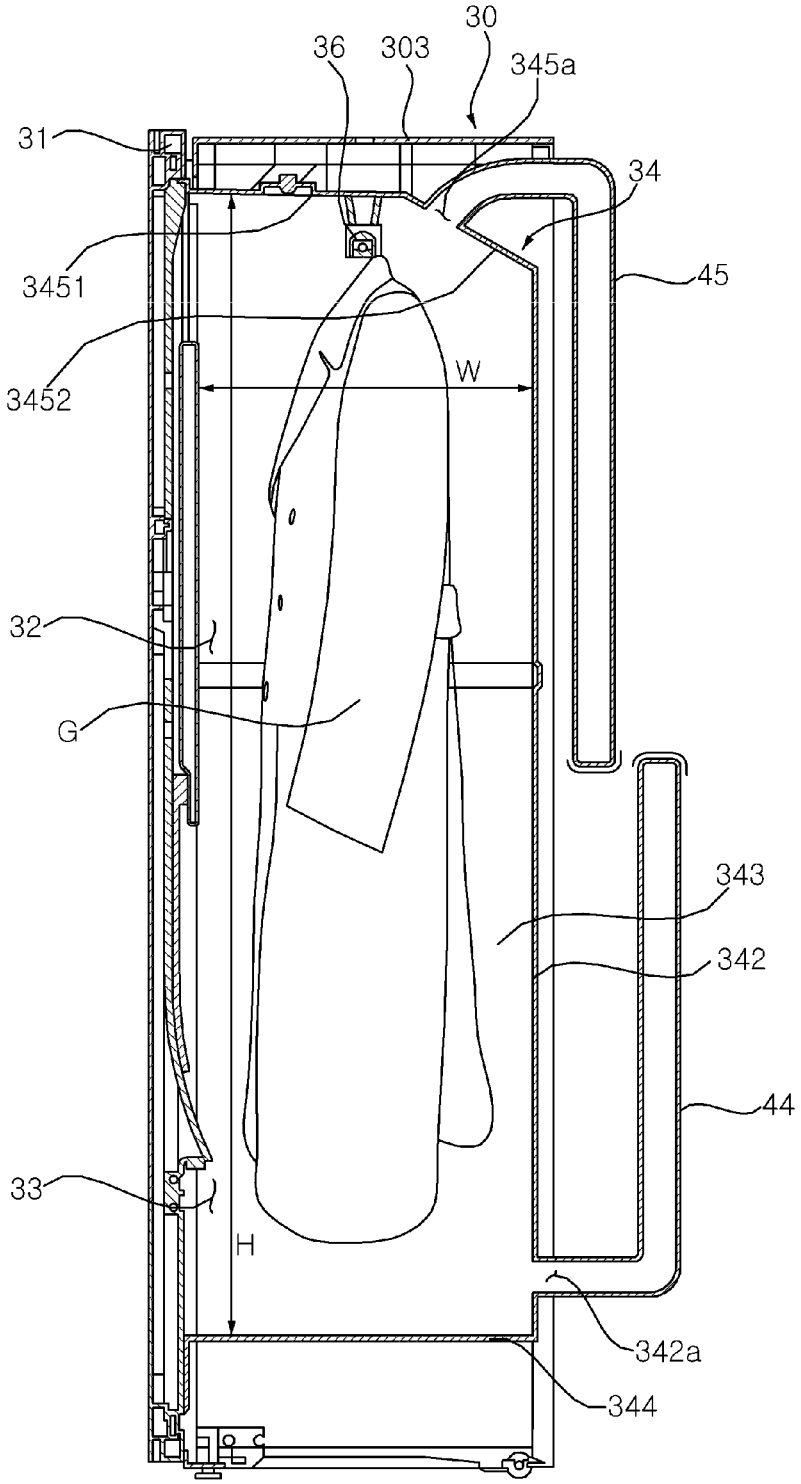
FIG. 16 is a cross-sectional view of the laundry treating apparatus according to an embodiment of the present invention.

Referring to FIGS. 15 and 16, the laundry treating apparatus B according to an embodiment of the present disclosure will be described below. A redundant description of the identical features, described above with reference to FIGS. 1 to 12, will be omitted.

Referring to FIG. 15, the second supply air duct 45 and the second exhaust air duct 44 for circulating hot air to the refresher 3 may be disposed in the rear of the third cabinet 30. The second supply air duct 45 and the second exhaust air duct 44 may be disposed behind the rear wall 342.

The second supply air duct 45 may be disposed between the rear wall 342 and the rear panel 102 of the dryer 1 in the forward and backward direction. The second supply air duct 45 may be disposed between the rear wall 342 and the rear panel 202 of the washing machine 2 in the forward and backward direction.

The second exhaust air duct 44 may be disposed between the rear wall 342 and the rear panel 102 of the dryer 1 in the forward and backward direction. The second exhaust air duct 44 may be disposed between the rear wall 342 and the rear panel 202 of the washing machine 2 in the forward and backward direction.

The second supply air duct 45 may extend upwardly from the heating device 50. The second supply air duct 45 may be connected to a supply air hole 345*a* (see FIG. 16) formed in the inner case 34.

The second supply air duct 45 may face the second side panel 206 of the washing machine 2. The second supply air duct 45 may be disposed parallel to the second side panel 206.

The second supply air duct 45 may include the first connection part 451*a* connected to the heating device 50, the first extension part 451*b* extending upwardly from the first connection part 451*a*, and the second connection part 451*c* coupled to the inner case 34. The second connection part 451*c* may be connected to the supply air hole 345*a*.

The first connection part 451*a* may be coupled to the first side panel 106 of the first cabinet 10. The first connection part 451*a* may be connected to the blowing duct 420, and the air blown by the fan 60 may be introduced through the first connection part 451*a*. The first connection part 451*a* may extend horizontally from the heating device 50.

The first extension part 451*b* may be bent upwardly from the first connection part 451*a*. The first extension part 451*b* may extend upwardly from one end of the first connection part 451*a*. The first extension part 451*b* may face the first side panel 106 of the dryer 1 and may be disposed parallel to the first side panel 106.

The second connection part 451*c* may be connected to the supply air hole 345*a*. The second connection part 451*c* may extend forwardly from the first extension part 451*b*.

The second connection part 451*c* may be inclined forwardly and downwardly. The supply air hole 345*a* may be opened forwardly and downwardly.

The second exhaust air duct 44 may include the third connection part 446 connected to the exhaust air hole 342*a*, the second extension part 447 extending upwardly from the third connection part 446, and the fourth connection part 448 connected to the heating device 50.

The third connection part 446 may be coupled to the rear wall 342. The third connection part 446 may communicate with the inner space 33 of the refresher 3, and air circulating in the refresher 3 may be introduced through the third connection part 446. The third connection part 446 may extend rearwardly from the rear wall 342.

The second extension part 447 may be bent upwardly from the third connection part 446. The second extension part 447 may extend upwardly from the third connection part 446. The second extension part 447 may face the second side panel 206 of the washing machine 2 and may be disposed parallel to the second side panel 206.

The fourth connection part 448 may extend into the separation space 55. The fourth connection part 448 may extend from the second extension part 447 in the left and right direction. The fourth connection part 448 may be connected to the heating device 50 in the separation space 55.

Referring to FIG. 16, the inner case 34 may provide the inner space 33, and laundry may be received in the space 33. The inner case 34 may include the bottom 344, the lateral side 343, the rear wall 342, and the ceiling 345.

The inner case 34 may include the ceiling 345 forming an upper surface thereof. The ceiling 345 may be connected to the lateral side 343 and the upper portion of the rear wall 342.

The ceiling 345 may include a first upper surface 3451 and a second upper surface 3452.

The first upper surface 3451 may form a front portion of the ceiling 345. The first upper surface 3451 may be disposed horizontally.

The hanger 36 may be disposed in the laundry receiving space 33. The hanger 36 may be connected to the ceiling 345. The hanger 36 may be held to the ceiling 345. The hanger 36 may be coupled to the ceiling 345.

The hanger 36 may be disposed at a position corresponding to the first upper surface 3451 in the forward and backward direction. The hanger 36 may be connected to the first upper surface 3451. The hanger 36 may be held to the first upper surface 3451. The hanger 36 may be coupled to the first upper surface 3451.

The second upper surface 3452 may form a rear portion of the ceiling 345. The second upper surface 3452 may extend rearwardly from the first upper surface 3451.

The second upper surface 3452 may be inclined. The second upper surface 3452 may be inclined downwardly toward the rear side. The second upper surface 3452 may be directed forwardly and downwardly.

The supply air hole 345*a* may be disposed in the second upper surface 3452. The supply air hole 345*a* may be opened forward and downward.

The supply air hole 345*a* may be disposed behind the hanger 36. The supply air hole 345*a* may be disposed at a position which is the same as or above the hanger 36.

The bottom 344 may form the lower surface of the inner case 34. The bottom 344 may define a lower end of the laundry receiving space 33. The bottom 344 may be disposed parallel to the lower panel 304.

The rear wall 342 may form the rear surface of the inner case 34. The rear wall 342 may be disposed parallel to the rear panel 302. The rear wall 342 may extend downwardly from the ceiling 345. The rear wall 342 may extend downwardly from the second upper surface 3452. The rear wall 342 may extend upwardly from the bottom 344.

The exhaust air hole 342*a* may be formed in the rear wall 342. The exhaust air hole 342*a* may be disposed at a lower portion of the rear wall 342.

The supply air hole 3443 may be connected to the second supply air duct 45. The supply air hole 3443 may allow the laundry receiving space 33 to communicate with the second supply air duct 45. The air in the second supply air duct 45 may be introduced into the laundry receiving space 33 through the supply air hole 3443.

The exhaust air hole 342*a* may be connected to the second exhaust air duct 44. The exhaust air hole 342*a* may allow the laundry receiving space 33 to communicate with the second exhaust air duct 44. The air in the laundry receiving space 33 may be discharged to the second exhaust air duct 44 through the exhaust air hole 342*a*.

The hot air discharged into the inner space 33 of the refresher 3 may dry the garments G, and then may flow into the second exhaust air duct 44 through the exhaust air hole 302*a*.

The supply air hole 345*a* may be disposed at an upper portion of the laundry receiving space 33, and the exhaust air hole 342*a* may be disposed at a lower portion of the laundry receiving space 33.

An upper portion of the clothing worn by a user may be generally more contaminated than a lower portion of the clothing. In the laundry treating apparatus according to an embodiment of the present disclosure, the supply air hole 345*a* may be formed at an upper portion, and the exhaust air hole 342*a* may be formed at a lower portion.

Accordingly, high temperature air may be supplied to the upper portion of the laundry receiving space, and the air may be discharged to the lower portion thereof.

Accordingly, a refresh cycle may be performed more intensively on the relatively more contaminated upper portion than the lower portion.

The heating device 50 may be positioned at an approximately intermediate height of the refresher 3. The second supply air duct 45 may extend upwardly from the heating device 50 to be connected to the supply air hole 345*a*. The second exhaust air duct 44 may extend downwardly from the heating device 50 to be connected to the exhaust air hole 342*a*.

The supply air duct 45 may be disposed ahead of the exhaust air duct 44. The supply air duct 45 may extend along the rear wall 342 at a position closer to the rear wall 342 than the exhaust air duct 44.

Accordingly, the passage for introducing air into the laundry receiving space 33 and the passage for discharging air from the laundry receiving space 33 may be arranged efficiently.

Accordingly, it is possible to reduce the loss of heat energy of the high temperature air, flowing through the supply air duct 45, when the heat energy is lost to a region other than the laundry receiving space 33.

Figure 17:
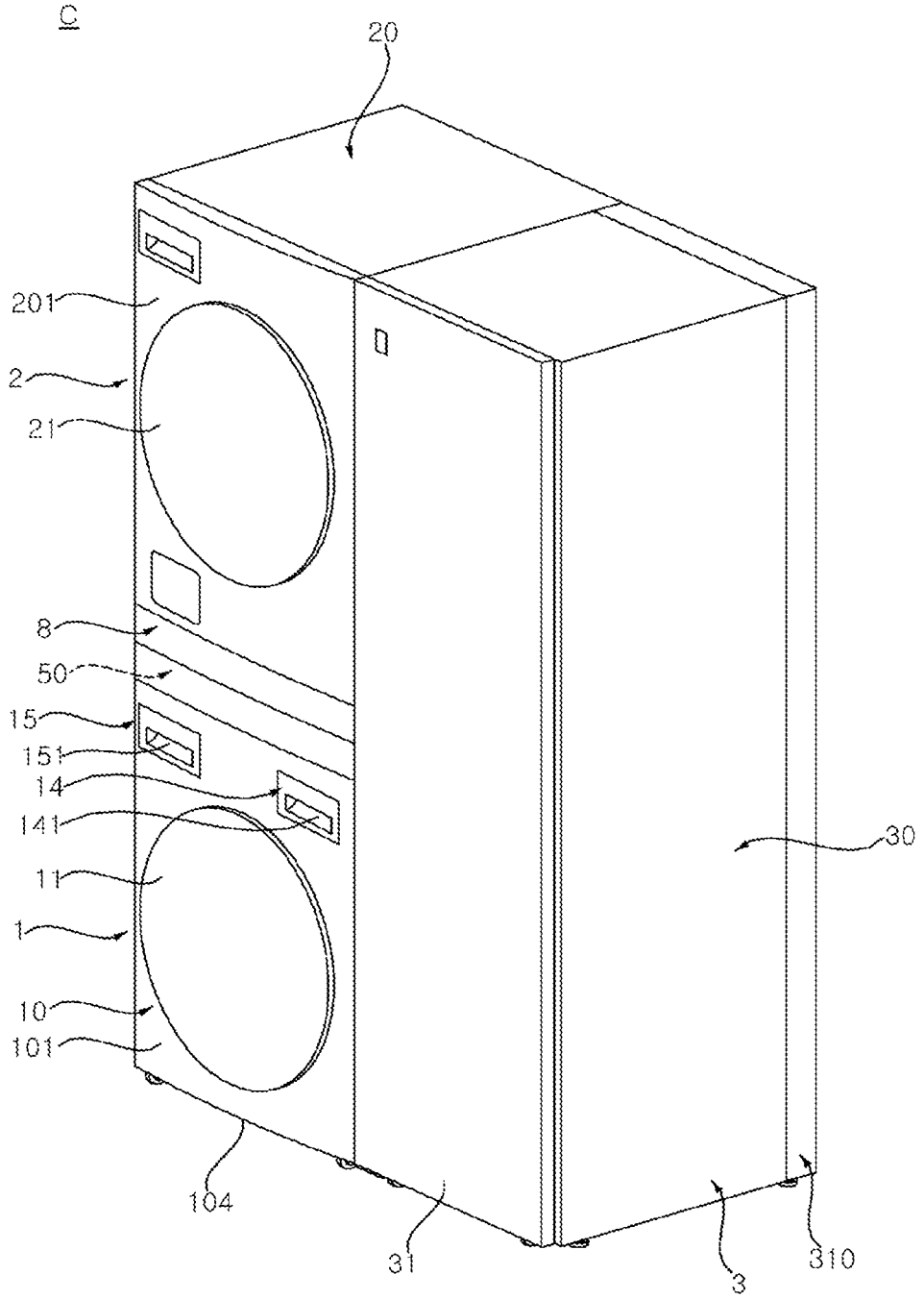
FIG. 17 is a front perspective view of a laundry treating apparatus according to an embodiment of the present disclosure.

Referring to FIG. 17, the laundry treating apparatus C according to an embodiment of the present disclosure will be described below. A redundant description of the identical features, described above with reference to FIGS. 1 to 12, will be omitted.

The washing machine 2, the dryer 1, and the heating device 50 (or the machine room S) may be arranged vertically, and the refresher 3 may be disposed on a lateral side of the washing machine 2 and the dryer 1. The heating device 50 may be disposed on a lateral side of the refresher 3.

The dryer 1 may be disposed under the washing machine 2.

The laundry treating apparatus C may include a drawer 14 formed therein which has a space for storing water. The drawer 14 may be disposed in the first cabinet 10. The drawer 14 may be disposed adjacent to the refresher 3. The drawer 14 may be disposed at the upper portion of the dryer 1. The drawer 14 may be disposed above the first door 11.

The drawer 14 may have a first handle 141. By holding the first handle 141, a user may withdraw the drawer 14. By withdrawing the drawer 14 to the outside of the first cabinet 10, the user may remove the water stored therein.

The laundry treating apparatus C may include a detergent supply device 15 formed therein which has a space for storing detergent. The detergent supply device 15 may be disposed in the first cabinet 10. The detergent supply device 15 may be disposed farther from the refresher 3 than the drawer 14. The detergent supply device 15 may be horizontally spaced apart from the drawer 14. The detergent supply device 15 may be disposed at the upper portion of the dryer 1. The detergent supply device 15 may be disposed above the first door 11.

The detergent supply device 15 may have a second handle 151. By holding the second handle 151, the user may withdraw the detergent supply device 15. By withdrawing the detergent supply device 15 to the outside of the first cabinet 10, the user may fill the detergent supply device 15 with detergent.

The heating device 50 may be disposed over the dryer 1. That is, the heating device 50 may be disposed between the washing machine 2 and the dryer 1 or may be disposed over the washing machine 2.

The control panel 8 may be disposed between the dryer 1 and the washing machine 2. A user may input a command to the laundry treating apparatus C through the control panel 8.

A longitudinal width of the refresher 3 may be smaller than a longitudinal width of the washing machine 2 and the dryer 1. The rear case 310 may be disposed in the rear of the refresher 3.

A plate may be disposed in a space between the washing machine 2 and the refresher 3 and in a space between the dryer 1 and the refresher 3. The plate may be a damping material. The dryer 1, the washing machine 2, and the refresher 3 may be coupled to each other by the plate.

The aforementioned second supply air duct 45 and second exhaust air duct 44 may be used as a passage for connecting the heating device 50 and the refresher 30 in the laundry treating apparatus C of the present disclosure.

Accordingly, the condensate generated in the evaporator may be discharged through the drain pump of the washing machine. In this case, a drawer may be disposed under the evaporator, and the condensate generated in the evaporator may be stored in the drawer without a separate pump.

Accordingly, the number of components required for the drainage decreases, thereby improving utilization of the inner space of the laundry treating apparatus.

Accordingly, a user does not need to bend down to take the wet laundry out of the washing machine after washing is complete.

Accordingly, after taking the washed heavy laundry out of the washing machine, the user may move the laundry to put it into the dryer.

Accordingly, convenience in drying after the washing cycle may be improved.

Referring to FIGS. 18 to 21, the laundry treating apparatus D according to an embodiment of the present disclosure will be described below. A redundant description of the identical features, described above with reference to FIGS. 1 to 16, will be omitted.

Figure 18:
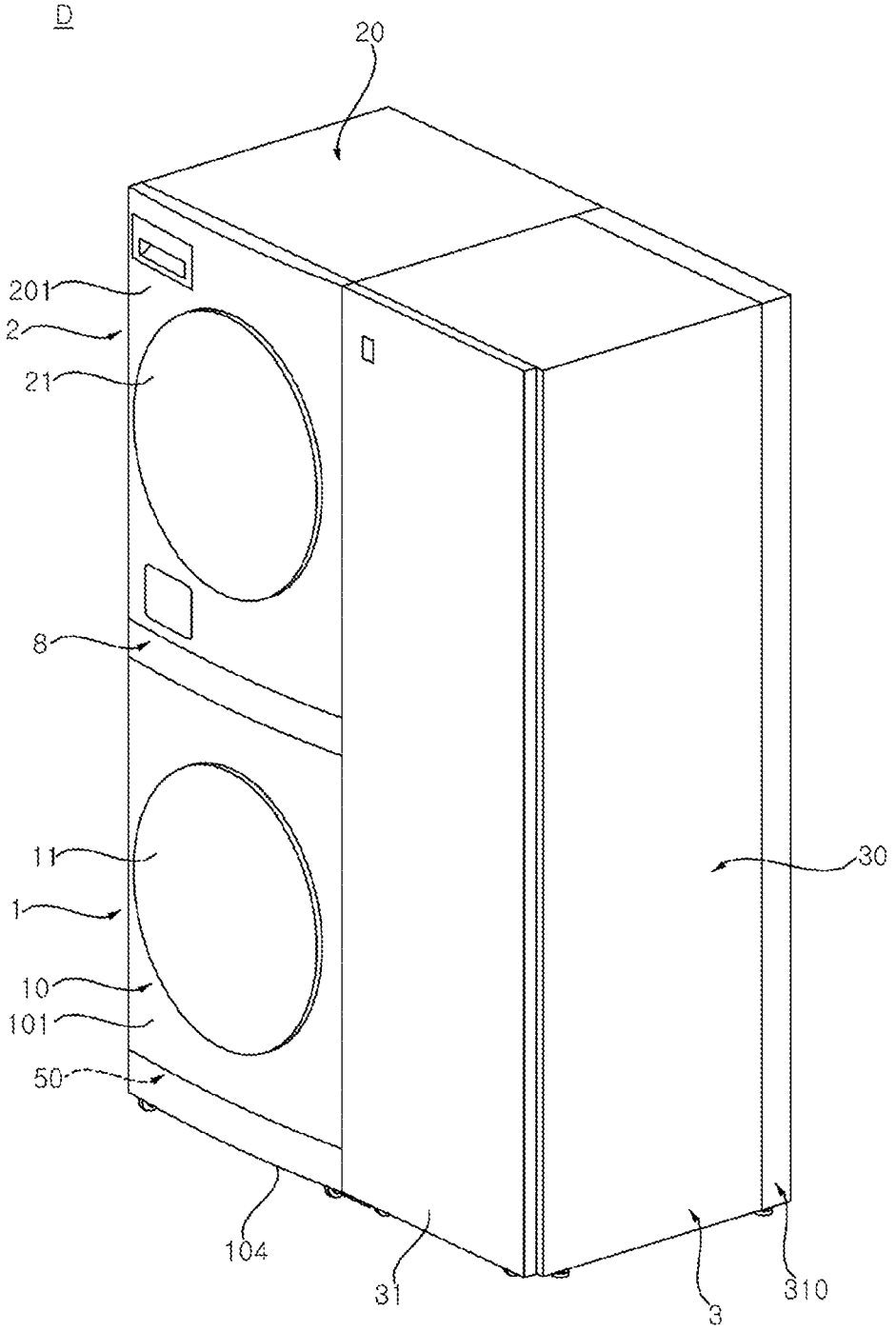
FIG. 18 is a front perspective view of a laundry treating apparatus according to an embodiment of the present disclosure.

Referring to FIG. 18, the washing machine 2, the dryer 1, and the heating device 50 (or the machine room S) may be arranged vertically, and the refresher 3 may be disposed on a lateral side of the washing machine 2 and the dryer 1. The heating device 50 may be disposed on a lateral side of the refresher 3.

The dryer 1 may be disposed under the washing machine 2. The heating device 50 may be disposed under the dryer 1.

A longitudinal width of the refresher 3 may be smaller than a longitudinal width of the washing machine 2 and the dryer 1. The rear case 310 may be disposed in the rear of the refresher 3.

A plate may be disposed in a space between the washing machine 2 and the refresher 3 and in a space between the dryer 1 and the refresher 3. The plate may be a damping material. The dryer 1, the washing machine 2, and the refresher 3 may be coupled to each other by the plate.

Figure 19:
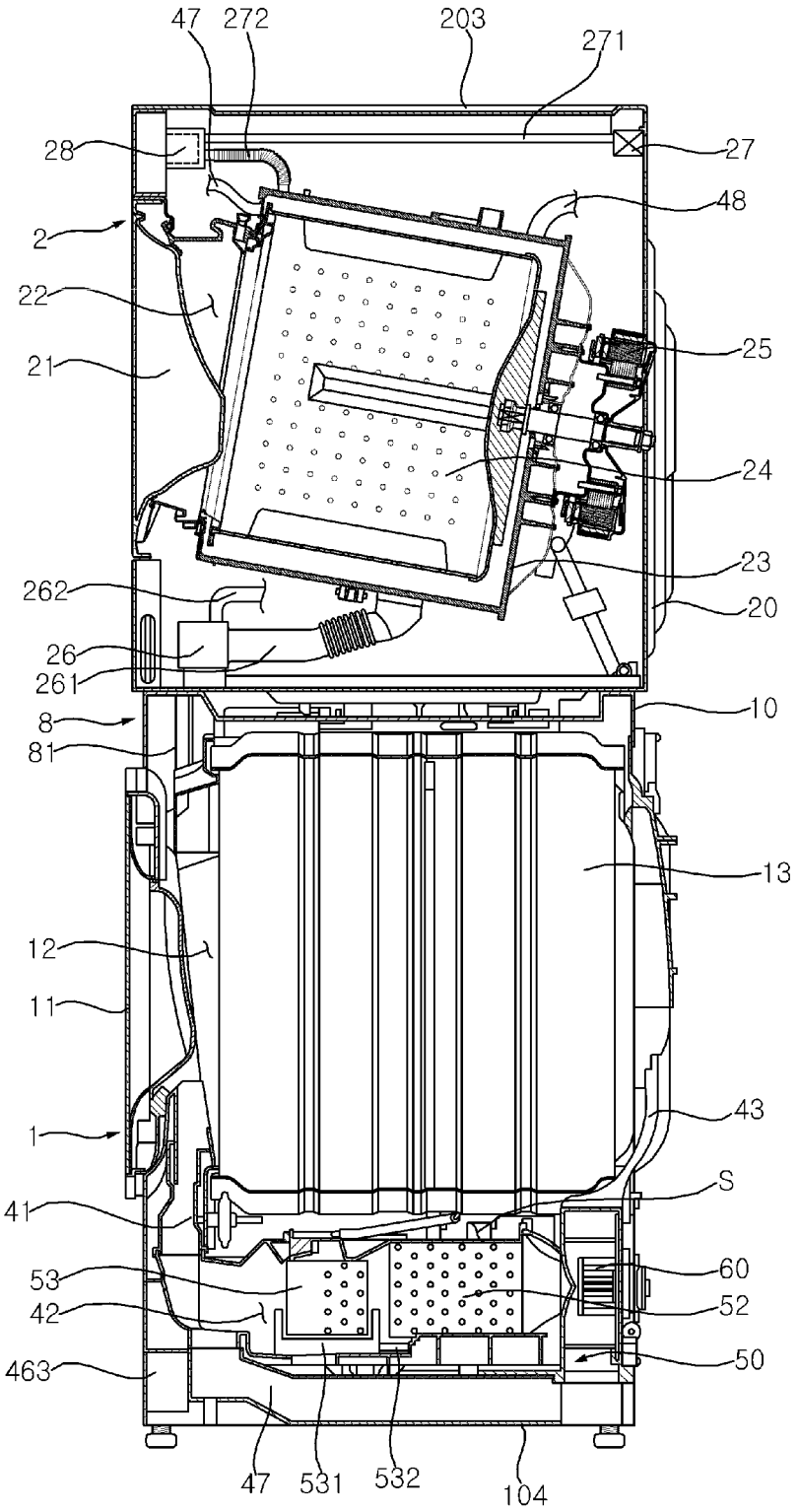
FIG. 19 is a cross-sectional view of the laundry treating apparatus according to an embodiment of the present disclosure.

Referring to FIG. 19, the dryer 1 may be disposed over the heating device 50. The drum 13 of the dryer 1 may be disposed over the heating device 50.

A connection of the dryer 1 and the heating device 50 may be the same as that in the laundry treating apparatus A described above with reference to FIGS. 1 to 12.

The washing machine 2 may be disposed over the dryer 1. The washing machine 2 may be connected to the heating device by the third supply air duct 48 and the third exhaust air duct 47.

The third supply air duct 48 may be connected to the tub 23. The third supply air duct 48 may be connected to the upper portion of the tub 23. The third supply air duct 48 may be connected to the rear portion of the tub 23.

The third exhaust air duct 47 may be connected to the tub 23. The third exhaust air duct 47 may be connected to the upper portion of the tub 23. The third supply air duct 48 may be connected to the front portion of the tub 23 or a gasket. The gasket may be a component connecting a front opening of the tub and a front opening of the cabinet.

Figure 20:
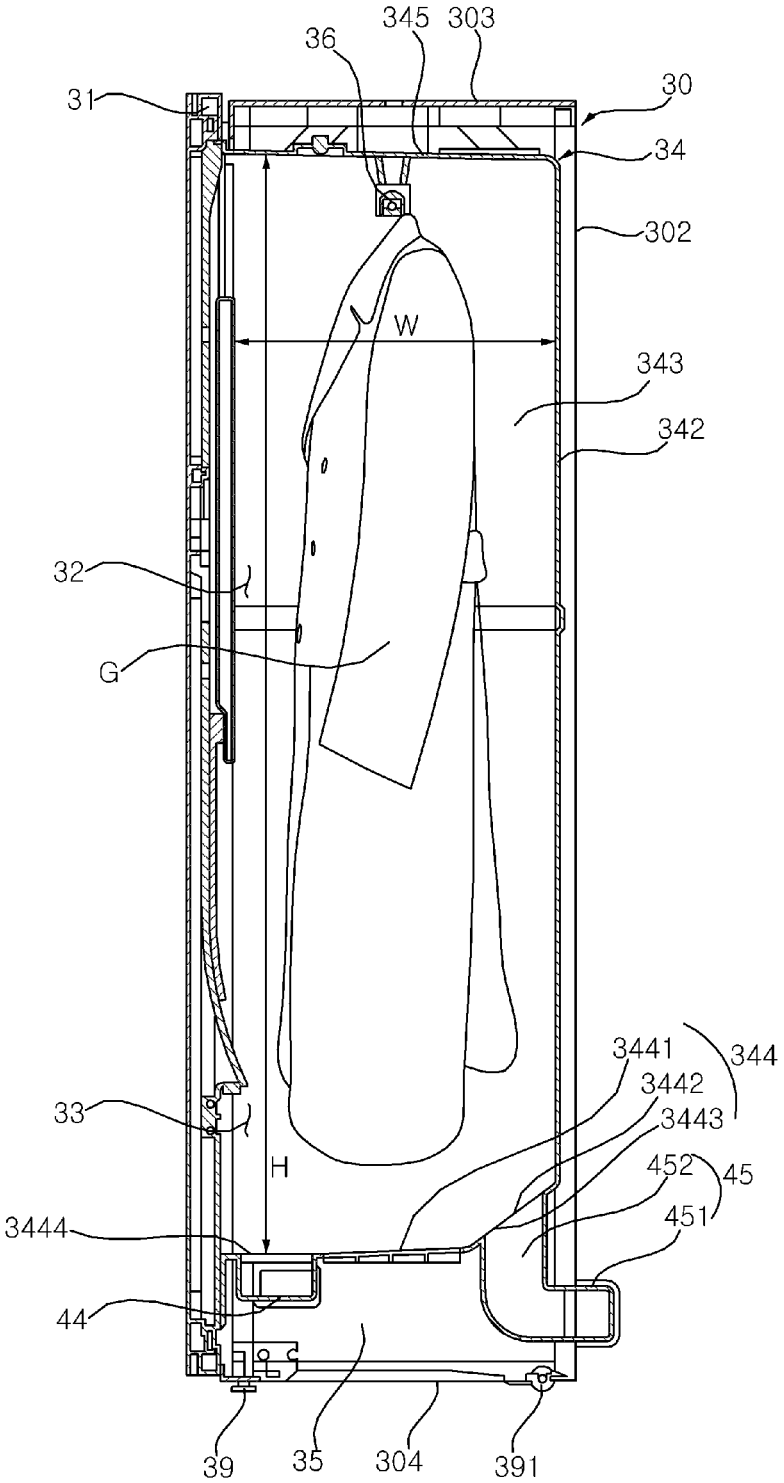
FIG. 20 is a cross-sectional view of the refresher according to an embodiment of the present disclosure.

Referring to FIG. 20, the inner case 34 may provide the inner space 33, and laundry may be received in the space 33.

The inner case 34 may include the bottom 344, the lateral side 343, the rear wall 342, and the ceiling 345.

The inner case 34 may include the ceiling 345 forming an upper surface thereof. The ceiling 345 may be connected to the lateral side 343 and the upper portion of the rear wall 342.

The bottom 344 may form a lower surface of the inner case 34. The bottom 344 may define a lower end of the laundry receiving space 33. The bottom 344 may be disposed parallel to the lower panel 304.

The bottom 344 may include the first bottom surface 3441 formed in the front thereof, and the second bottom surface 3442 formed in the rear thereof. The supply air hole 3443 may be formed in the bottom 344. The exhaust air hole 3444 may be formed in the bottom 344.

The supply air hole 3443 may be formed in the second bottom surface 3442. The second bottom surface 3442 may be inclined upwardly and forwardly.

The supply air hole 3443 may allow the laundry receiving space 33 to communicate with the second supply air duct 45. Air in the second supply air duct 45 may be introduced into the laundry receiving space 33 through the supply air hole 3443.

The second supply air duct 45 may include the first hot air duct 451 disposed in the rear of the third rear panel 302, and the second hot air duct 452 disposed in the front of the third rear panel 302.

The exhaust air hole 3444 may be formed in the first bottom surface 3441. The exhaust air hole 3444 may be formed on a side opposite to the supply air hole 3442 with respect to the center of the refresher 3 in the forward and backward direction. The exhaust air hole 3444 may be formed at a front portion of the bottom 344.

The exhaust air hole 3444 may be connected to the second exhaust air duct 44. The exhaust air hole 3444 may allow the laundry receiving space 33 to communicate with the second exhaust air duct 44. Air in the laundry receiving space 33 may be discharged to the second exhaust air duct 44 through the exhaust air hole 3444.

The second exhaust air duct 44 may be disposed under the bottom 344.

The rear wall 342 may form a rear surface of the inner case 34. The rear wall 342 may be disposed parallel to the rear panel 302. The rear wall 342 may extend upwardly from the bottom 344.

Figure 21:
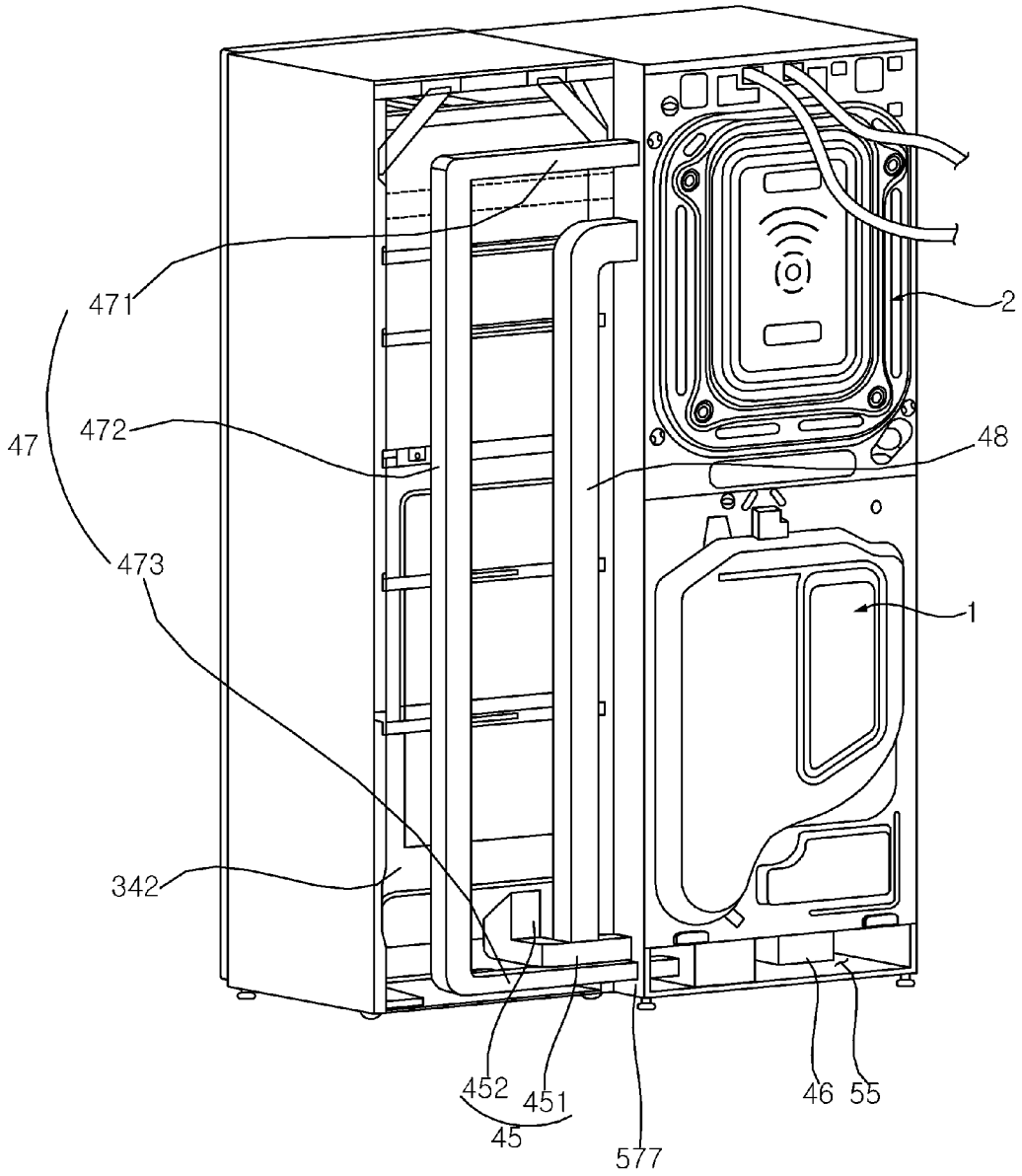
FIG. 21 is a rear perspective view of the laundry treating apparatus, from which the rear case is removed according to an embodiment of the present disclosure.

Referring to FIG. 21, the third supply air duct 48 may extend vertically on the rear side of the refresher 3. The third supply air duct 48 may be disposed in the rear of the inner case 34 of the refresher 3. The third supply air duct 48 may be disposed in the rear of the rear wall 342. The third supply air duct 48 may extend along the rear wall 342. The third supply air duct 48 may extend vertically along the rear wall 342.

The third supply air duct 48 may be disposed between the rear surface of the refresher 3 and the rear surface of the dryer 1 and/or the rear surface of the washing machine 2 in the forward and backward direction. The third supply air duct 48 may be disposed in the rear case 310.

The third supply air duct 48 may be connected to the heating device 50. The third supply air duct 48 may connect the heating device 50 and the tub 23 of the washing machine 2.

The third exhaust air duct 47 may extend vertically on the rear side of the refresher 3. The third exhaust air duct 47 may be disposed in the rear of the inner case 34 of the refresher 3. The third exhaust air duct 48 may be disposed in the rear of the rear wall 342. The third exhaust air duct 47 may extend along the rear wall. The third exhaust air duct 48 may extend vertically along the rear wall 342.

The third exhaust air duct 47 may be disposed between the rear surface of the refresher 3 and the rear surface of the dryer 1 and/or the rear surface of the washing machine 2 in the forward and backward direction. The third exhaust air duct 47 may be disposed in the rear case 310.

The third exhaust air duct 47 may be connected to the heating device 50. The third exhaust air duct 47 may connect the tub 23 of the washing machine 2 and the heating device 50.

The third exhaust air duct 47 may include a tub connector 471, a heating device connector 473, and an extension part 472 connecting the two connectors.

The tub connector 471 may be connected to the tub 23. The tub connector 471 may pass through the side panel in the washing machine 2 to extend to the rear of the refresher 3. The tub connector 471 may extend horizontally in the rear of the refresher 3.

The extension part 472 may extend downwardly from the tub connector 471. The extension part 472 may extend vertically along the rear wall 342. The extension part 472 may be disposed in the rear of the rear wall 342.

The heating device connector 473 may be connected to the extension part 472. The heating device connector 473 may extend from the extension part 472 toward the heating device 50 and may pass through the side wall (support plate 577) to be connected to the heating device 50. The heating device connector 473 may extend horizontally.

The dehumidification duct 46 may be connected to the heating device 50. The dehumidification duct 46 may be disposed under the dryer 2. The dehumidification duct 46 may discharge dried air to the outside.

Accordingly, a user does not need to bend down to take the wet laundry out of the washing machine after washing is complete.

Accordingly, after taking the washed heavy laundry out of the washing machine, the user may move the laundry to put it into the dryer.

Accordingly, convenience in drying after the washing cycle may be improved.

Accordingly, the length of the hot air passage connected to the dryer and the refresher may be minimized.

Accordingly, by reducing the length of the supply air duct connecting the heating device and the refresher, the heat loss of hot air supplied to the refresher may be minimized.

Accordingly, the laundry treating apparatus including a plurality of laundry treating machines may be provided with a minimum change in the existing laundry treating machines.

Hereinafter, the laundry treating apparatus E according to an embodiment of the present disclosure will be described with reference to FIG. 22. A redundant description of the identical features, which are described above, will be omitted.

Figure 22:
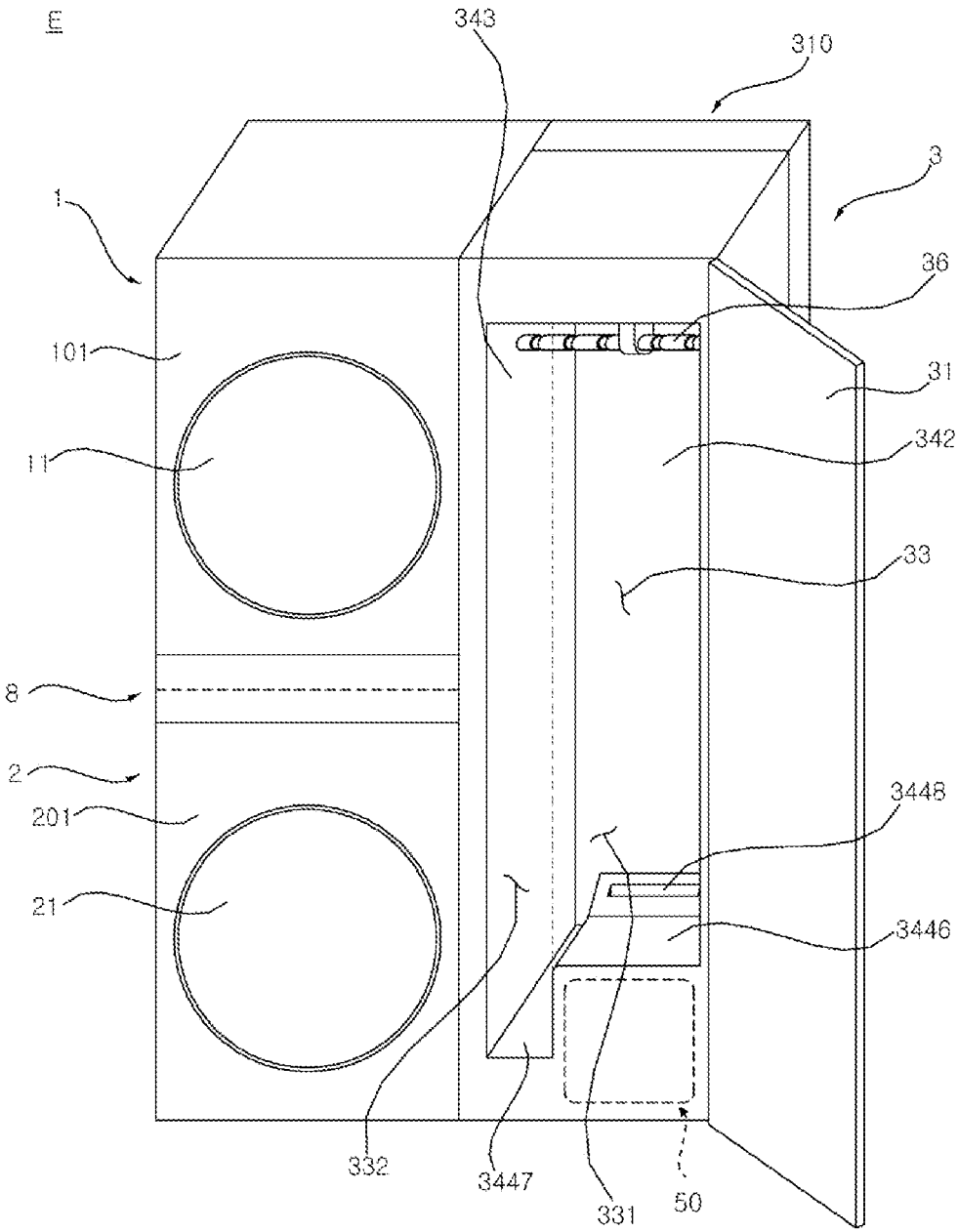
FIG. 22 is a front perspective view of a laundry treating apparatus according to an embodiment of the present disclosure.

Referring to FIG. 22, the heating device 50 may be disposed in the cabinet 30 of the refresher 3. The heating device 50 may include the heat exchange channel 42.

The dryer 1 may be disposed in the lateral direction of the refresher 3. The side panel of the dryer 1 may face the side panel of the refresher 3. The side panels of the dryer 1 and the refresher 3, which face each other, may come into contact with each other.

The washing machine 2 may be disposed vertically with respect to the dryer 1. For example, the washing machine 2 may be disposed under the dryer 1, and the dryer 1 may be disposed over the washing machine 2. Unlike the example, the dryer 1 may be disposed under the washing machine 1, and the washing machine 2 may be disposed over the dryer 1.

The control panel 8 may be disposed between the door 11 of the dryer 1 and the door 21 of the washing machine 2 in the vertical direction. The control panel 8 may be positioned at an approximately intermediate height of the laundry treating apparatus with a combination of the washing machine 2 and the dryer 1.

A lower part of the control panel 8 may receive a command associated with the control of a laundry treating machine located at the lower part, e.g., washing machine, and may display a state of the washing machine.

An upper part of the control panel 8 may receive a command associated with controlling a laundry treating machine located at the upper part, e.g., dryer 1, and may display a state of the dryer 1.

In addition, the control panel 8 may receive a command associated with controlling the refresher 3, and may display a state of the refresher 3.

The refresher 3 may include the inner case 34 providing the laundry receiving space 33. The laundry receiving space 33 may be divided into a first space 331 and a second space 332, as will be described below.

The hanger 36 may be provided at an upper portion of the laundry receiving space 33. The hanger 36 may be elongated in a width direction of the laundry receiving space 33. The hanger 36 may extend horizontally.

The inner case 34 may include the bottom 344 defining the lower surface of the laundry receiving space 33. The bottom 344 may include a first bottom 3446, and a second bottom 3447 recessed downwardly from the first bottom 3446.

The heating device 50 may be disposed under the bottom 344. The heating device 50 may be disposed between the lower panel 304 and the bottom 344. The heating device 50 may be disposed under the first bottom 3446.

The second bottom 3447 may be disposed on a lateral side of the heating device 50. The second bottom 3447 may be disposed below an upper end of the heating device 50.

A space above the first bottom 3446 may be referred to as the first space 331, and a space above the second bottom 3447 may be referred to as the second space 332. The second space 332 may have a greater height than the first space 331.

The first bottom 3446 and the second bottom 3447 may be arranged in a longitudinal direction of the hanger 36. The first bottom 3446 and the second bottom 3447 may be arranged horizontally.

For example, the second bottom 3447 may be disposed on a side panel side facing the washing machine 2 and/or the dryer 1, and the first bottom 3446 may be disposed on an opposite side.

The door 31 may be hingedly coupled to the cabinet 30. The door 31 may be coupled to the cabinet 30 by the hinge. The door 31 may be hingedly coupled to the cabinet 30 on a side opposite to the side panel that faces the washing machine 2 and/or the dryer 1.

A center of rotation of the door 31 may be located on the side opposite to the side panel that faces the washing machine 2 and/or the dryer 1.

Accordingly, the user may hang long clothes on the hanger 36 at a position where the second space 332 is formed.

A supply air hole 3448 may be formed in the bottom 344. The supply air hole 3448 may be formed in the first bottom 3446. The first bottom 3446 may have an inclined surface extending forwardly and upwardly and formed in the rear thereof, and the supply air hole 3448 may be disposed in the inclined surface.

Figure 23:
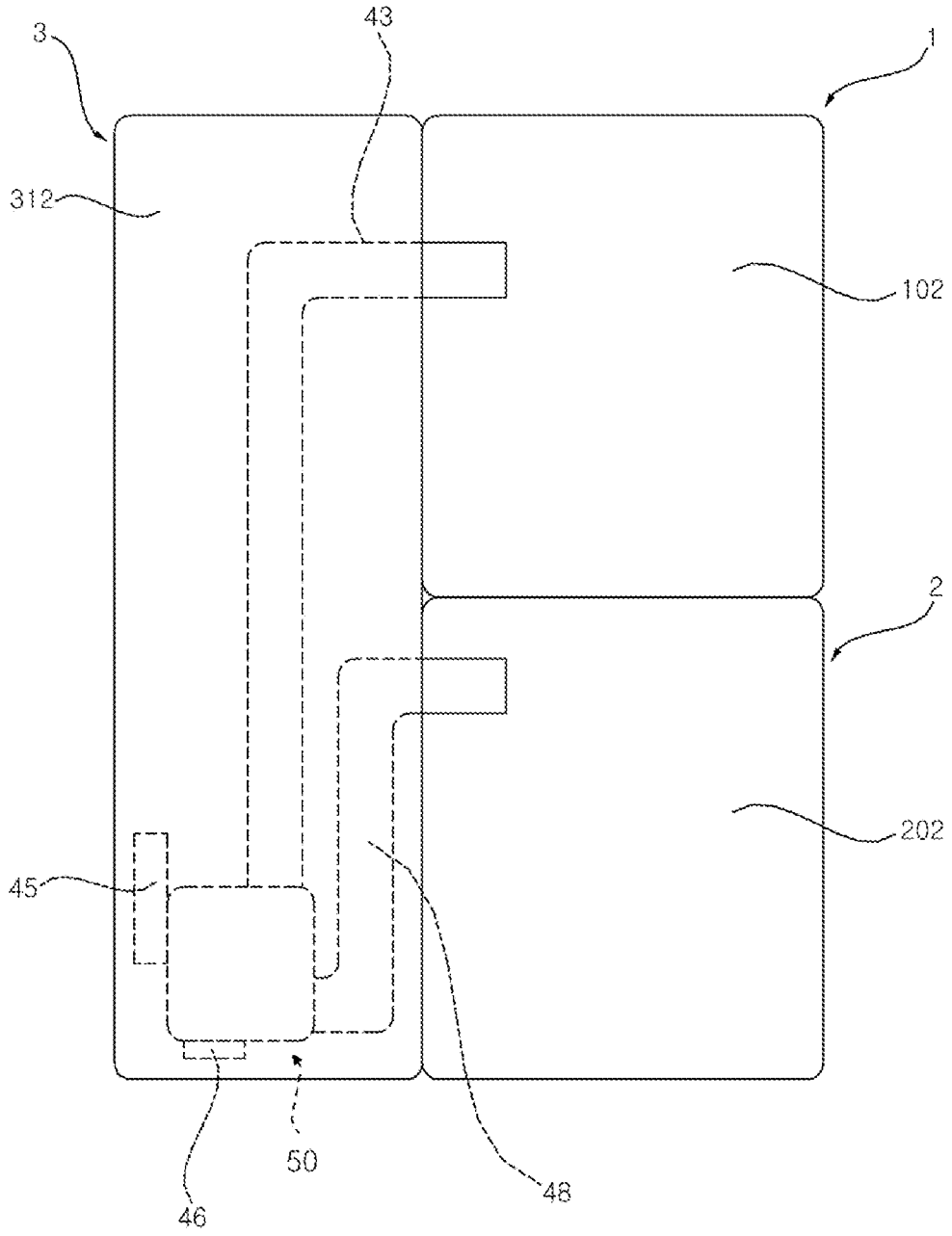
FIG. 23 is a conceptual cross-sectional view of a laundry treating apparatus according to an embodiment of the present disclosure.

Referring to FIG. 23, the heating device 50 provided in the refresher 3 may heat the air supplied to the dryer 1.

The heating device 50 may heat the air introduced into the inner space 33 of the refresher 3. The heating device 50 may heat the air introduced into the drum 13 of the dryer 1. The heating device 50 may heat the air introduced into the tub 23 of the washing machine 2.

The rear case 310 may be disposed in the rear of the refresher 3. The duct connecting the heating device 50 and the laundry treating machines 1, 2, and 3 may be disposed in the rear case 310.

The heating device 50 may be a concept that encompasses the switching device 70 and the blowing duct 420 (see FIG. 6). As descried above, the first to fourth discharge ports 425, 427, 426, and 428 may be connected to the first to third supply air ducts 43, 45, and 48 and the dehumidification duct 46, respectively.

The first supply air duct 43 connecting the dryer 1 and the heating device 50 may be disposed between the rear wall 342 of the inner case 34 and the dryer 1 and/or the rear surface of the washing machine 2. The first supply air duct 43 may extend vertically along the rear wall 342.

The first supply air duct 43 may be disposed between the rear wall 342 and the rear panel 312 of the rear case 310 in the forward and backward direction. The first supply air duct 43 may be disposed in the rear case 310.

The third supply air duct 48 connecting the washing machine 2 and the heating device 5 may be disposed between the rear wall 342 of the inner case 34 and the washing machine 2 and/or the rear surface of the dryer 1. The third supply air duct 48 may extend vertically along the rear wall 342.

The third supply air duct 48 may be disposed between the rear wall 342 and the rear panel 312 of the rear case 310 in the forward and backward direction. The third supply air duct 48 may be disposed in the rear case 310.

Accordingly, high temperature air may be supplied to the dryer 1 and/or the washing machine 2 through the heating device 50 of the refresher 3.

Accordingly, the dryer 1 and the washing machine 2 do not require a separate heating device.

Accordingly, the height of the laundry treating apparatus including the dryer 1 and the washing machine 2 may be reduced.

Accordingly, the height of the door of one of the dryer 1 and the washing machine 2, which is disposed over the other, in the laundry treating apparatus may be reduced.

Accordingly, the height of the control panel 8 for inputting a control command to one of the dryer 1 and the washing machine 2, which is disposed over the other, in the laundry treating apparatus may be reduced.

Accordingly, long clothes may be refreshed even when the heating device 50 is disposed in the refresher 3.

Accordingly, the front surface of the refresher 3 or the door 31 may be aligned with the front panels 201 and 101 of the washing machine 2 and/or the dryer 1.

Accordingly, the rear surface of the rear case 310 or the rear surface of the refresher 3 including the rear case 310 may be aligned with the rear surfaces of the dryer 1 and/or the washing machine 2.

Accordingly, the upper surface of one of the dryer 1 and the washing machine 2, which is disposed over the other, in the laundry treating apparatus may be aligned with the upper surface of the refresher 3.

A laundry treating apparatus may include an outer case, an inner case disposed in the outer case and providing a laundry receiving space that is opened forward, a supply air hole formed in the inner case and communicating with the laundry receiving space, a heat exchange channel having an inlet end where air is introduced and a discharge end where the air is discharged, a heating device configured to heat air passing through the heat exchange channel, and a supply air duct connecting the discharge end of the heat exchange channel and the supply air hole, and disposed in a rear of the inner case.

The laundry treating apparatus may be configured as above, wherein the supply air duct extends vertically in the rear of the inner case.

The laundry treating apparatus may be configured as above, wherein the inner case has a bottom defining a lower surface of the laundry receiving space, wherein the heating device is disposed above the bottom of the inner case.

The laundry treating apparatus may be configured as above, wherein the heating device is disposed outside of the outer case.

The laundry treating apparatus may be configured as above, wherein the inner case has a rear wall extending upwardly from the bottom and defining a rear surface of the laundry receiving space, wherein the supply air hole is disposed at a lower portion of the inner case; and the supply air duct is connected to the discharge end, and extends downwardly along the rear wall of the inner case to be connected to the supply air hole.

The laundry treating apparatus may be configured as above, and may further include an exhaust air hole formed in the inner case and communicating with the laundry receiving space and an exhaust air duct connecting the inlet end of the heat exchange channel and the exhaust air hole, and disposed in the rear of the inner case.

The laundry treating apparatus may be configured as above, wherein the inner case has the rear wall defining the rear surface of the laundry receiving space, wherein the exhaust air duct extends vertically along the rear wall.

The laundry treating apparatus may be configured as above, wherein the exhaust air hole is disposed at an upper portion of the inner case, and the exhaust air duct extends downwardly from the exhaust air hole to be connected to the inlet end.

The laundry treating apparatus may be configured as above, wherein the supply air hole and the exhaust air hole are disposed vertically on opposite sides with respect to the heat exchange channel.

The laundry treating apparatus may be configured as above, wherein the supply air hole is disposed at the lower portion of the inner case, and the supply air duct extends downwardly from the heat exchange channel to be connected to the supply air hole, and the exhaust air hole is disposed at the upper portion of the inner case, and the exhaust air duct extends upwardly from the heat exchange channel to be connected to the exhaust air hole.

The laundry treating apparatus may be configured as above, wherein the supply air hole is disposed at the upper portion of the inner case, and the supply air duct extends upwardly from the heat exchange channel to be connected to the supply air hole, and the exhaust air hole is disposed at the lower portion of the inner case, and the exhaust air duct extends downwardly from the heat exchange channel to be connected to the exhaust air hole.

The laundry treating apparatus may be configured as above, wherein the supply air duct and the exhaust air duct extend vertically along the rear wall of the inner case defining the rear surface of the laundry receiving space, wherein the supply air duct extends vertically at a position closer to the rear wall than the exhaust air duct.

The laundry treating apparatus may be configured as above, and may further include a rear case which is disposed in the rear of the inner case, and in which the supply air duct is disposed.

A laundry treating apparatus may include a dryer that includes a first cabinet having an opening formed on a front side thereof, a first door coupled to the first cabinet to open and close the opening, and a drum rotatably mounted in the first cabinet, a refresher that includes a second cabinet having an outer case disposed on a lateral side of the dryer and an inner case disposed in the outer case and providing a laundry receiving space that is opened forward, a second door coupled to the second cabinet to open and close the laundry receiving space, and a supply air hole formed in the inner case and communicating with the laundry receiving space, a duct system that includes a first supply air duct for supplying air into the drum, a second supply air duct connected to the supply air hole to supply air into the laundry receiving space, and a heat exchange channel connected to the first supply air duct and the second supply air duct and a heating device configured to heat air passing through the heat exchange channel, wherein the inner case has a smaller depth than the first cabinet in a forward and backward direction and the second supply air duct is disposed between a rear surface of the inner case and a rear surface of the first cabinet in the forward and backward direction.

The laundry treating apparatus may be configured as above, wherein the heating device is disposed horizontally with respect to the refresher.

The laundry treating apparatus may be configured as above, wherein the heating device is disposed vertically with respect to the drum.

The laundry treating apparatus may be configured as above, and may further include a washing machine including a third cabinet disposed vertically with respect to the first cabinet and having an opening, a third door coupled to the third cabinet to open and close the opening of the third cabinet, an outer tub disposed in the third cabinet, and an inner tub rotatably mounted in the outer tub.

The laundry treating apparatus may be configured as above, wherein the dryer is disposed over the washing machine; and the heating device is disposed between the drum of the dryer and the outer tub of the washing machine.

The laundry treating apparatus may be configured as above, wherein the first cabinet and the second cabinet are spaced apart from each other in a lateral direction, wherein the second supply air duct has an extension part extending across a rear of a space between the first cabinet and the second cabinet which are spaced apart from each other.

The laundry treating apparatus may be configured as above, wherein the extension part has a corrugated tube.

A laundry treating apparatus may include a first laundry treating machine including a first cabinet having a first opening formed on a front side thereof, a first door coupled to the first cabinet to open and close the first opening, and a first drum rotatably mounted in the first cabinet, a second laundry treating machine including a second cabinet disposed over the first cabinet and having a second opening formed on a front side thereof, a second door coupled to the second cabinet to open and close the second opening, and a second drum rotatably mounted in the second cabinet, a third laundry treating machine including a third cabinet disposed on a lateral side of the first laundry treating machine and the second laundry treating machine and providing a laundry receiving space that is formed in the third cabinet and is opened forward, and a third door coupled to the third cabinet to open and close the laundry receiving space, a duct system including a first supply air duct for supplying air into the first drum, a second supply air duct for supplying air into the second drum, and a heat exchange channel disposed under the first drum and connected to the first supply air duct and the second supply air duct, and a heating device configured to heat air passing through the heat exchange channel, wherein the second supply air duct is disposed in a rear of the third cabinet.

The laundry treating apparatus may be configured as above, wherein the second supply air duct is disposed between a rear surface of the laundry receiving space and a rear surface of the first cabinet in a forward and backward direction.

The laundry treating apparatus may be configured as above, and may further include a third supply air duct connecting a supply air hole, formed at a lower portion of the laundry receiving space, and the heat exchange channel.

A laundry treating apparatus may include a first laundry treating machine including a first cabinet having a first opening formed on a front side thereof, a first door coupled to the first cabinet to open and close the first opening, and a drum rotatably mounted in the first cabinet, a second laundry treating machine including a second cabinet disposed on a lateral side of the first laundry treating machine and having an outer case with a second opening formed on a front side thereof and an inner case disposed in the outer case and providing a laundry receiving space that is opened by the second opening, and a second door coupled to the second cabinet to open and close the laundry receiving space, a duct system including a first supply air duct for supplying air into the drum, a second supply air duct for supplying air into the laundry receiving space, and a heat exchange channel connected to the first supply air duct and the second supply air duct and a heating device configured to heat air passing through the heat exchange channel, and disposed under a bottom of the inner case.

The laundry treating apparatus may be configured as above, wherein the first supply air duct is disposed in a rear of the inner case.

The laundry treating apparatus may be configured as above, wherein the first supply air duct is disposed between a rear surface of the inner case and a rear surface of the first cabinet in a forward and backward direction.

The laundry treating apparatus may be configured as above, wherein the second laundry treating machine further includes a hanger provided at an upper portion of the laundry receiving space, wherein the bottom of the inner case includes a first bottom and a second bottom recessed downwardly from the first bottom, wherein the heating device is disposed under the first bottom.

The laundry treating apparatus may be configured as above, wherein the second cabinet includes a first side panel facing the first cabinet and a second side panel disposed on a side opposite to the first side panel, wherein the second door is hingedly coupled to the second cabinet at a position adjacent to the second side panel.

The laundry treating apparatus may be configured as above, wherein the second bottom is disposed adjacent to the first side panel.

The laundry treating apparatus may be configured as above, and may further include a third laundry treating machine including a third cabinet disposed under the first cabinet and having a third opening formed at a front portion thereof, a third door coupled to the third cabinet to open and close the third opening, and a drum rotatably mounted in the third cabinet and a third supply air duct connected to the heat exchange channel to supply air into the drum of the third laundry treating machine.

The laundry treating apparatus may be configured as above, wherein the third supply air duct is disposed in the rear of the inner case.

The laundry treating apparatus may be configured as above, wherein an upper surface of the first cabinet and an upper surface of the second cabinet are disposed on a same plane.

The laundry treating apparatus may be configured as above, further including a control panel disposed vertically between the first door and the second door, and configured to receive commands for the first laundry treating machine and the second laundry treating machine from a user.

Certain embodiments or other embodiments of the disclosure described above are not mutually exclusive or distinct from each other. Any or all elements of the embodiments of the disclosure described above may be combined with another or combined with each other in configuration or function.

For example, a configuration "A" described in one embodiment of the disclosure and the drawings and a configuration "B" described in another embodiment of the disclosure and the drawings may be combined with each other. Namely, although the combination between the configurations is not directly described, the combination is possible except in the case where it is described that the combination is impossible.

Various embodiments described herein may be implemented in a computer-readable medium using, for example, software, hardware, or some combination thereof. For example, the embodiments described herein may be implemented within one or more of Application Specific Integrated Circuits (ASICs), Digital Signal Processors (DSPs), Digital Signal Processing Devices (DSPDs), Programmable Logic Devices (PLDs), Field Programmable Gate Arrays (FPGAs), processors, controllers, micro-controllers, microprocessors, other electronic units designed to perform the functions described herein, or a selective combination thereof. In some cases, such embodiments are implemented by the controller. That is, the controller is a hardware-embedded processor executing the appropriate algorithms (e.g., flowcharts) for performing the described functions and thus has sufficient structure. Also, the embodiments such as procedures and functions may be implemented together with separate software modules each of which performs at least one of functions and operations. The software codes can be implemented with a software application written in any suitable programming language. Also, the software codes can be stored in the memory and executed by the controller, thus making the controller a type of special purpose controller specifically configured to carry out the described functions and algorithms. Thus, the components shown in the drawings have sufficient structure to implement the appropriate algorithms for performing the described functions.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A laundry treating apparatus comprising:

an outer case;

an inner case disposed in the outer case, the inner case providing a laundry receiving space that is opened in a front side of the inner case;

a supply air hole formed in the inner case, the supply air hole communicating with the laundry receiving space;

a heat exchange channel through which air flows, the heat exchange channel having an inlet end configured to introduce the air and a discharge end configured to discharge the air;

a heating device configured to heat the air passing through the heat exchange; channel;

a supply air duct connecting the discharge end of the heat exchange channel and the supply air hole;

an exhaust air hole formed in the inner case, the exhaust air hole communicating with the laundry receiving space; and an exhaust air duct connecting the inlet end of the heat exchange channel and the exhaust air hole, the exhaust air duct extending vertically.

2. The laundry treating apparatus of claim 1, wherein the supply air duct extends vertically and is disposed in a rear of the inner case.

3. The laundry treating apparatus of claim 1, wherein the inner case has a bottom defining a lower surface of the laundry receiving space, and wherein the heating device is disposed above the bottom of the inner case.

4. The laundry treating apparatus of claim 3, wherein the heating device is disposed outside of the outer case.

5. The laundry treating apparatus of claim 3, wherein the inner case has a rear wall extending upwardly from the bottom of the inner case, the rear wall defining a rear surface of the laundry receiving space, wherein the supply air hole is disposed at a lower portion of the inner case, and wherein the supply air duct extends downwardly along the rear wall of the inner case.

6. The laundry treating apparatus of claim 1, wherein the exhaust air hole is disposed at an upper portion of the inner case, and wherein the exhaust air duct extends downwardly from the exhaust air hole.

7. The laundry treating apparatus of claim 1, wherein the supply air hole and the exhaust air hole are disposed on opposite sides of the heat exchange channel.

8. The laundry treating apparatus of claim 1, wherein a vertical portion of the supply air duct is positioned closer to a rear wall of the inner case than a vertical portion of the exhaust air duct is positioned to the rear wall.

9. The laundry treating apparatus of claim 8, wherein the supply air hole is disposed at a lower portion of the inner case, wherein the supply air duct extends downwardly from the heat exchange channel, wherein the exhaust air hole is disposed at an upper portion of the inner case, and wherein the exhaust air duct extends upwardly from the heat exchange channel.

10. The laundry treating apparatus of claim 8, wherein the supply air hole is disposed at an upper portion of the inner case, wherein the supply air duct extends upwardly from the heat exchange channel to be connected to the supply air hole, wherein the exhaust air hole is disposed at a lower portion of the inner case, and wherein the exhaust air duct extends downwardly from the heat exchange channel.

11. The laundry treating apparatus of claim 1, wherein the inner case has a rear wall extending upwardly from a bottom of the inner case and defining a rear surface of the laundry receiving space, wherein the supply air duct and the exhaust air duct extend vertically along the rear wall of the inner case, and wherein a vertical portion of the supply air duct is positioned closer to the rear wall of the inner case than a vertical portion of the exhaust air duct is positioned to the rear wall.

12. The laundry treating apparatus of claim 1, further comprising a rear case disposed behind the inner case, wherein the supply air duct is disposed in the rear case.

* * * * *